United States Patent [19]

Taguchi et al.

[11] Patent Number: 5,058,217

[45] Date of Patent: Oct. 22, 1991

[54] WATER CLOSET BLOWING WARM AIR AND WATER CLOSET UNIT ATTACHABLE TO TOILET ROOM

[75] Inventors: Yasuhisa Taguchi; Makoto Endo; Ryuichi Kawamoto; Shiro Saito, all of Tokoname; Reigi Zaizen; Hiroshi Komachi, both of Anjyo; Naomasa Narita, Toyota; Kenichi Fujiwara, Kariya, all of Japan

[73] Assignees: Inax Corporation; Nippondenso Co., Ltd., both of Aichi, Japan

[21] Appl. No.: 342,031

[22] Filed: Apr. 24, 1989

[30] Foreign Application Priority Data

| | | | |
|---|---|---|---|
| Apr. 22, 1988 | [JP] | Japan | 63-100945 |
| Apr. 28, 1988 | [JP] | Japan | 63-107235 |
| Apr. 29, 1988 | [JP] | Japan | 63-108064 |
| May 10, 1988 | [JP] | Japan | 63-60609 |
| May 10, 1988 | [JP] | Japan | 63-60610 |
| May 10, 1988 | [JP] | Japan | 63-60612 |
| May 10, 1988 | [JP] | Japan | 63-60618 |

[51] Int. Cl.[5] ..... E03D 11/00

[52] U.S. Cl. ..... 4/420

[58] Field of Search ..... 4/420, 662, 408, 251, 4/233, 111.1, 209 R, 216, 545, DIG. 6, 420.2

[56] References Cited

U.S. PATENT DOCUMENTS

| | | | |
|---|---|---|---|
| 4,028,745 | 6/1977 | Caniglia | 4/420.2 |
| 4,063,316 | 12/1977 | Hunninghaus | 4/233 |
| 4,071,915 | 2/1978 | Kurataro | 4/217 |
| 4,329,745 | 5/1982 | Aguero | 4/408 |
| 4,411,030 | 10/1983 | Kawai et al. | 4/420.2 X |
| 4,422,989 | 12/1983 | Couviette | 4/420.2 |
| 4,451,942 | 6/1984 | Hirano et al. | 4/420.4 |
| 4,558,473 | 12/1985 | Morikawa et al. | 4/420.2 |
| 4,692,951 | 9/1987 | Taki et al. | 4/662 |
| 4,745,639 | 5/1988 | Wileman, III | 4/233 |
| 4,790,036 | 12/1988 | Vogeli et al. | 4/233 |
| 4,831,670 | 5/1989 | Velesquez | 4/408 |

FOREIGN PATENT DOCUMENTS

| | | |
|---|---|---|
| 0105377 | 4/1984 | European Pat. Off. . |
| 2503687 | 8/1987 | France . |
| 57-33642 | 2/1982 | Japan . |
| 63-104467 | 7/1988 | Japan . |
| 63-198666 | 12/1988 | Japan . |
| 63-311918 | 12/1988 | Japan . |
| 2137873 | 10/1984 | United Kingdom . |

*Primary Examiner*—Henry J. Recla
*Assistant Examiner*—Glenn T. Barrett
*Attorney, Agent, or Firm*—Sherman and Shalloway

[57] ABSTRACT

A sitting type water closet, comprising a toilet bowl, a warm air path for conveying the warm air to a front portion of the bowl, and warm air outlet disposed in a front portion of the bowl. Further, a water closet unit capable of attaching the same to a toilet room and blowing warm air out, comprising: an adapter having a means for fixing the adapter to the toilet room, and a warm air generator; and a sitting type water closet having a warm air duct for conveying warm air from the generator to a space in front of the water closet; the water closet being attached at the rear portion thereof to the adapter, and furthermore, a prefabricated toilet room unit including the above water closet unit are also disclosed.

2 Claims, 45 Drawing Sheets

49
50
51
41
50
29
51
23
20
30
4
22
24
25
26
54
51
12
28
75
1a
69
26
26
26
32
68
4
14
2
1
56
5
6
4
7
48
50
51
48a
46
61
47

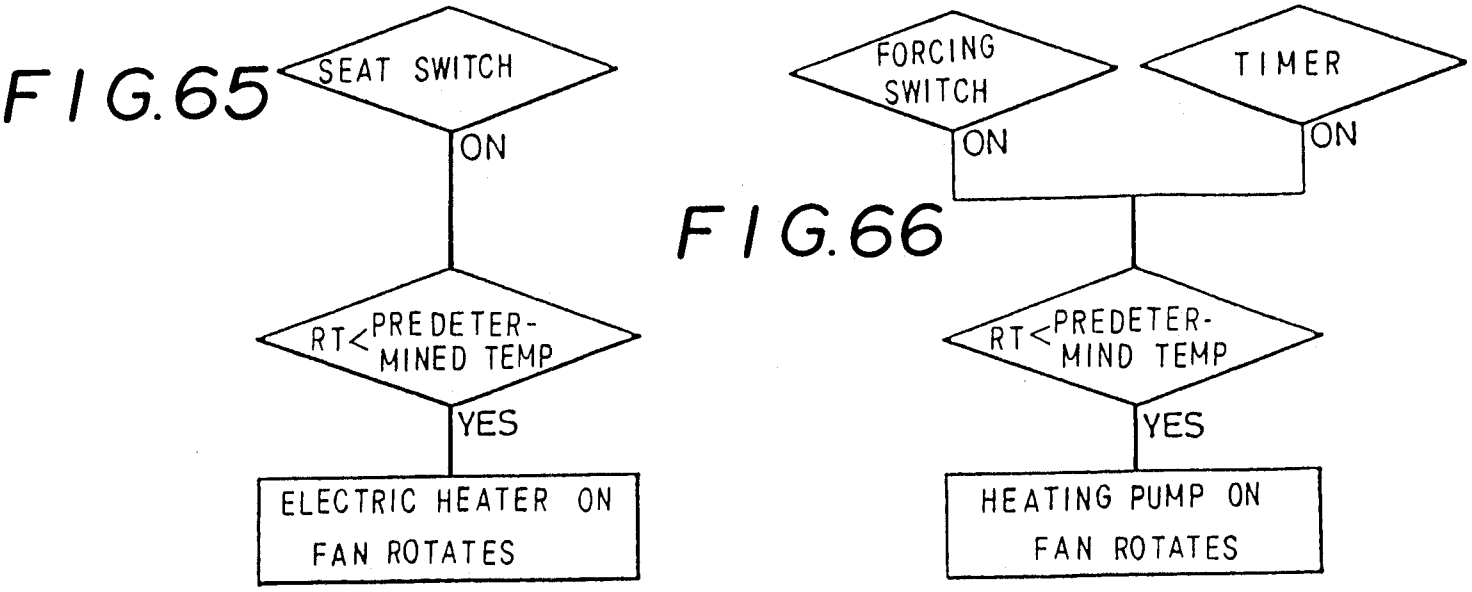
FIG.65
FIG.66
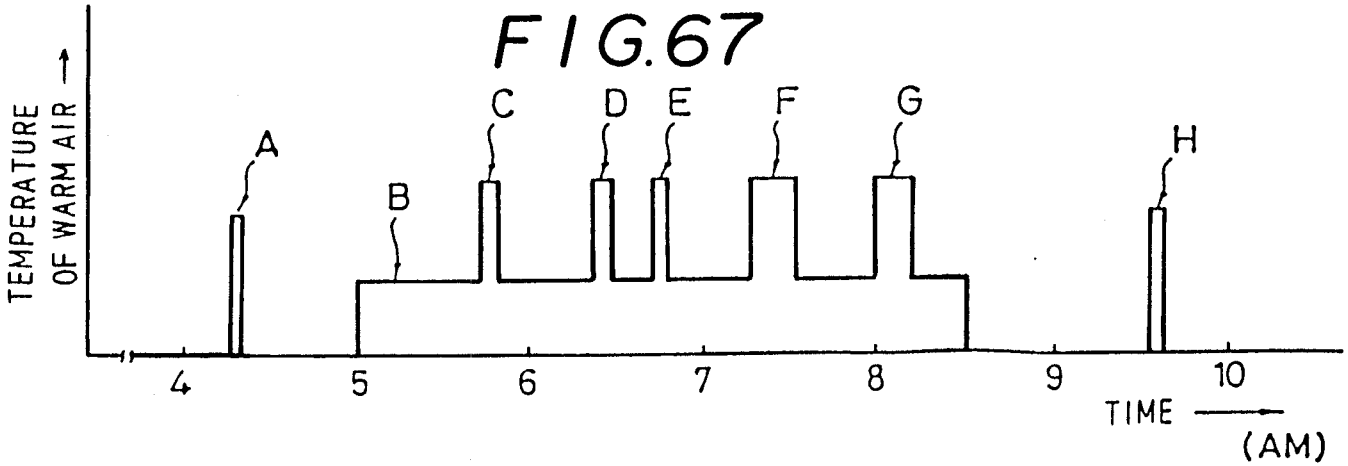
FIG.67

WATER CLOSET BLOWING WARM AIR AND WATER CLOSET UNIT ATTACHABLE TO TOILET ROOM

BACKGROUND OF THE INVENTION

1. Field of the Invention

The present invention relates to a sitting type water closet blowing warm air, and a water closet unit capable of attaching to a toilet room.

The term "sitting type water closet" used herein means a water closet utilized by sitting directly on a toilet seat thereof, and includes a bench type water closet (i.e, a water closet fixed on a side wall of a toilet room at a rear side of the water closet), a stool type water closet (i.e., a water closet mounted on a floor of the toilet room), a water closet fixed on the side wall and floor of the toilet room, and so on.

2. Description of the Related Art

A heatable toilet seat has become popular and thereby improves the user's feeling when a water closet is used. Recently, a portable electric heater is often furnished in the toilet room to wholly heat the room. Further, an air-conditioner such as a heat pump type air-conditioner is sometimes provided in the toilet room.

However, the toilet room can not be wholly heated by the heatable toilet seat.

The electric heater should be turned off for prevention of fire, when the toilet room is not used. The electric heater is not convenient to wholly heat the toilet room. There is a possibility to burn clothes of the user of the water closet, if the electric heater is too close. The heat is rapidly reduced, as the distance between the user and the heater is increased. When the toilet room is small, it is impossible to sufficiently separate the heater from the user. Thus, a power of the heater should be decreased, and a heating becomes unsufficient.

Although the air-conditioner, such as the heat-pump type air-conditioner, is used to wholly heat the toilet room, only the upper portion thereof is heated, but it is usually insufficient to heat the lower portion close to the leg of the user.

In Japan, there has been a recent increase in the number of houses in which so-called western-style water closet (i.e., sitting type water closet) is disposed instead of so-called Japanese-style water closet (i.e., a toilet tub in the form of a depression in the floor). The western-style water closet includes the bench type one. The western-style bench type water closet is disposed by attaching the same to the wall of the toilet room at the rear side of the water closet.

In the case of a concrete building, the western-style bench type water closet can be firmly attached to a front side wall of a counter which is mounted on the wall of the toilet room. In the case of an ordinary house, however, the wall is usually made of panels or wooden plates having a relatively low strength. Thus, the western-style bench type water closet can not be firmly attached to the wall.

SUMMARY OF THE INVENTION

The inventors of the present invention found that a heating can be effectively performed by applying warm air mainly to the leg of the user of the water closet. The inventors further completed an adapter which may firmly and easily attach the bench type water closet (which has a heating device using warm air), to the toilet room, even on the wall made of panels or wooden plates having a relatively low strength.

Accordingly, the object of the present invention is to provide a sitting type water closet having a means for applying warm air to the leg and the periphery thereof.

Another object of the present invention is to provide a water closet unit for attaching the sitting type water closet, particularly bench type water closet, having a means for applying warm air to the leg, to the side wall of the toilet room.

Other objects and advantages of the present invention will be apparent from the following description.

In accordance with the present invention, there is provided a sitting type water closet, comprising a toilet bowl, a warm air path for conveying warm air to a front portion of the bowl, and a warm air outlet disposed in a front portion of the bowl.

Further, in accordance with the present invention, there is also provided a water closet unit capable of the same attaching to a toilet room and blowing warm air out, comprising:

an adapter having a means for fixing the adapter to the toilet room, and a warm air generator;

and a sitting type water closet having a warm air duct for conveying warm air from the generator to a space in front of the water closet;

the bowl being attached at the rear portion thereof to the adapter.

The term "front" portion or "front" space as used herein with respect to the water closet or bowl means the direction which the face of the sitting user turns toward. Thus, the term "rear" as used herein means the direction which the back of the sitting user turns toward.

BRIEF DESCRIPTION OF THE DRAWINGS

FIGS. 65 and 66 are flow charts thereof, and FIG. 67 is a time chart thereof.

DESCRIPTION OF THE PREFERRED EMBODIMENTS

Figure 1:
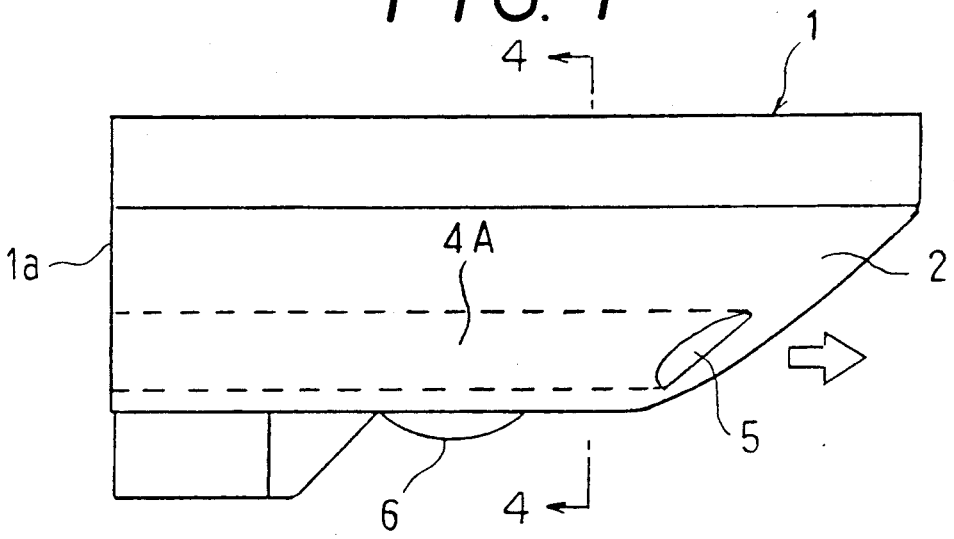
FIG. 1 is a side elevation view of a first embodiment of the water closet according to the present invention.
Figure 2:
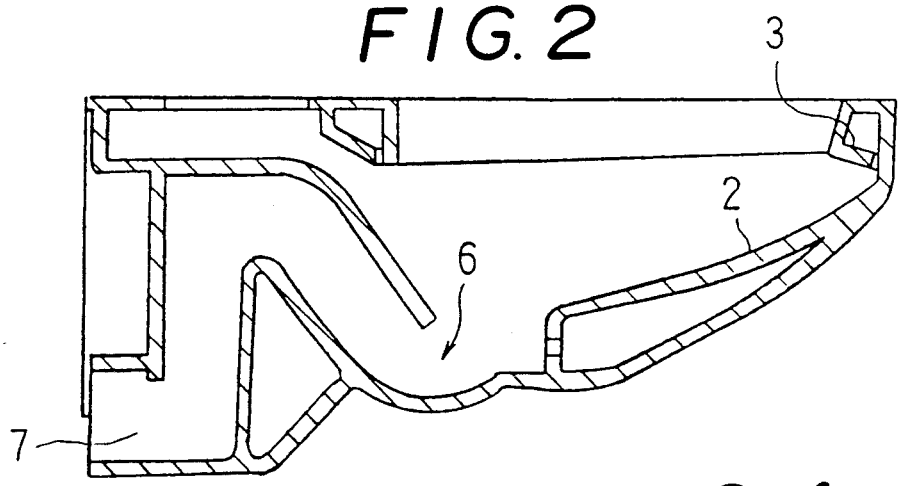
FIG. 2 is a sectional view taken on line II—II of FIG. 3.
Figure 3:
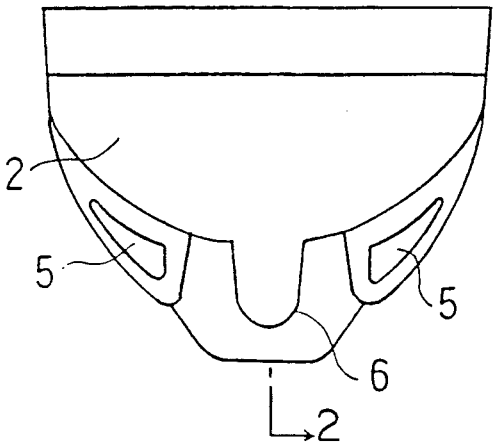
FIG. 3 is a front view of FIG. 1.
Figure 4:
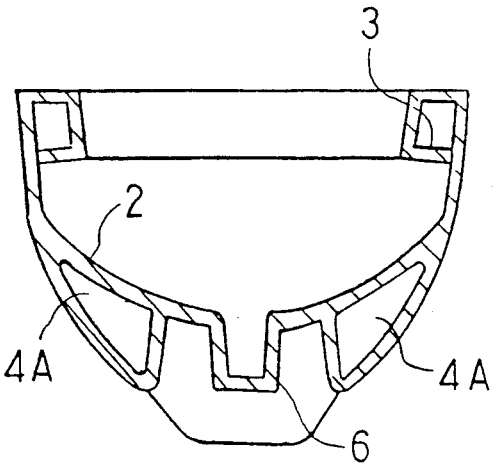
FIG. 4 is a sectional view taken on line IV—IV of FIG. 1.

The preferred embodiments of the sitting type water closet according to the present invention will be explained hereinafter.

The sitting type water closet of the present invention has a warm air path (comprising a warm air duct, and optionally a warm air guiding groove) so that warm air may be blown out from the front portion of the water closet.

In the water closet according to the present invention, the warm air is blown out from the front portion thereof, and thus, the user can be heated mainly around the leg. Because the heating is carried out with the warm air, there is no possibility to burn the clothes. If the warm air continues to be blown out when the toilet room is not used, it is possible to wholly heat the room. Therefore, the water closet may be very comfortably employed, particularly in a low temperature season, e.g., winter. During a humid season, e.g., the rainy season, it is possible to avoid dew condensation on the water closet by blowing the warm air out.

Typical embodiments of the present invention will be explained hereinafter referring to the drawings.

FIGS. 1 to 4 show a first embodiment of the present invention. The western-style bench type water closet 1 is attached to the side wall of the toilet room or the like at the rear side la of the closet. A toilet bowl 2 is provided to the front portion of the closet 1, and a rim water conduit 3 is provided to the upper portion of the bowl 2, surrounding the bowl 2. In the water closet 1, the warm air duct 4A is disposed integrally with the bowl 2, extending longitudinally, i.e., from the rear portion of the bowl to the front portion of the bowl. The warm air duct 4A is ended at the front portion of the bowl 2 to form a warm air outlet 5. The other end of the warm air duct 4A is open at the rear side 1*a* of the water closet 1. The water closet 1 further contains a trap 6 and a drainage hole 7.

The water closet according to the above embodiment can blow the warm air out from the outlet 5, by disposing a warm air generator (refer to FIG. 25, etc.) connected with the warm air duct 4A. The warm air blown from the outlet touches a lower half of the user's body, particularly a calf, to thereby heat the user. Because the heating is carried out with the warm air, the clothes are not burnt. If the warm air is blown out even when the water closet is not employed, the toilet room may be wholly heated.

Figure 5:
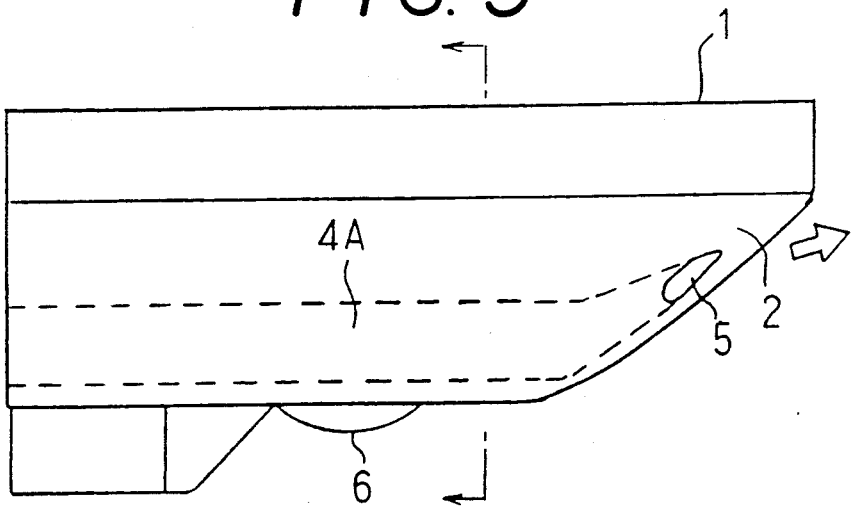
FIG. 5 is a side elevation view of a second embodiment of the water closet of the present invention.
Figure 6:
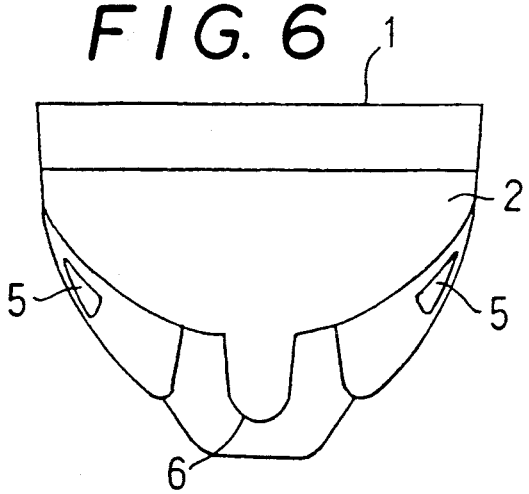
FIG. 6 is a front view of FIG. 5.
Figure 7:
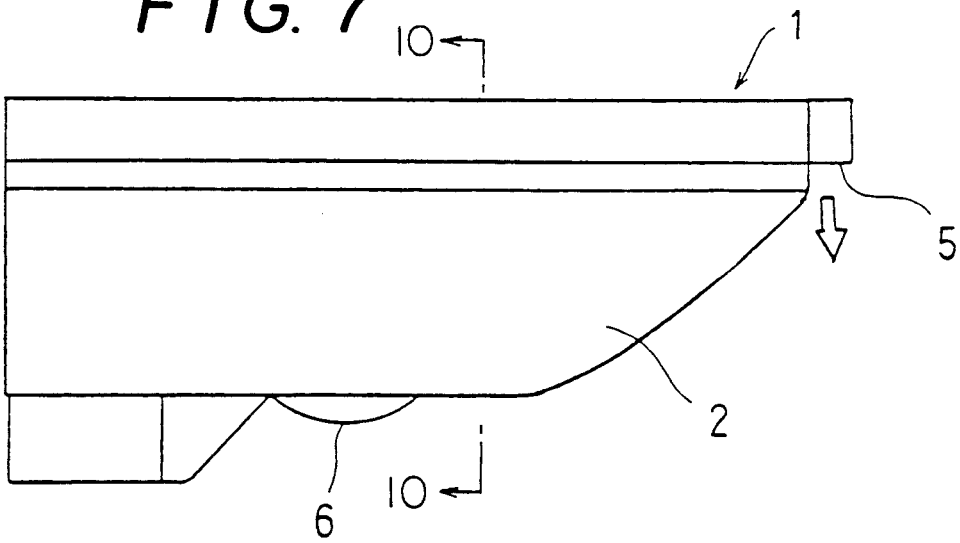
FIG. 7 is a side elevation view of a third embodiment of the water closet according to the present invention.

FIGS. 5 and 6 show a second embodiment of the present invention. In the water closet 1 of this embodiment, the outlet 5 is disposed at the position higher than that of the above embodiment shown in FIGS. 1 to 4. The warm air duct 4A is also disposed at the front portion of the bowl 2, diagonally upwardly extending from the rear portion to the front portion. Therefore, the warm air is blown out diagonally upwardly, and thus, the upper part in the leg of the user is heated.

Figure 8:
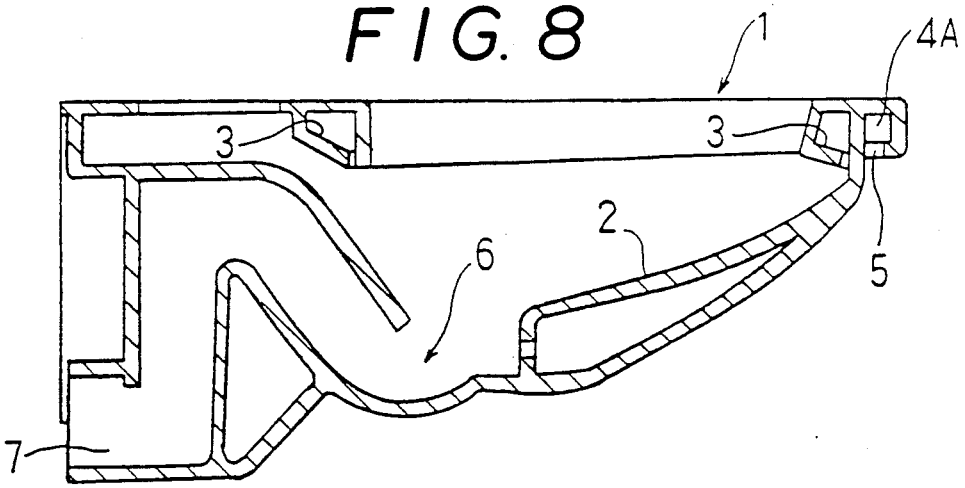
FIG. 8 is a sectional view taken on line VIII—VIII of FIG. 9.
Figure 9:
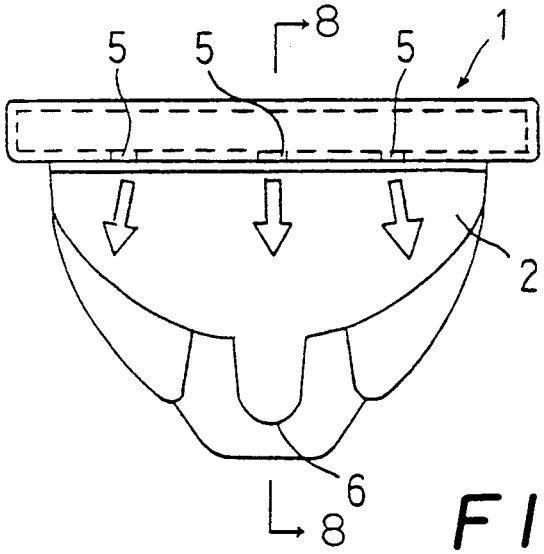
Figure 10:
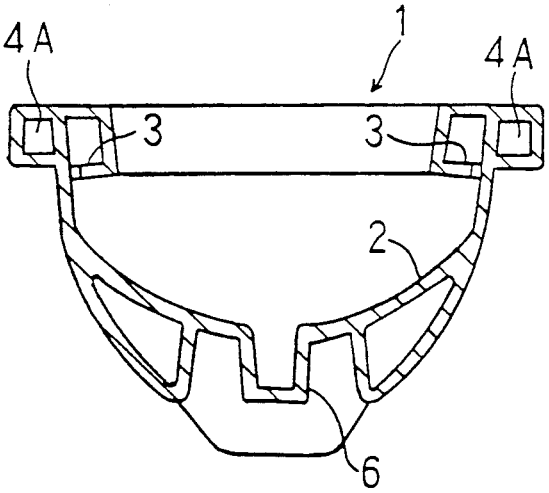
FIG. 10 is a sectional view taken on line X—X of FIG. 7.

FIGS. 7 to 10 show a third embodiment of the present invention. In the water closet 1 of this embodiment, the warm air duct 4A is disposed along the upper periphery of the bowl 2. As shown in FIGS. 8 and 10, the warm air duct 4A surrounds the outer periphery of the rim water conduit 3, at the front portion of the toilet bowl 2. The outlet 5 is formed in the form of opening disposed in the bottom wall of the warm air duct 4A at the front portion of the bowl 2. In the embodiment as shown, three outlets are disposed, although any number of the outlets 5 may be formed.

Figure 11:
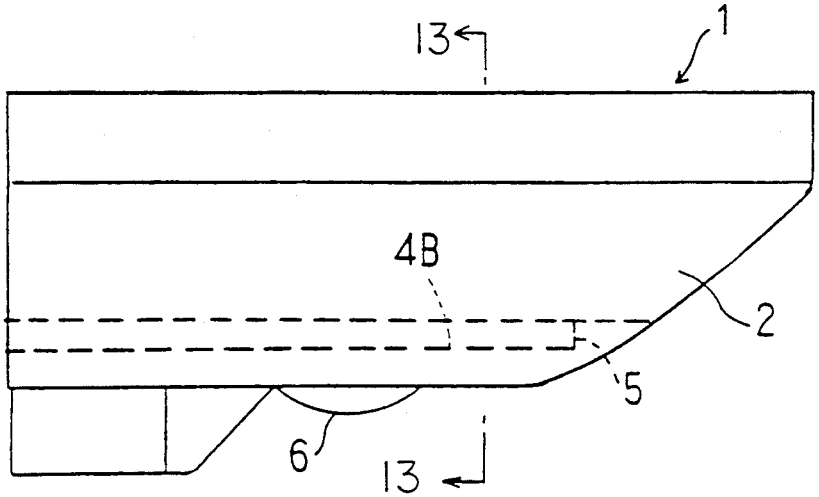
FIG. 11 is a side elevation view of a fourth embodiment of the water closet of the present invention.
Figure 12:
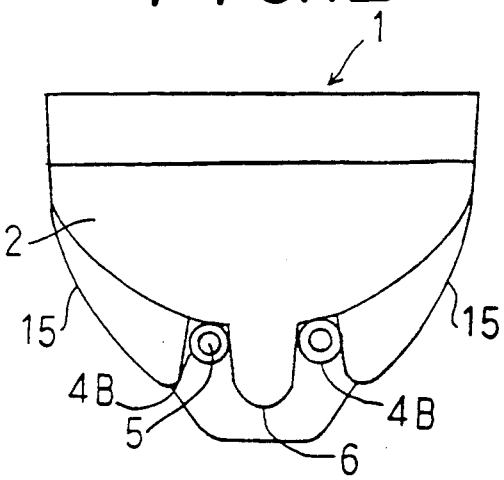
FIG. 12 is a front view of FIG. 11.
Figure 13:
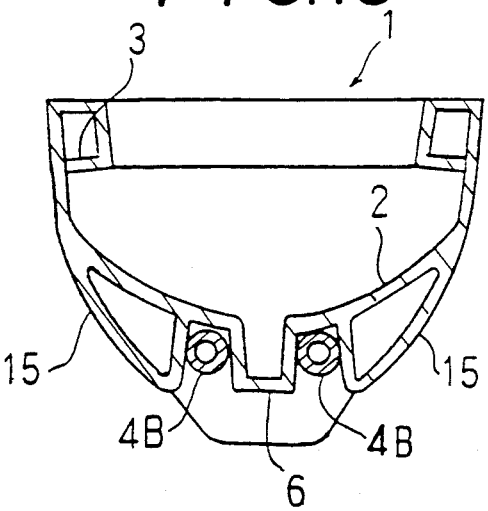
FIG. 13 is a sectional view taken on line XIII—XIII of FIG. 11.

FIGS. 11 to 13 illustrate a fourth embodiment of the present invention. In this embodiment, the warm air duct 4B formed separately from the bowl 2 is disposed along the bottom surface of the bowl 2, extending longitudinally, i.e., from the rear portion of the bowl to the front portion of the bowl. The outlet 5 is formed at the end of the duct 4B. In this embodiment, a cover 15 for the bowl 2 is arranged. The duct 4B is disposed in a space between the cover 15 and trap 6.

Figure 14:
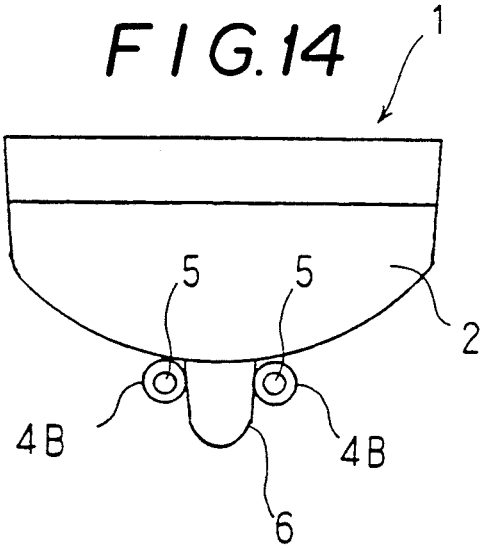
FIG. 14 is a front view of a fifth embodiment of the water closet of the present invention.
Figure 15:
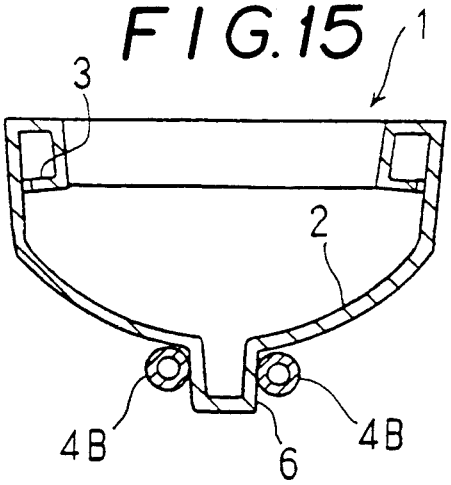
FIG. 15 is a sectional view of FIG. 14.

FIGS. 14 and 15 show the water closet 1 corresponding to fifth embodiment of the present invention. This embodiment is different from the above fourth embodiment with respect to the fact that the cover for the bowl 2 is not provided, and thus, the warm air duct 4B is exposed.

In the fourth and fifth embodiments as shown in FIGS. 11 to 15, the warm air duct 4B can be attached to the water closet without changing the conventional shape of the closet per se. Thus, the water closet can be easily manufactured.

Figure 16:
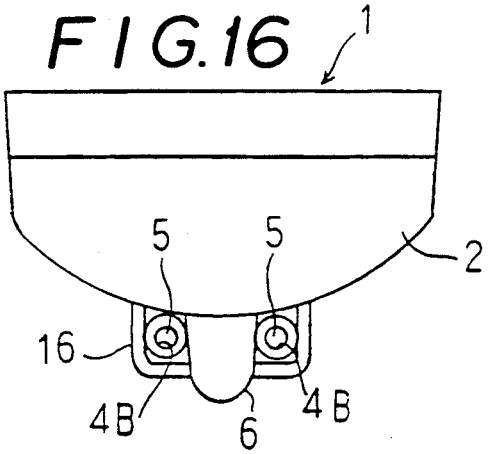
FIG. 16 is a front view of a sixth embodiment of the water closet of the present invention.
Figure 17:
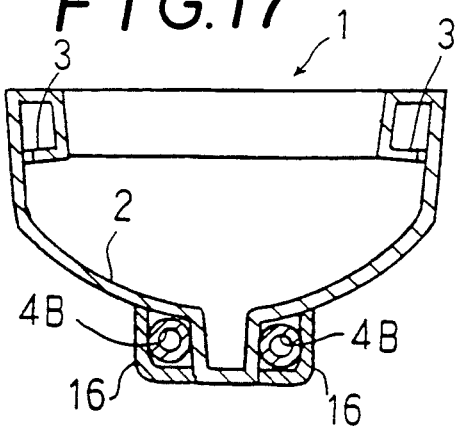
FIG. 17 is a sectional view thereof.

FIGS. 16 and 17 show the water closet as a sixth embodiment of the present invention. The water closet 1 of this embodiment corresponds to the water closet wherein the cover 16 for the warm air duct is arranged in the water closet of the embodiment as shown in FIGS. 14 and 15. The cover 16 can be attached with, for example, an adhesive. The water closet of this embodiment can also be easily manufactured without changing the conventional shape of the water closet. Further, the cover 16 brings about a good appearance.

Figure 18:
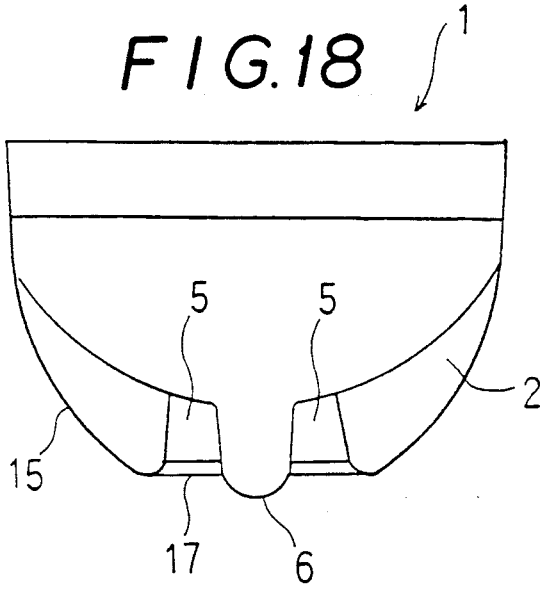
FIG. 18 is a front view of a seventh embodiment of the water closet of the present invention.
Figure 19:
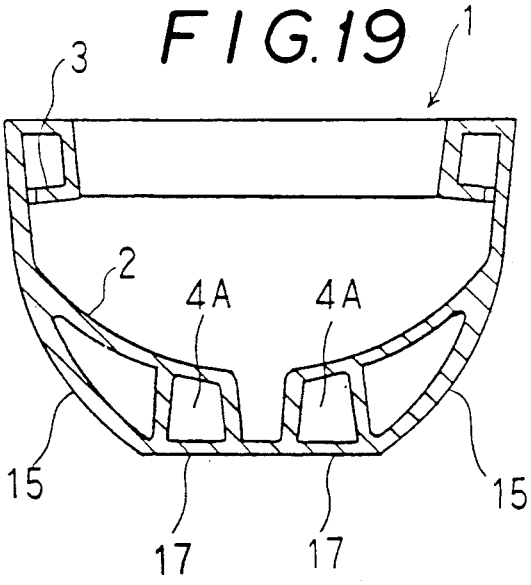
FIG. 19 is a sectional view thereof.

FIGS. 18 and 19 illustrate the water closet 1 as a seventh embodiment of the present invention. In the water closet 1 of this embodiment, a wall 17 is arranged to form the warm air duct 4A with the bowl cover 15, trap 6, the bottom surface of the bowl 2 and the wall 17.

Figure 20:
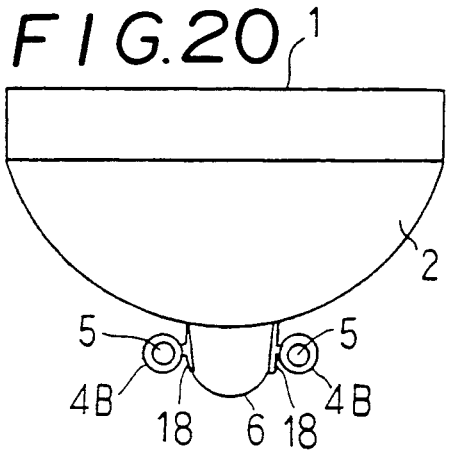
FIG. 20 is a front view of a eighth embodiment of the water closet of the present invention.
Figure 21:
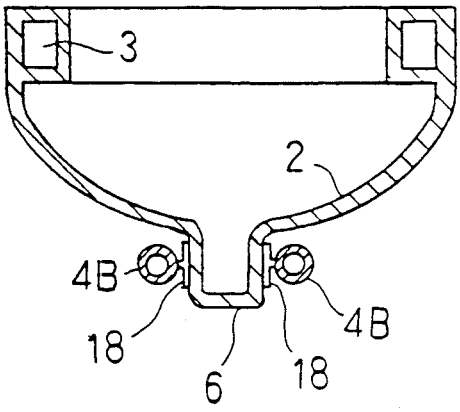
FIG. 21 is a sectional view thereof.

FIGS. 20 and 21 show the water closet 1 as a eighth embodiment of the present invention. In this embodiment, the warm air duct 4B is attached to the water closet 1 with a rubber sucker 18. Thus, the duct 4B can be easily attached to and removed from the closet 1.

Figure 22:
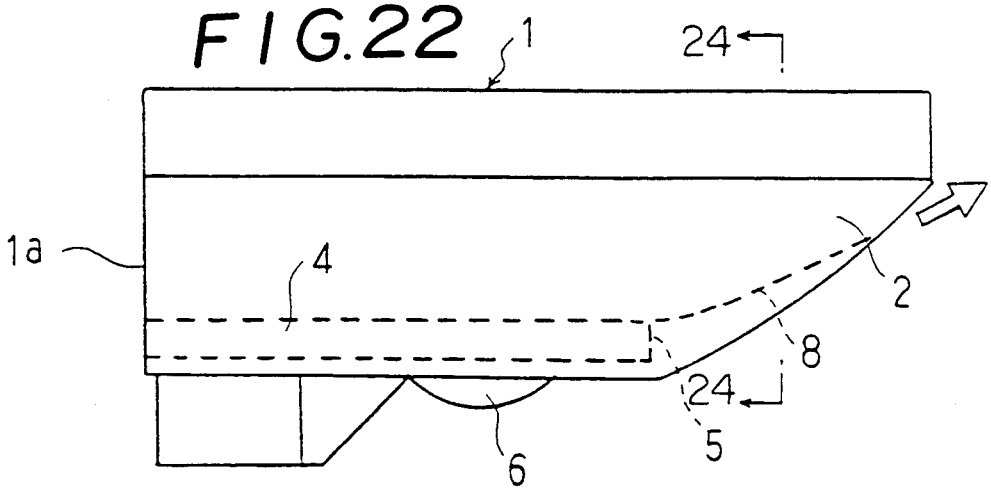
FIG. 22 is a side elevation view of a ninth embodiment of the water closet according to the present invention.
Figure 24:
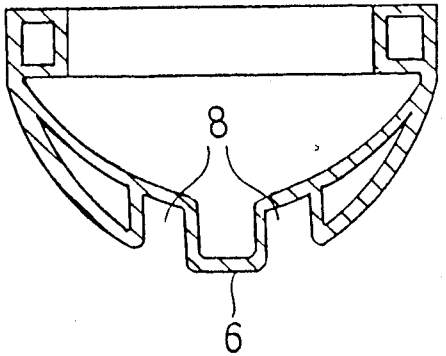
FIG. 24 is a sectional view taken on line XXIV—XXIV of FIG. 22.
Figure 23:
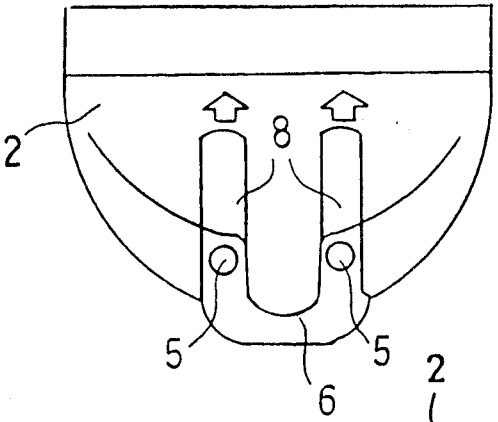
FIG. 23 is a front view of FIG. 22

FIGS. 22 to 24 show the water closet 1 as a ninth embodiment of the present invention. In this embodiment, the warm air duct 4A formed integrally with the water closet 1 is disposed, longitudinally extending to the lower portion of the bowl. From the outlet 5 to the tip of the bowl, a warm air guiding groove 8 which does not have a bottom wall is disposed, extending to the tip of the bowl so as to guide the warm air toward the upper portion of the leg of the user. In the sitting type water closet of the above embodiment, the outlet at the end of the warm air duct is disposed backwardly in a given distance from the tip of the bowl. Therefore, if urine (particularly, when discharged from a standing male user) splashed on the front outer surface of the toilet bowl or washing water (hereinafter referred to as "foul water") runs down to the outlet, the foul water is prevented from entering into the warm air duct. Therefore, it may be avoided that the foul water dries up in the warm air duct and becomes a source of a malodor. Even if the dried foul water is bonded to the ceiling or the side wall in the warm air duct, it may be easily removed by wiping.

As described, the warm air duct may be formed integrally with the toilet bowl. Alternatively, the duct may be formed separately from the bowl, and then attached thereto.

In a preferred embodiment of the present invention, at least a terminal portion of the warm air duct extends on the lower portion of the toilet bowl in a direction of the front portion of the bowl, and the warm air outlet at the end of the duct is disposed backwardly in a given distance in a direction of the rear portion of the bowl from the front portion. Further, the warm air guiding groove extends on the lower outside of the bowl from the warm air outlet to the front portion of the bowl, to thereby convey the warm air from the outlet to the front space of the water closet. Furthermore, a width of the groove is gradually broadened toward the front portion of the bowl, at least around a downstream area of the groove.

In the sitting type water closet of this embodiment, the disadvantages caused by the foul water splashed to the outside of the front portion of the bowl can be avoided, because the warm air outlet at the end of the warm air duct is disposed backwardly in a given distance in the direction of the rear portion of the bowl from the front portion thereof. Further, the water closet of this embodiment has the groove which guides the warm air blown out from the outlet of the warm air duct, and is broadened in the direction of the front portion of the bowl. Therefore, the warm air is blown out at the wide angle. Thus, the water closet of this embodiment can certainly heat the lower half of the user, particularly the calf, independently of the figure of the leg of the user, e.g., O-shaped or X-shaped shank.

The present water closet which contains the warm air path comprising the warm air duct 4 and the warm air guiding groove 8 having a specific structure is illustrated in FIGS. 25 to 35.

Figure 25:
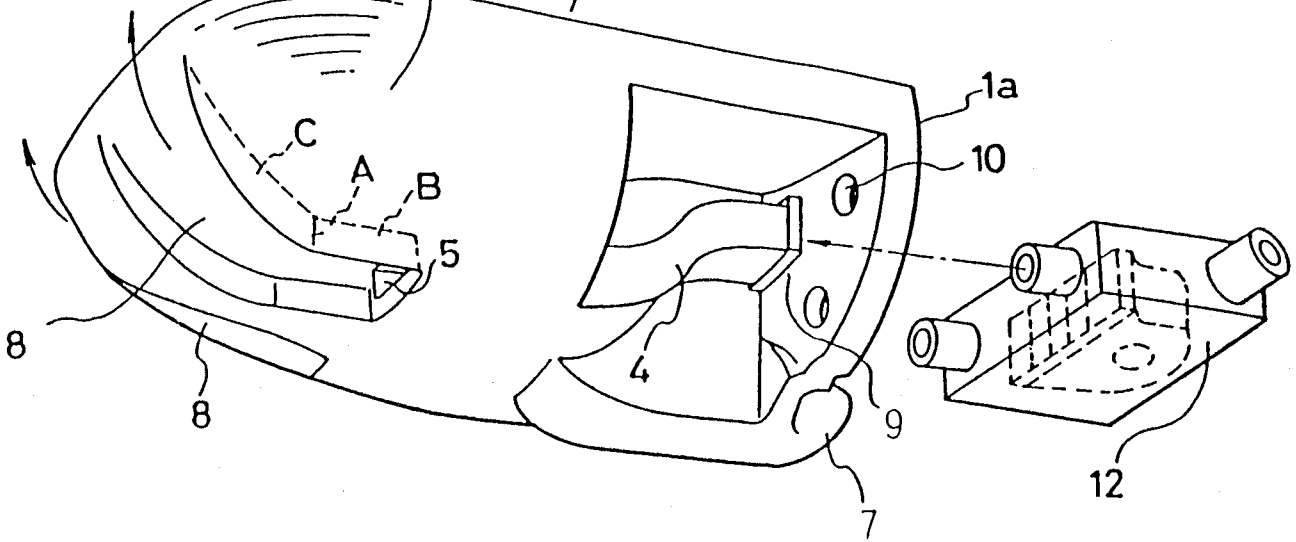
FIG. 25 is a perspective view of a lower portion of another embodiment of the water closet of the present invention.
Figure 26:
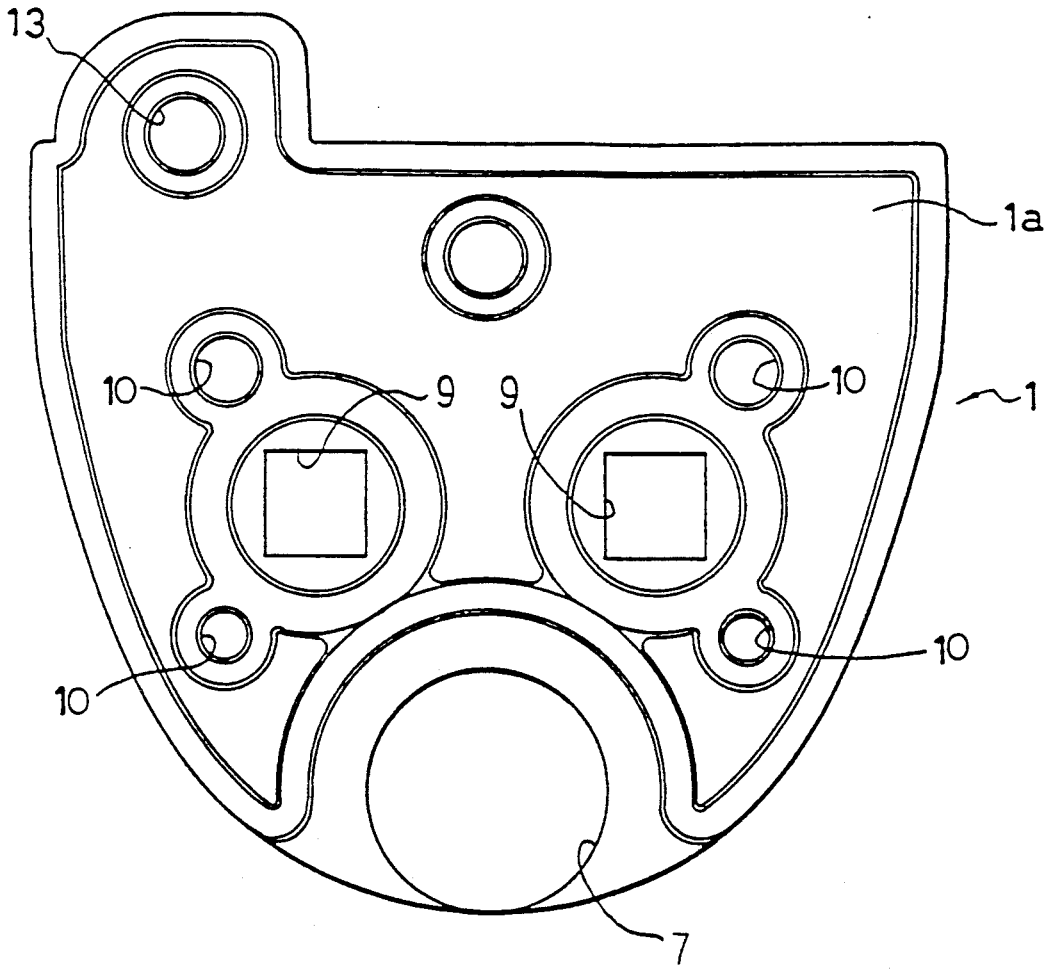
FIG. 26 is a rear view of the water closet.
Figure 27:
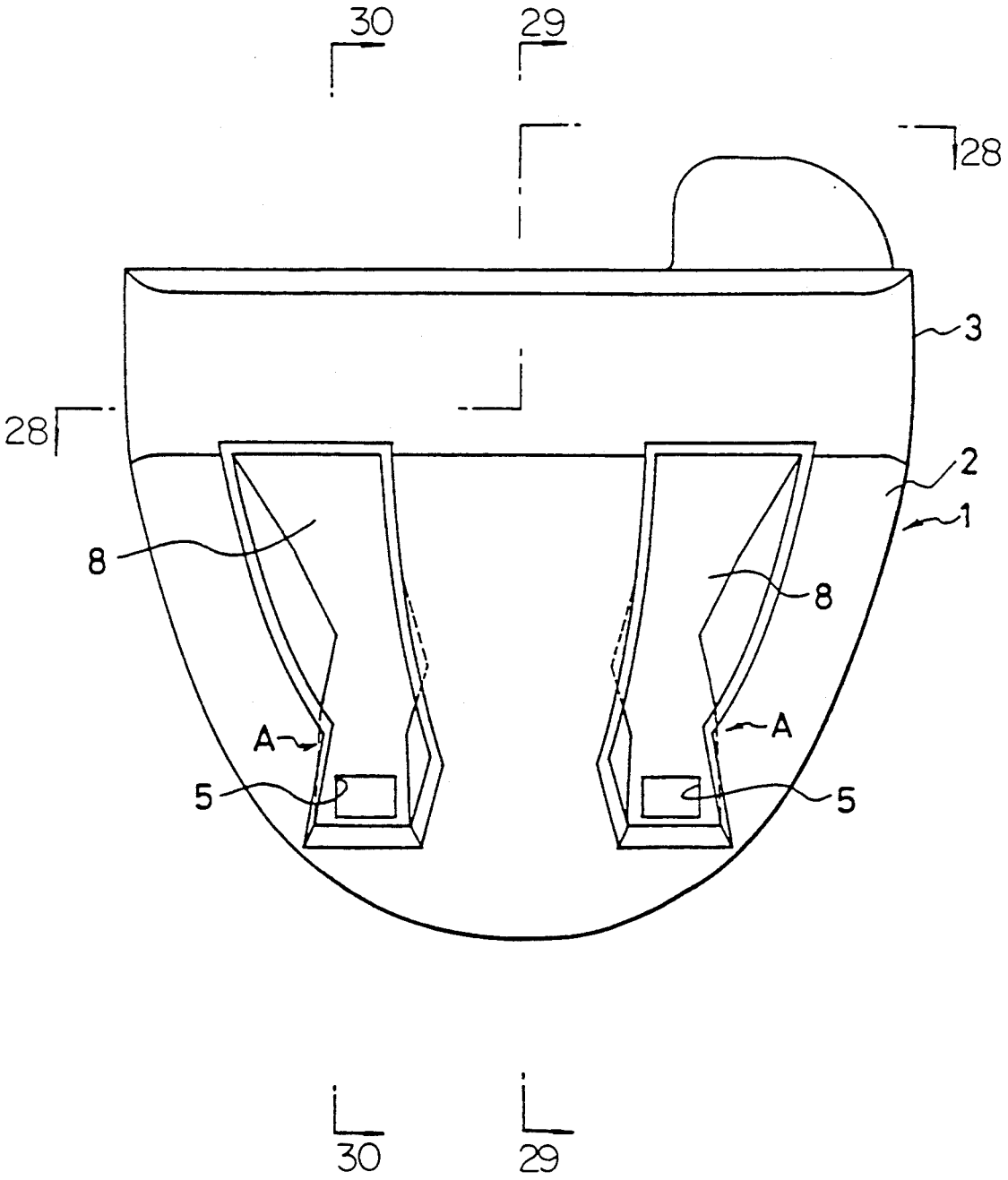
FIG. 27 is a front view thereof.

The sitting type water closet 1 shown in FIG. 25 is a bench type one, and attached to the wall of the toilet room or the like at the rear side 1*a*. The water closet 1 contains the toilet bowl 2 in the front portion, and the rim water conduit 3 is disposed in the upper portion of the bowl 2, surrounding the bowl 2 (refer to FIGS. 26 to 30. etc.). In the bench type water closet 1, a pair of the warm air ducts 4 is disposed integrally with the toilet bowl 2, longitudinally extending along the curved surface of the lower portion of the bowl 2. The warm air duct 4 has an opening, i.e., the warm air outlet 5 which is set back in a given distance (at the position slightly forward from the trap 6 in this embodiment as shown) in the direction of the rear portion from the front portion of the bowl (refer to FIG. 28). The other end of the warm air duct 4 is an opening 9 on the rear side la of the water closet 1 (refer to FIGS. 26 and 28). The groove 8 is disposed from the outlet 5 on the front and lower portion of the bowl 2, and may guide the warm air from the outlet 5 to the front space of the water closet 1.

As shown in FIGS. 25 to 28, the width of the groove 8 is rarely or not changed in a portion B between the outlet 5 and an intermediate point A. However, the width is gradually broadened in a front portion C beginning from the intermediate point A to the front portion of the water closet 1.

The water closet 1 shown in FIG. 25 has the drainage hole 7, holes 10 for the bolts to attach the water closet 1 to the wall of the toilet room or the like, holes 11 for the bolts to attach the toilet seat (refer to FIG. 41 etc.), and a water supply inlet 13 (refer to FIG. 26, etc.), and the like.

As shown in FIG. 25, the rear end opening 9 of the warm air duct 4 is connected with, for example, the warm air generator 12, to supply the warm air to the warm air duct.

In the sitting type water closet 1 having the above structure, the warm air from the warm air generator 12 is emitted from the outlet 5, driven along the guiding groove 8, and widely blown out from the tip of the groove 8, whereby the lower half of the body, particularly the calf, of the user of the water closet 1 is heated with the warm air.

Although the width of the guiding groove 8 is gradually broadened in the front portion C from the intermediate position A in the embodiment shown in the above figures (particularly, FIG. 28), the width may be gradually broadened immediately after the outlet 5. To avoid an internal focusing of the warm air blown out from the tip D of the water closet, the direction of the groove 8 is biased to the center of the bowl in the portion B between the outlet 5 and the intermediate position A, as shown in FIG. 28.

Figure 28:
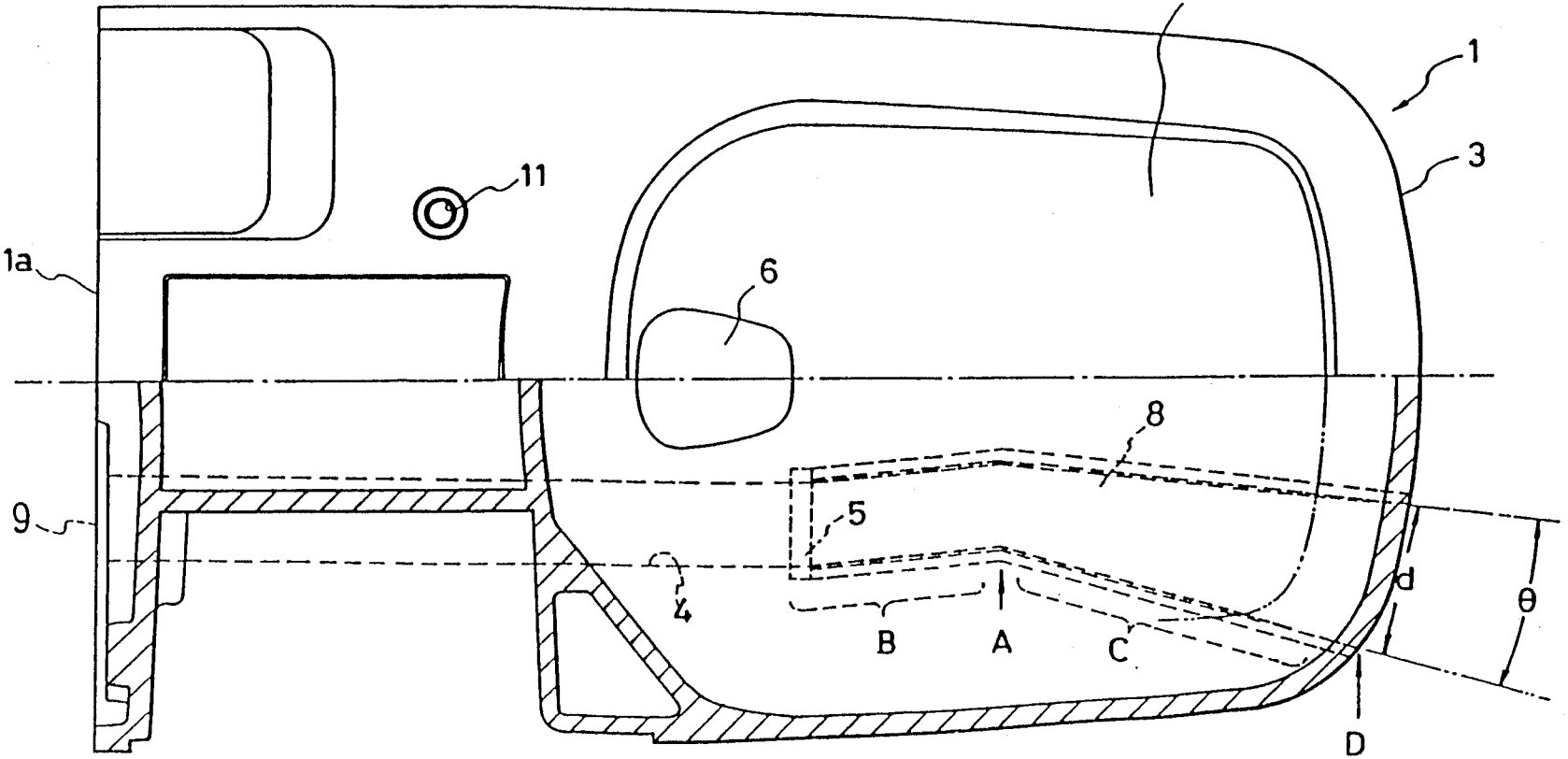
FIGS. 28, 29 and 30 are sectional views taken on lines XXVIII—XXVIII, XXIX—XXIX and XXX—XXX of FIG. 27, respectively.
Figure 29:
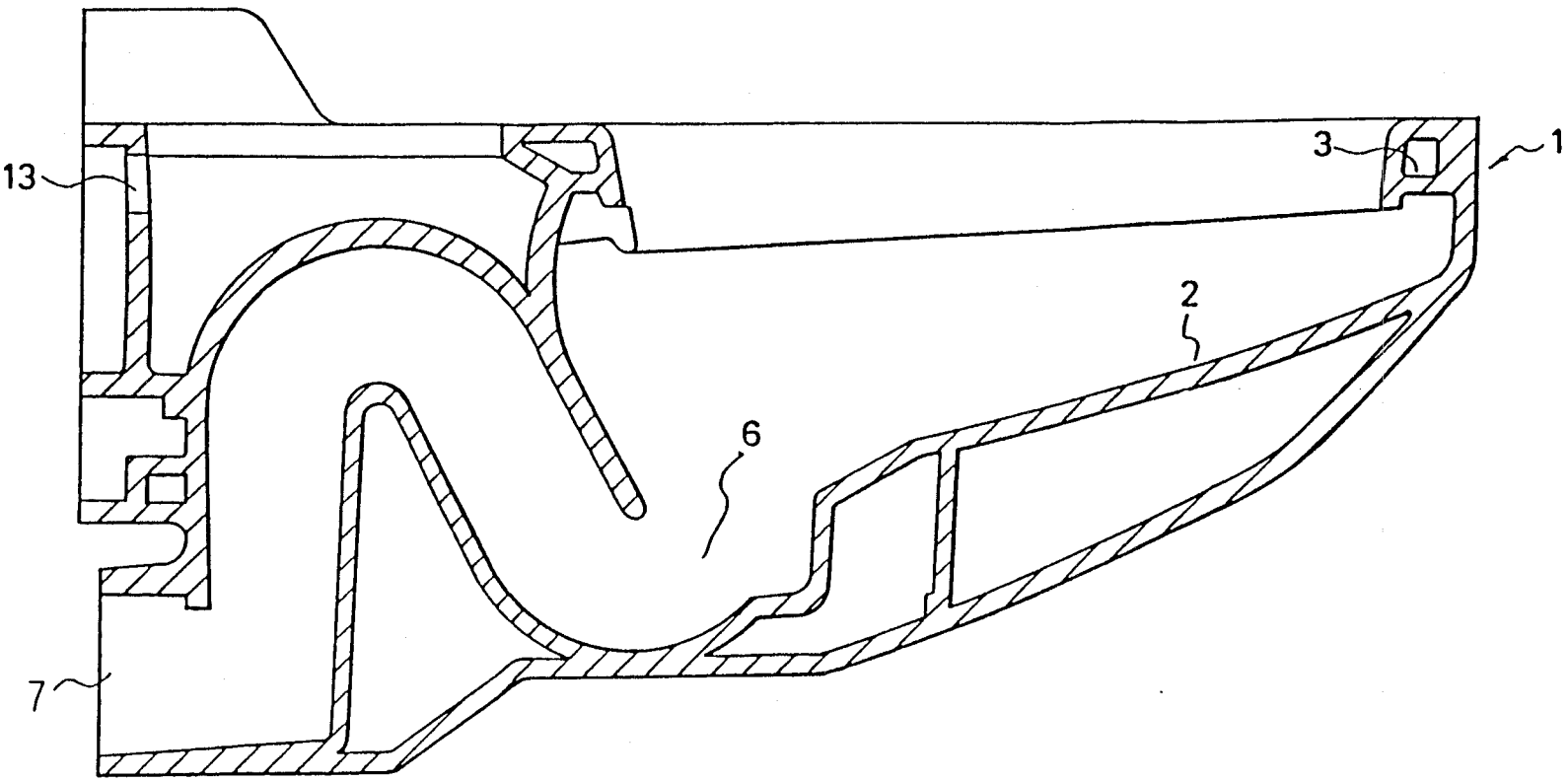
Figure 30:
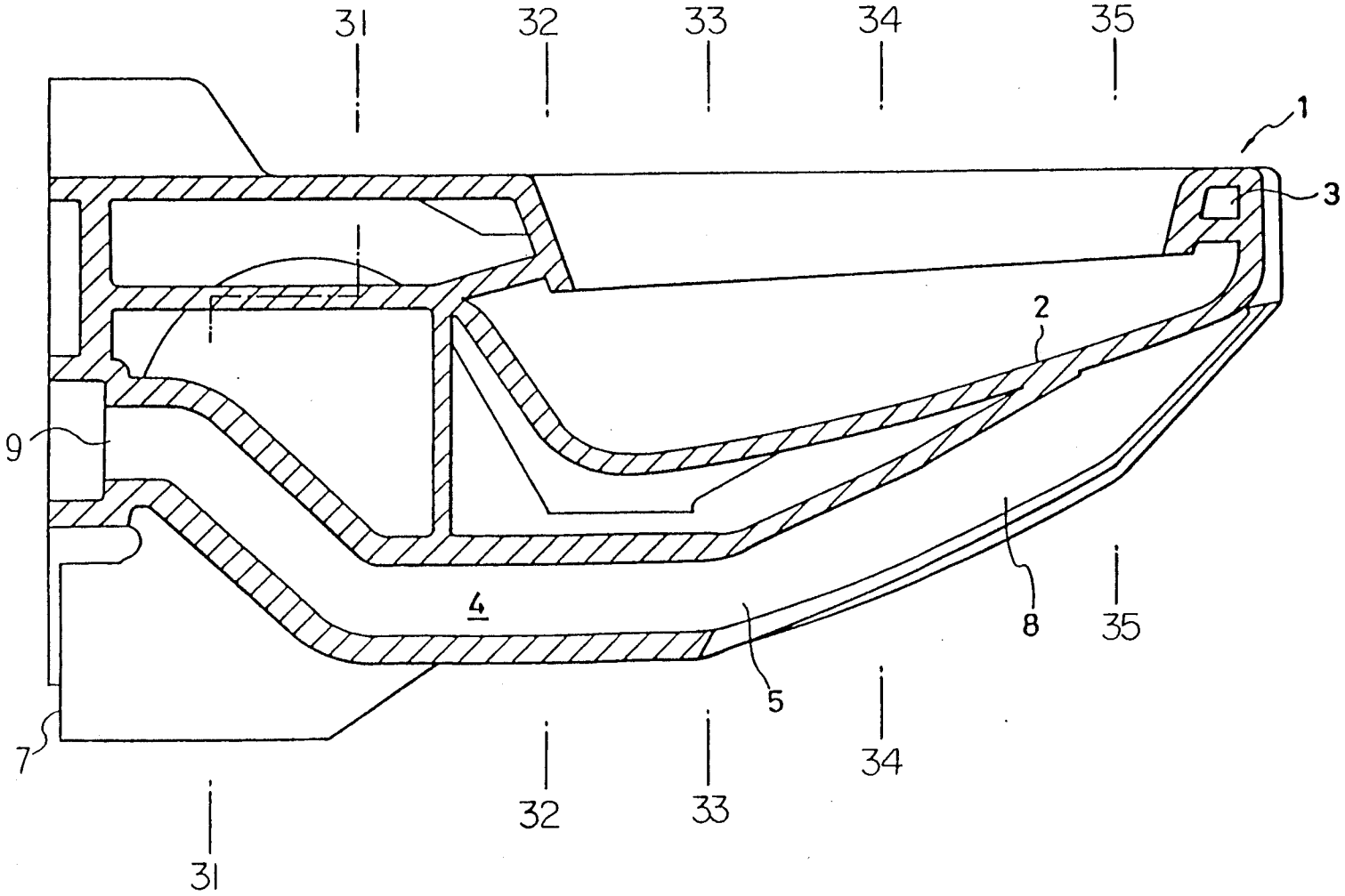
Figure 31:
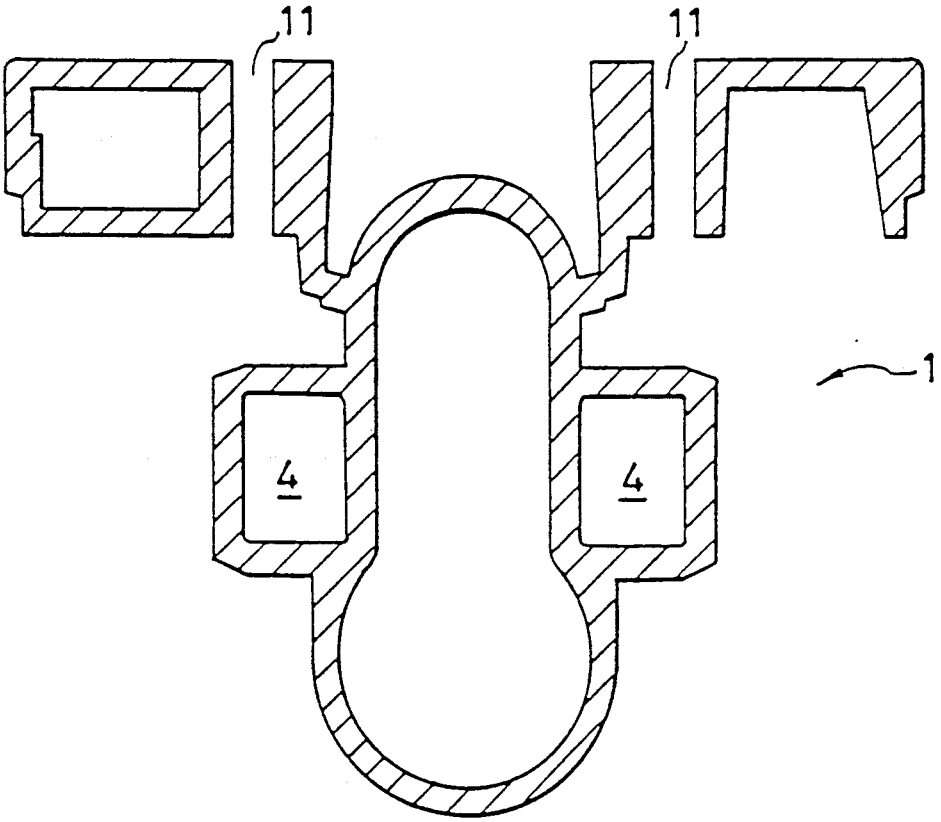
FIGS. 31, 32, 33, 34 and 35 are sectional views taken on lines XXXI—XXXI, XXXII—XXXII, XXXIII—XXXIII, XXXIV—XXXIV and XXXV—XXXV of FIG. 30, respectively.
Figure 32:
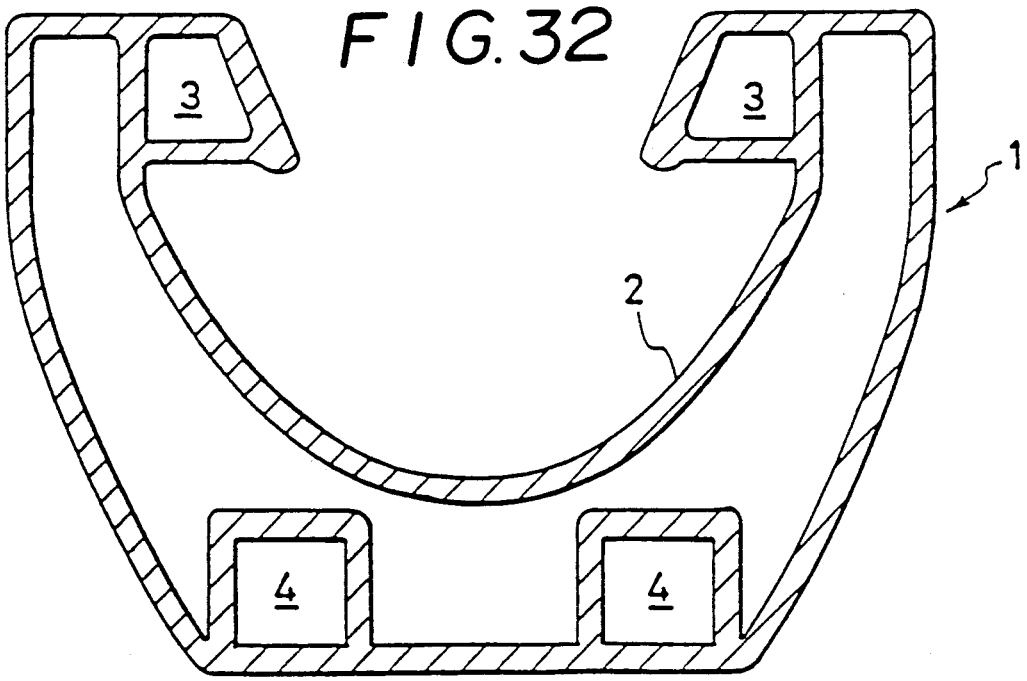
Figure 33:
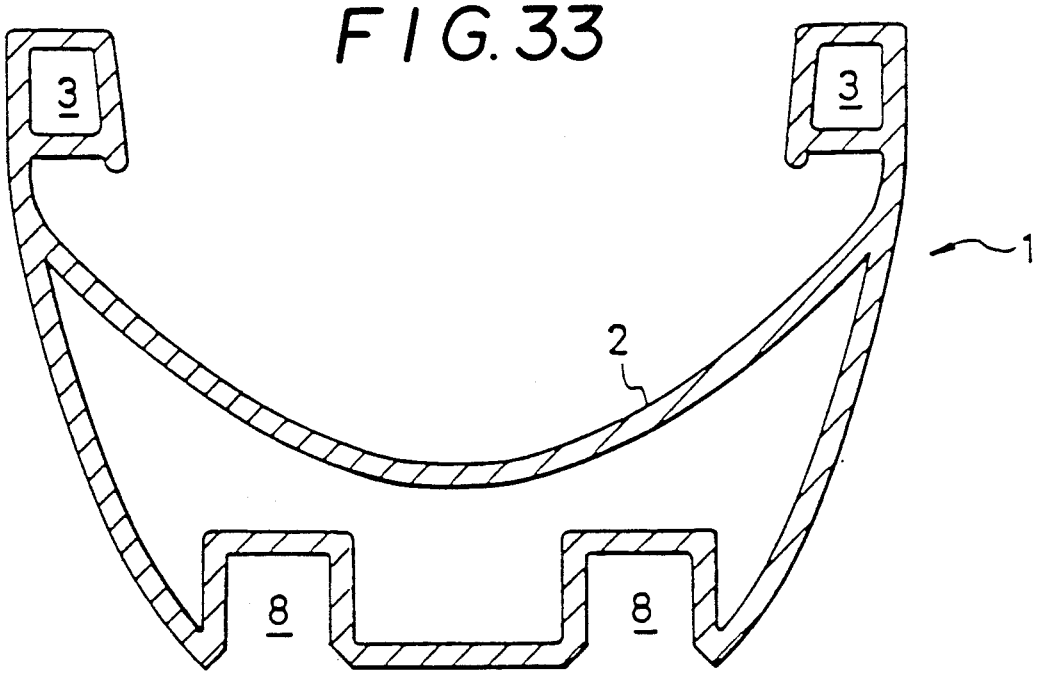
Figure 34:
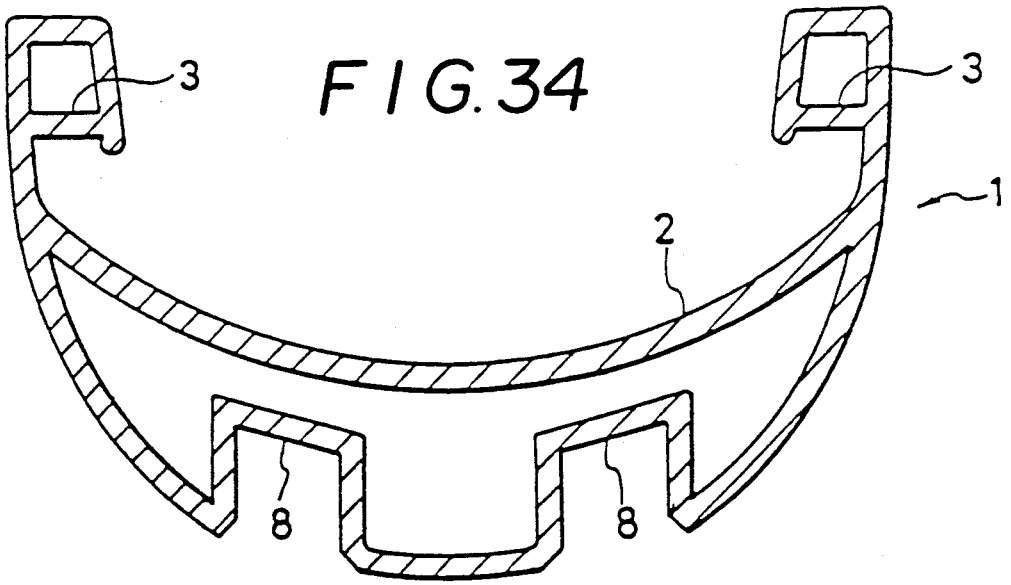
Figure 35:
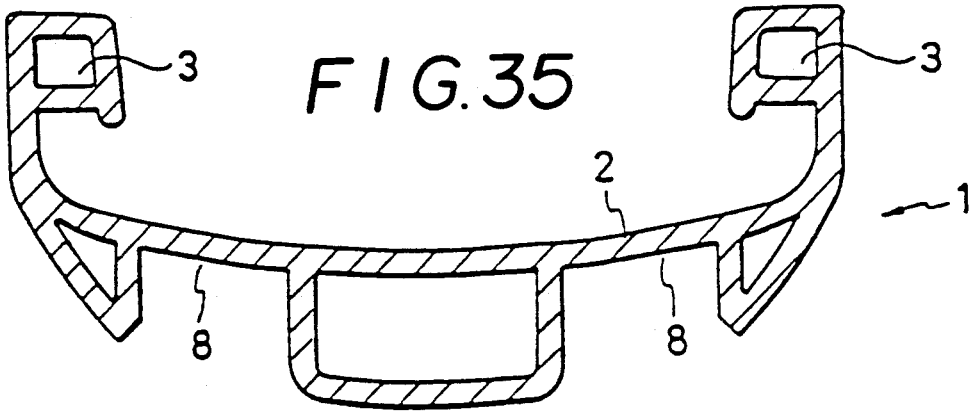

In the embodiment as shown in FIGS. 25 to 35, the width of the groove 8 is preferably about 50 to 100 mm at the downstream mouth of the groove 8 (i.e., the position shown with the arrow D in FIG. 28) where the warm air leaves from the water closet 1, when the width of the outlet 5 is about 40 mm, and a widening angle 0 at the downstream mouth of the groove 8 is preferably about 5 ° to 20° (refer to FIG. 28).

Although the embodiment shown in FIGS. 25 to 35 is the bench type water closet, the present invention may be applied to various water closets, such as the stool type water closet, or the water closet installed on the floor and fixed on the wall of the toilet room.

Figure 36:
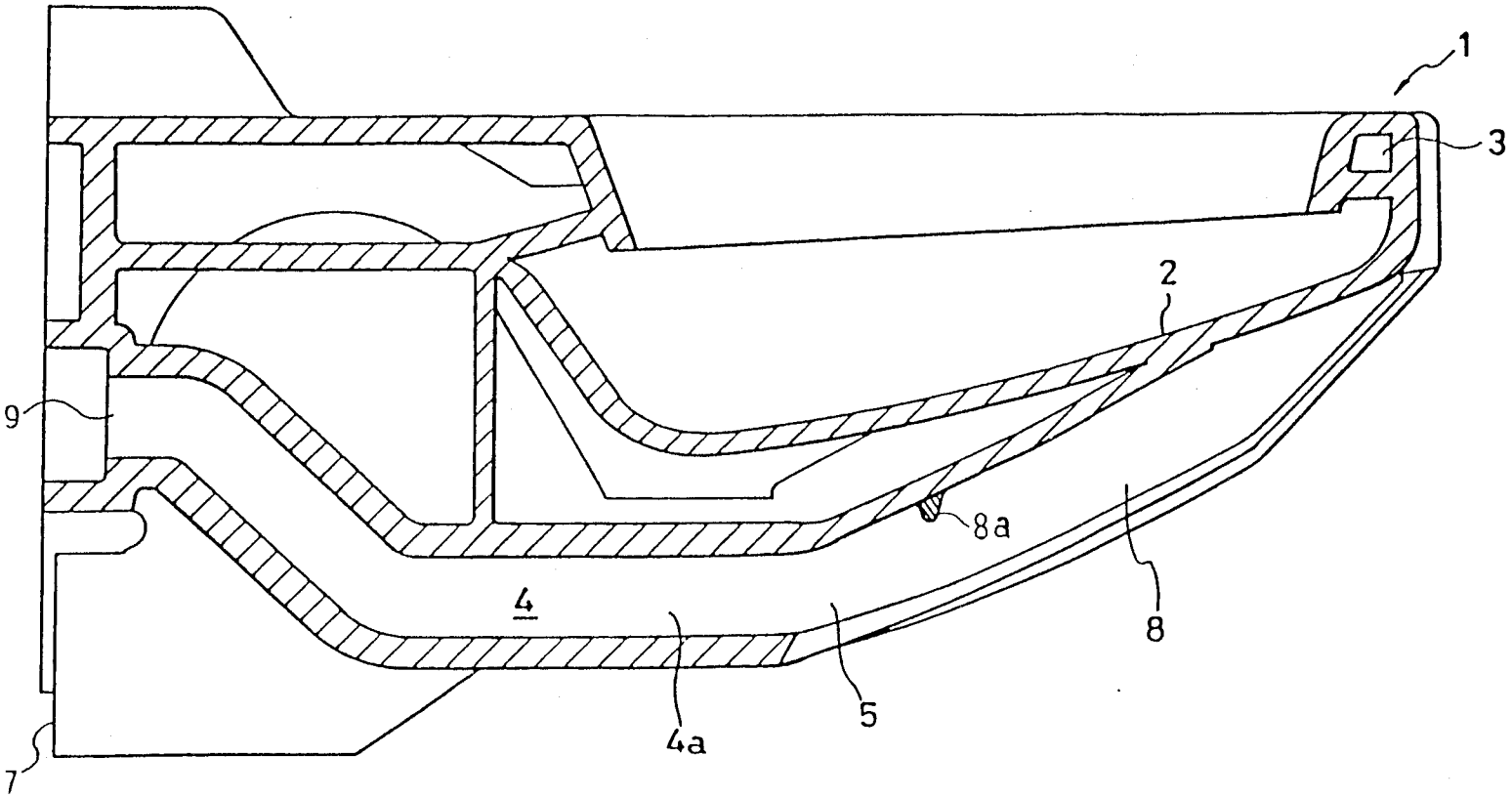
FIG. 36 is a sectional view of still another embodiment of the sitting type water closet according to the present invention.

According to the preferred embodiment of the present invention, the warm air duct has a horizontal or downstreamly downgrade slope around the warm air outlet. In this embodiment, the foul water is not introduced into the warm air duct, even if the foul water reaches to the warm air outlet. Therefore, it is prevented that the foul water is dried up in the warm air duct 4 and becomes the source of the malodor. For example, as shown in FIG. 36, the warm air duct 4 has a horizontal or downgrade slope in a direction of the outlet 5 from the rear opening 9. In the embodiment as illustrated, the slope is horizontal in the portion 4*a* near to the outlet 5. The portion 4*a* may be downgrade. Alternatively, the slope of the warm air duct 4 may be horizontal or downgrade as a whole. Further, as shown in FIG. 36, a raised portion 8*a* for protection against water may be disposed on the roof and/or the side wall of the groove 8, thereby preventing the foul water from approaching the outlet 5.

In still another embodiment of the sitting type water closet according to the present invention, the warm air path (comprising the warm air duct and the guiding groove) shares at least a part of the wall thereof with at least a part of the wall contacting the level surface of a sink water in the toilet bowl. The warm air passing through the warm air path can heat the trap water at the level surface thereof, thereby preventing the trap water from freezing, particularly in a cold district. The freezing of the trap water begins from the surface thereof. Therefore, the freezing of the trap water may be avoided by heating the water around the level surface thereof in the toilet bowl in the water closet according to this embodiment.

Figure 37:
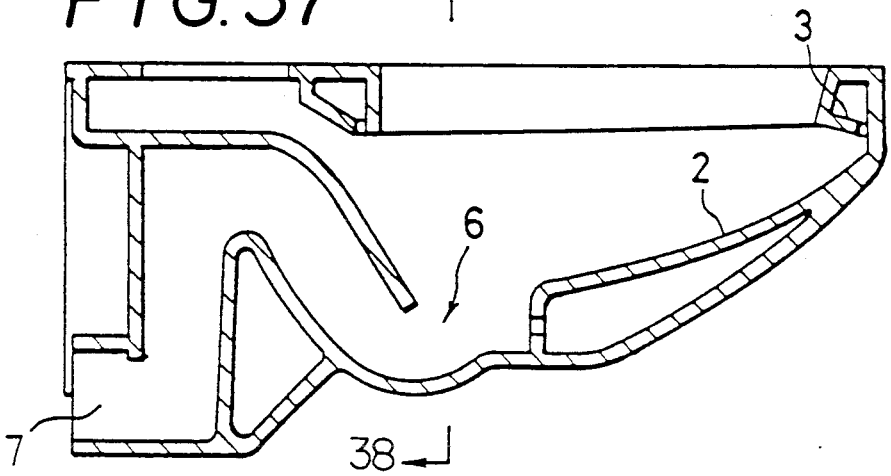
FIG. 37 is a sectional side view of a first embodiment of the present water closet for preventing a trap water from freezing.
Figure 38:
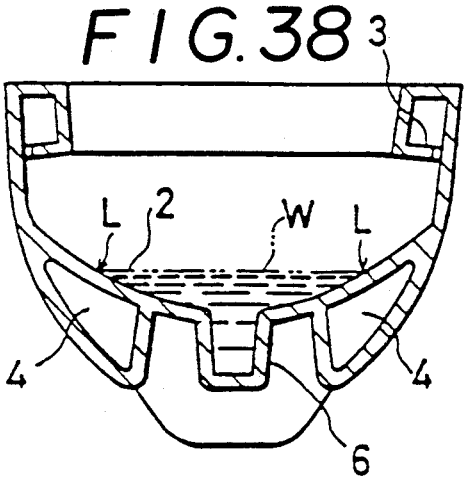
FIG. 38 is a sectional view taken on line XXXVIII—XXXVIII of FIG. 37.

FIGS. 37 and 38 illustrate a first embodiment of the water closet for preventing the trap water from freezing. The water closet 1 shown in FIGS. 37 and 38 is a bench type closet, and attached to the wall of the toilet room or the like at the rear side la. The referential numerals in FIGS. 37 and 38 have the same meanings as given in FIG. 1 and the like.

As shown in FIG. 38, the warm air duct 4 shares the wall thereof with that of the toilet bowl 2 on the right and left sides thereof, whereby the warm air passing through the warm air duct 4 directly heat the toilet bowl 2, particularly around the level surface L of the trap water W. Therefore, the freezing of the trap water may be avoided.

Figure 40:
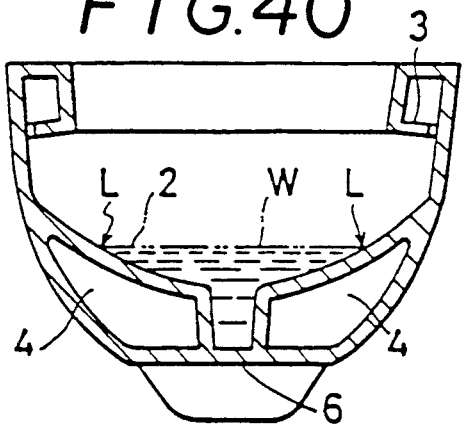
FIGS. 39 and 40 are sectional views of another embodiment of the present water closet for preventing the trap water from freezing.
Figure 39:
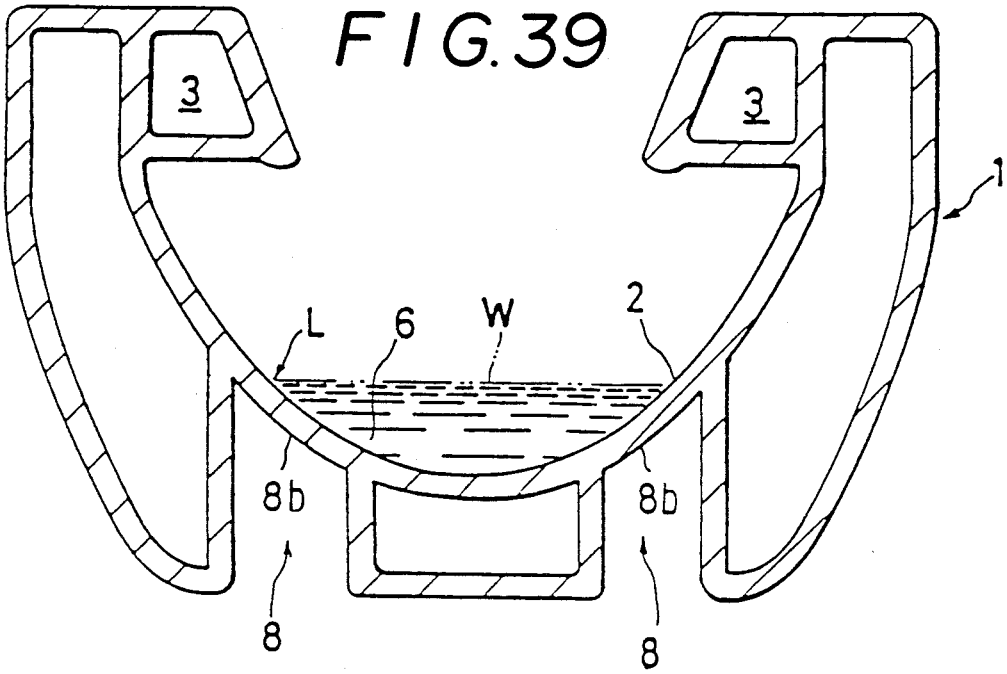

FIGS. 39 and 40 illustrate another embodiment of the water closet for preventing the trap water from freezing. The warm air path in the bench type water closet 1 of this embodiment comprises the warm air duct 4 and the guiding groove 8. As shown particularly in FIG. 39, the guiding groove 8 shares the upper wall 8*b* thereof with the bottom wall of the toilet bowl 2, whereby the warm air in the guiding groove 8 directly contacts the bowl surface opposite to the trap water W around the level L.

It should be understood that the detailed description with reference to FIGS. 1 to 40 is given by way of illustration only. For example, the number of the warm air outlet, the direction of blowing the warm air out or the like may be different from those shown in FIGS. 1 to 40. The warm air path may have, for example, the sectional profile as shown in FIG. 40. Further, the water closet may be not only the bench type, but also the stool type or the like.

The present invention also relates to a water closet unit containing an adapter which can attach the sitting type water closet having the warm air path to the wall of the toilet room.

The water closet unit according to the present invention may blow the warm air out from the front portion thereof, thereby heating the leg of the user. Since the heating is effected with the warm air, the clothes are not burnt.

By using the water closet unit according to the present invention, the bench type water closet is attached to the wall of the toilet room with the adapter, and thus, the fixing strength may be extremely improved, even if the wall of the toilet room is made of a material having a weak strength, such as a wooden plate.

Figure 41:
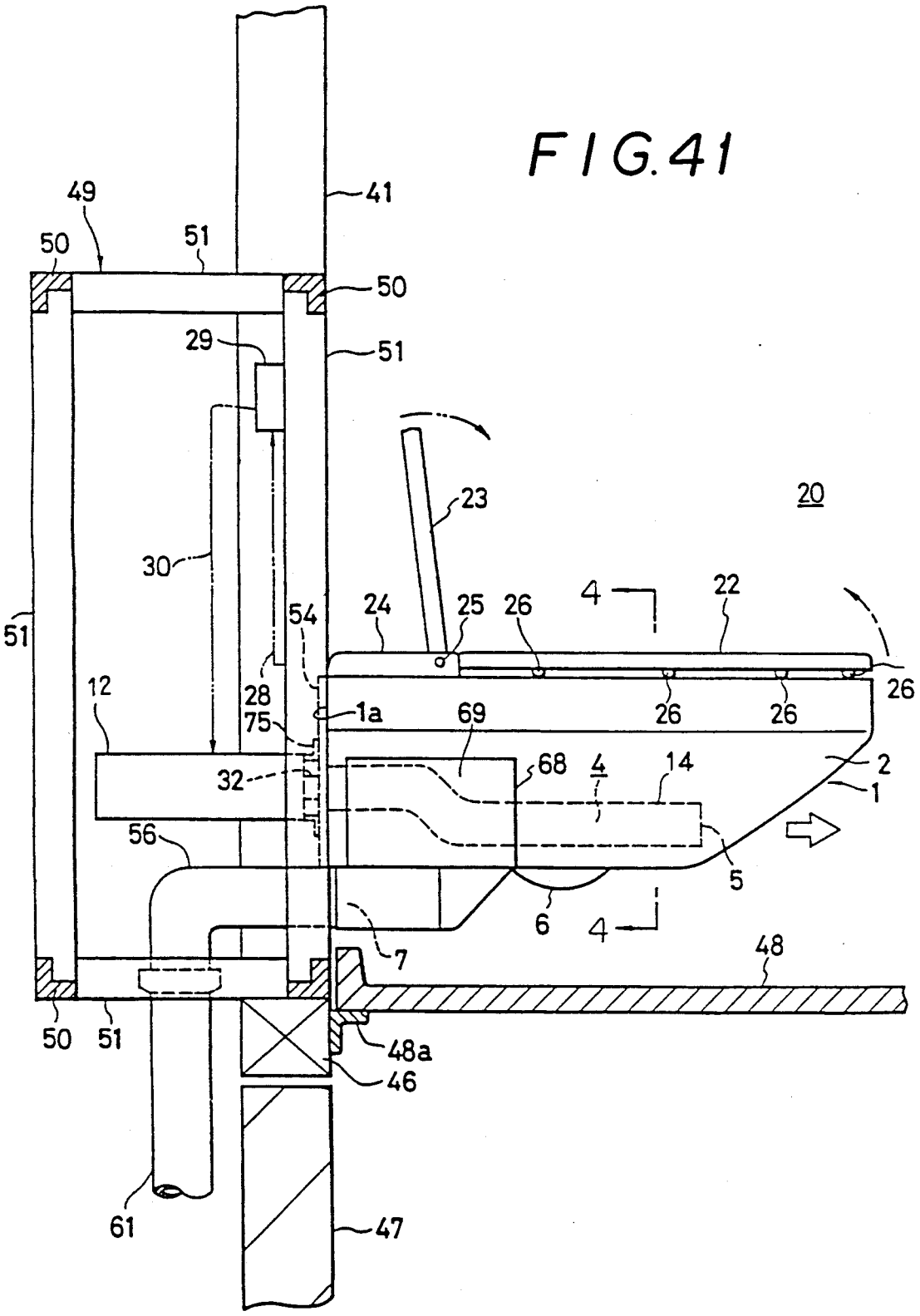
FIGS. 41 and 42 are side elevation views schematically illustrating a manner wherein the water closet unit according to the present invention is installed in the toilet room.
Figure 42:
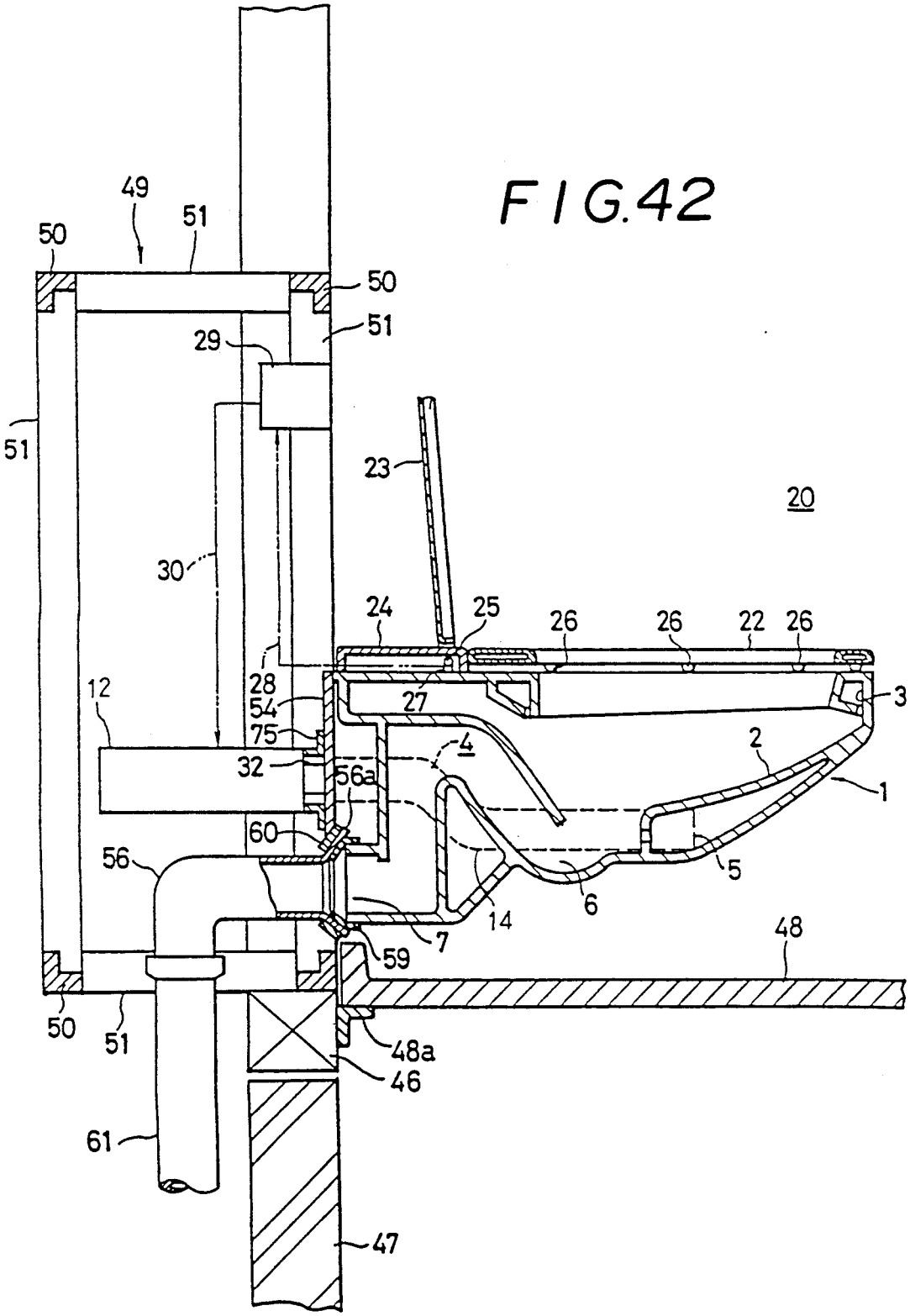
Figure 43:
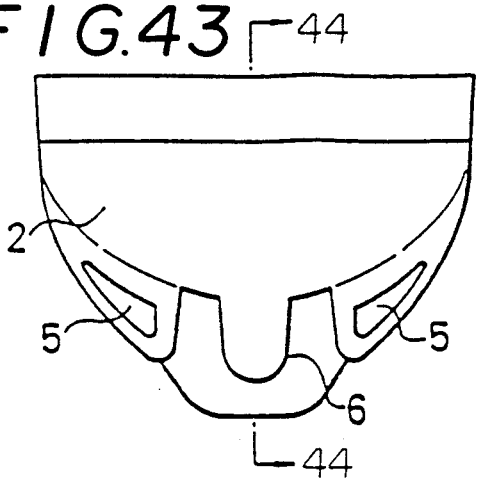
FIG. 43 is a front view of the water closet shown in FIG. 42 as a sectional view.
Figure 44:
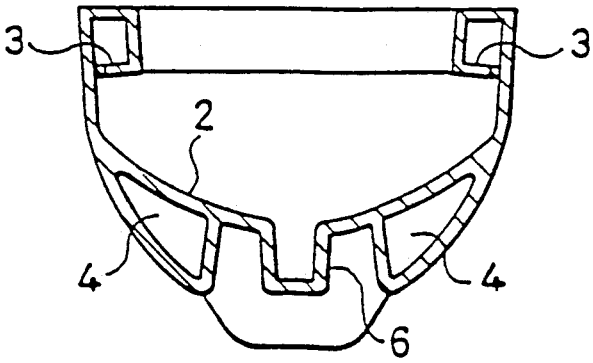
FIG. 44 is a sectional view taken on line XLIV—XLIV of FIG. 43.

FIGS. 41 to 44 schematically illustrate the water closet unit according to the present invention. The sitting type water closet 1 is a bench type one, and attached at the rear side la thereof to the adapter 49 installed in the wall portion of the toilet room 20. The rim water conduit 3 is disposed around the upper portion of the toilet bowl 2 (FIG. 42). In the water closet 1, the warm air duct 4 composing the warm air path 14 is longitudinally disposed at the side portion thereof, formed integrally with the toilet bowl. The end of the warm air duct 4 is an opening, i.e., the outlet 5, at the tip of the water closet 1. The rear end of the warm air duct 4 is an opening at the rear side la of the water closet 1. The water closet 1 has the trap 6 and the drainge hole 7.

A toilet seat 22 and a toilet cover 23 are disposed on the upper portion of the water closet 1 in a manner that the closet can be opened and closed with the seat and the cover. The toilet seat 22 and the toilet cover 23 are rotatably fixed with a hinge shaft 25 to a case 24 mounted on the upper rear portion of the water closet 1. The bottom surface of the toilet seat 22 has rubber protuberances 26.

In the embodiment as shown, the hinge shaft 25 may be moved up and down with a slight stroke. Further, a seat switch 27 including a pressure-sensitive switching mechanism may be disposed between the upper surface of the toilet bowl 2 and the hinge shaft 25.

The seat switch 27 is connected via a lead wire 28 to a controller 29 installed in the wall 21 of the adapter or the toilet room. The controller 29 is connected through a signal wire 30 to the warm air generator 12. The outlet 32 of the generator 12 is connected to the warm air duct 4.

In the water closet 1 having the above structure, when the user sits down on the toilet seat 22, the seat switch 27 is turned on, the warm air generator 12 is actuated, and then, the warm air is blown out from the outlet 5. The warm air contacts and heats the lower half, particularly the calf, of the user. Because the warm air is blown out shortly after the actuation of the warm air generator 12, the water closet has a good starting performance, and thus provides a comfortable heating. The on-off control of the warm air generator may be carried out, using means other than the seat switch.

The water closet unit of this embodiment will be explained in detail, referring to FIGS. 45 to 48.

Figure 45:
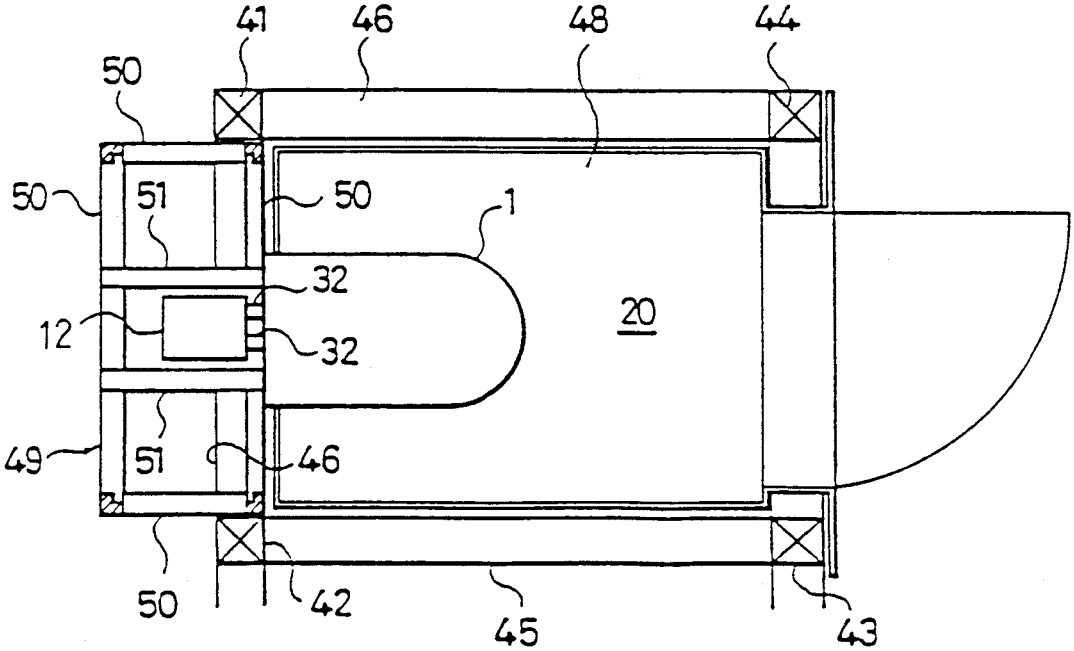
FIG. 45 is a sectional plan view illustrating a manner wherein the sitting type water closet unit is installed in the toilet room.
Figure 46:
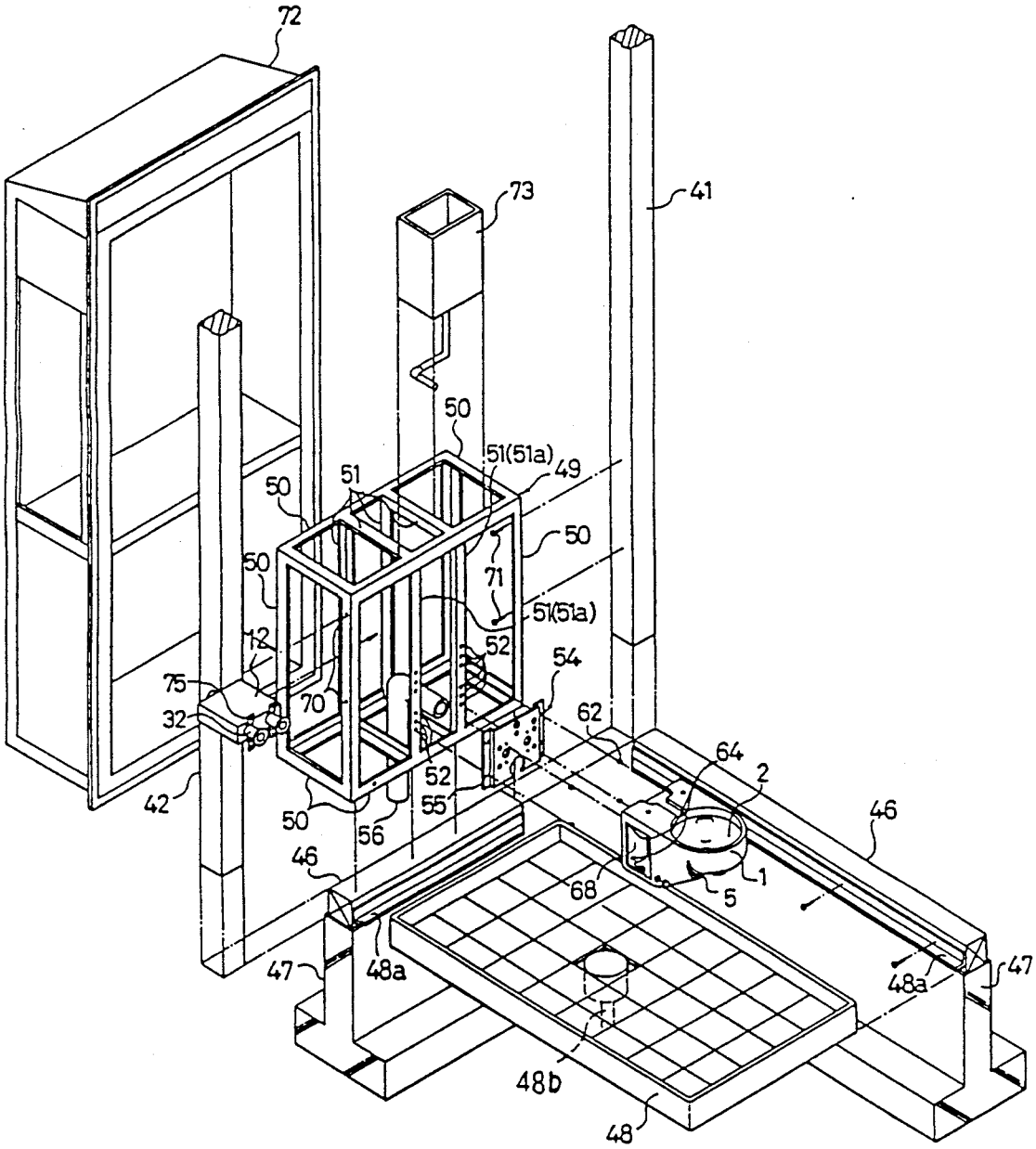
FIGS. 46 and 47 are setting-up perspective views of the water closet unit.

As shown in FIG. 45, there are four pillars 41, 42, 43, 44 at four corners in the toilet room 20. Sleepers 45 and foundations 46 are arranged between the pillars, and the foundations 46 are arranged on pedestals 47 (FIGS. 45 and 46). Metallic fixtures **48*a* having an L-letter shaped sectional profile are fastened with screws to the side walls of the spleepers 45 and foundations 46. A waterproof pan 48 is held on the metallic fixture 48*a* and composes a floor of the toilet room 20. Between the pillars 41 and 42, there is installed the adapter 49 comprising a box-like structural frame. The frame type adapter 49 comprises twelve main angle bars 50 corresponding to twelve edges of a rectangular parallelepiped, and sub-angle bars 51 spanning the main angle bars 50. Plural bolt holes 52 are vertically provided in the sub-angle bars 51*a* facing the toilet room. The bench type water closet 1 is attached to the adapter 49 with bolts 53 through the bolt holes 52**.

The water closet 1 is fastened to the adapter 49 via a fixing plate 54 made of an iron plate. The fixing plate 54 has openings 55 for bolts 53, an opening 57 for a drainage pipe 56, and an opening 58 for the warm air outlet 32.

Figure 47:
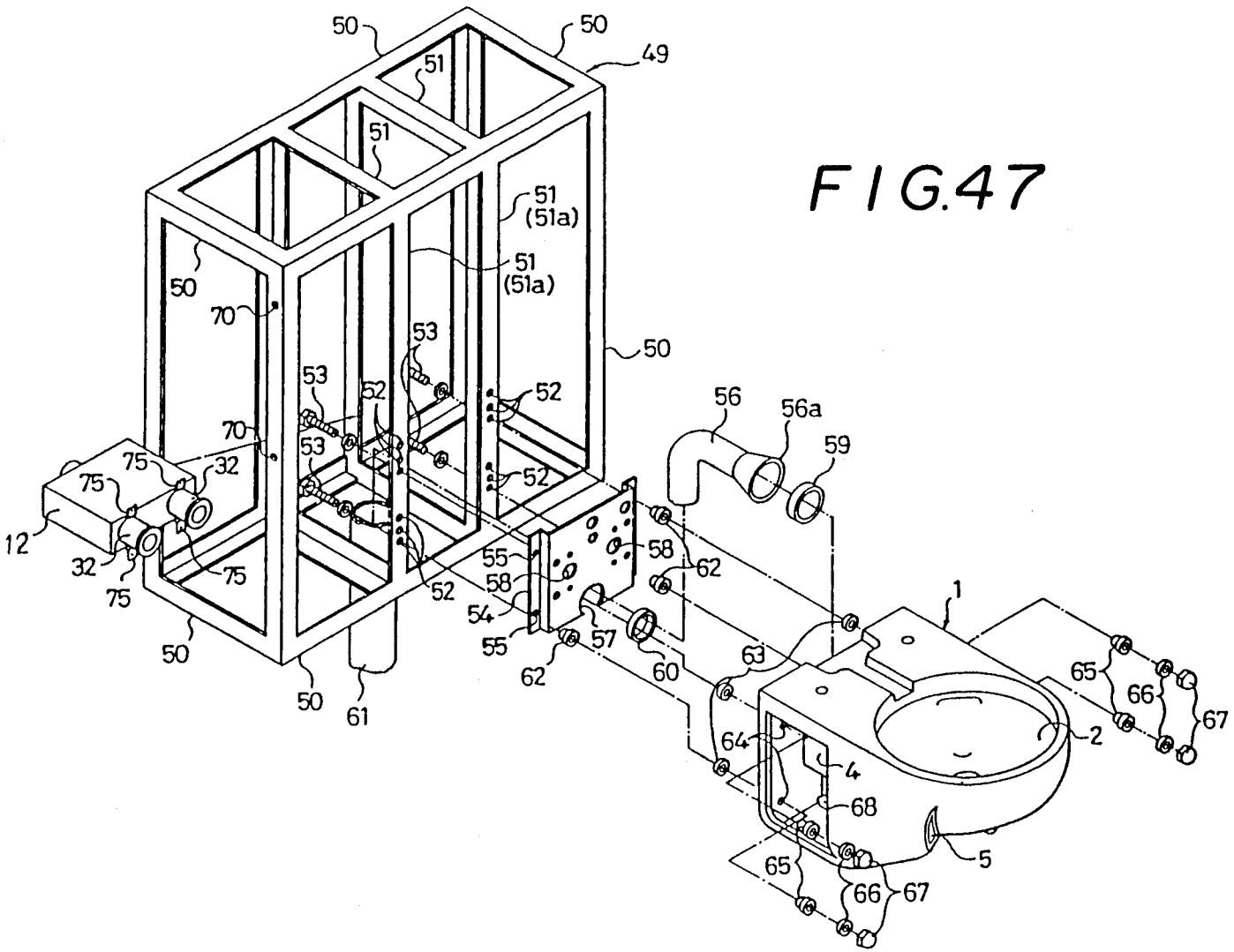

As shown in FIG. 47, the drainage pipe 56 has a widened portion **56*a* at the end thereof. The widened portion 56*a* is connected via a gasket 59 to the drainage hole 7 of the water closet 1. Further, the widened portion 56*a* is held on the edge of the opening 57 of the fixing plate 54 via a packing 60. The drainage pipe 56 is an elbow pipe, and is connected with a wastepipe 61** at the other end.

The bolts 53 are inserted through the bolt holes 64 of the water closet 1 via space nuts 62 and rubber packings 63, and then threadedly engaged with decorative nuts 67 through sectional nylon packings 65 and washers 66.

In the sides of the water closet 1, openings 68 are provided through which the decorative nuts 67 may be clamped with a tool. A cover 69 is removably fitted over the opening 68 (FIG. 41).

In the vertical main angle bars 50 nearer to the toilet room, screw holes are provided. The adapter 49 is fastened by rocking the screws 71 to the pillars 41 and 42 through the holes 70. FIG. 46 shows a bay window unit 72 which is attached to the outside of the pillars 41 and 42 and covers the adapter 49, and further a tank 73 for washing water installed in the adapter. A lidded waste trap **48*b* provided to the waterproof pan 48 is also shown. Appropriate decorative panel (not shown) or the like is disposed in the front face of the adapter 49**.

Figure 48:
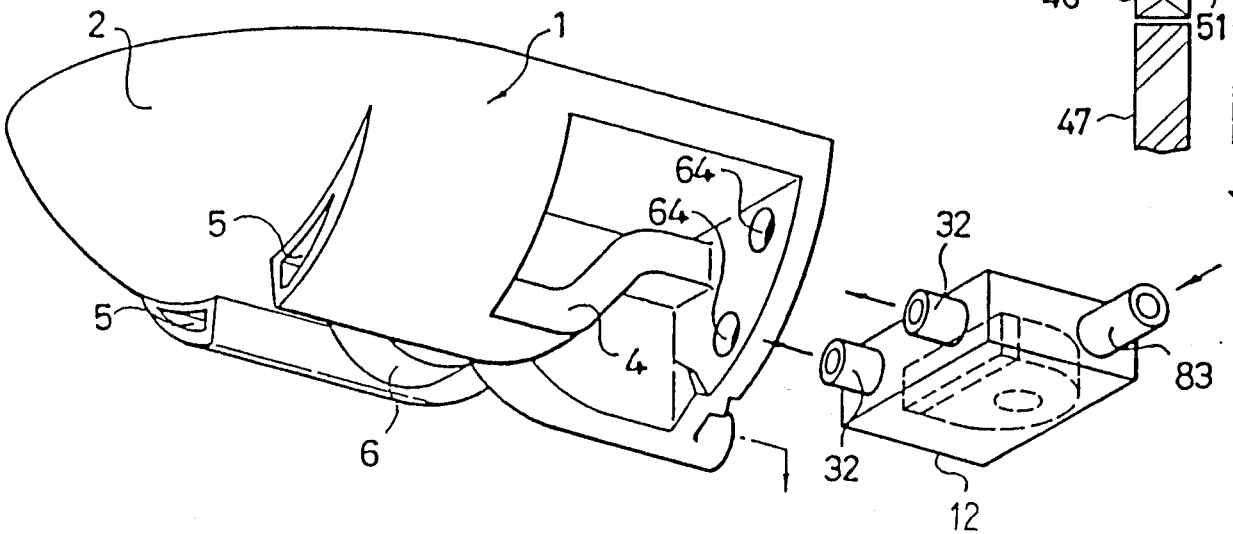
FIG. 48 is a perspective view showing upwardly a lower portion of a structure fixing the warm air generator to the water closet.

As shown in FIG. 48, two outlets 32 are symmetrically disposed to the warm air generator 12. The warm air duct 4 is connected with the outlet 32 to communicate the warm air generator 12 and the water closet 1. The warm air generator 12 has L-shaped brackets 75 for attaching to the fixing plate 54 with screws (FIGS. 46 and 47).

In the bench type water closet unit having the above structure, the water closet 1 is fastened to the box-like and frame type adapter 49, and in turn the adapter 49 is attached to the pillars 41 and 42. Thus, the supporting strength of the water closet is extremely high. Because the bench type water closet is used, the floor (the waterproof pan 48) of the toilet room can be wholly washed. The washing water may be removed through the trap **48*b***.

In the above embodiment, plural bolt holes 52 are provided in the sub-angle bars at various heights, with respect to one bolt hole 64 in the water closet 1. The height of the water closet 1 may be easily adjusted by changing the bolt hole in the sub-angle bars 51 through which the bolts 53 are inserted. The adapter 49 may be installed with protruding from the toilet room, or the bay window unit 72 may be installed, whereby the space of the toilet room may be enlarged.

Figure 49:
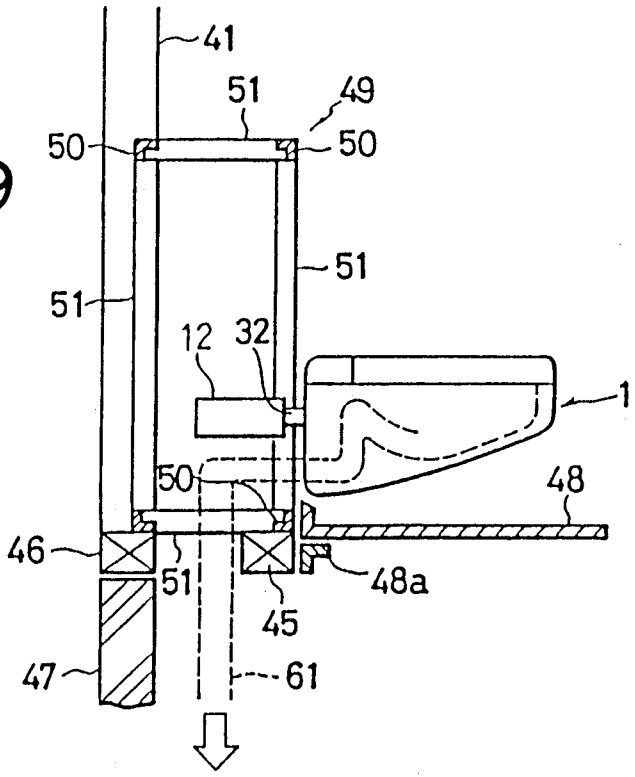
FIG. 49 is a side elevation view schematically illustrating another manner wherein the sitting type water closet is installed in the toilet room.

FIG. 49 illustrates another embodiment wherein the water closet 1 according to the present invention is installed in a different manner. In this embodiment, a major part of the adapter 49 is installed in the inside of the pillars 41 and 42. The main angle bar 50 in the lower front part of the adapter 49 is fixed on the sleeper 45. The referential numerals in FIG. 49 have the meanings same as those given in FIG. 41.

It should be understood that the detailed description as to the water closet unit with reference to the above drawings is given by way of illustration only. For example, the number of the warm air outlet, the position of the warm air path, the structure of the warm air path (the presence or the absence of the guiding groove), the direction of the warm air blown out, or the like, may be different from those shown in the drawings. The water closet used includes the bench type, and the water closet fixed on the floor and the adapter. A device for controlling an amount of the warm air may be installed. The adapter used includes not only the frame type, but also a box which is made of plates and has appropriate openings. The shape of the adapter may be appropriately adjusted in accordance with the shape of the toilet room. The water closet of the present invention may be adjusted so as to attach the same to the wall or the like of the toilet room, instead of the pillars.

As explained, the sitting type water closet, particularly the bench type water closet, can be installed in the toilet room with an extremely high strength, using the water closet unit of the present invention. An air conditioner or the tank for the washing water may be installed within the adapter. By protruding the adapter from the building as the bay window, the inner space may be enlarged.

According to the present invention, a means for facilitating the attachment of the water closet to the adapter is provided.

In the water closet unit of the present invention, the fixing plate is attached on the adapter side facing the toilet room, and nuts are fixed on the plate, whereby the water closet can be fastened to the adapter with the bolts threadedly fittable to the nuts.

Alternatively, the bolts are fixed on the plate instead of the nuts, and the bolts are inserted through the bolts holes in the water closet, whereby the water closet can be fastened to the adapter with the nuts threadedly fittable to the bolts. Because the fixing plate having such structures is attached to the adapter, the water closet can be attached to the adapter by bringing the rear side of the water closet with the fixing plate and then fastening the bolts or nuts.

Accordingly, a register of the water closet and the fixing plate can be easily carried out, and the bolts and nuts can be easily fastened.

Figure 50:
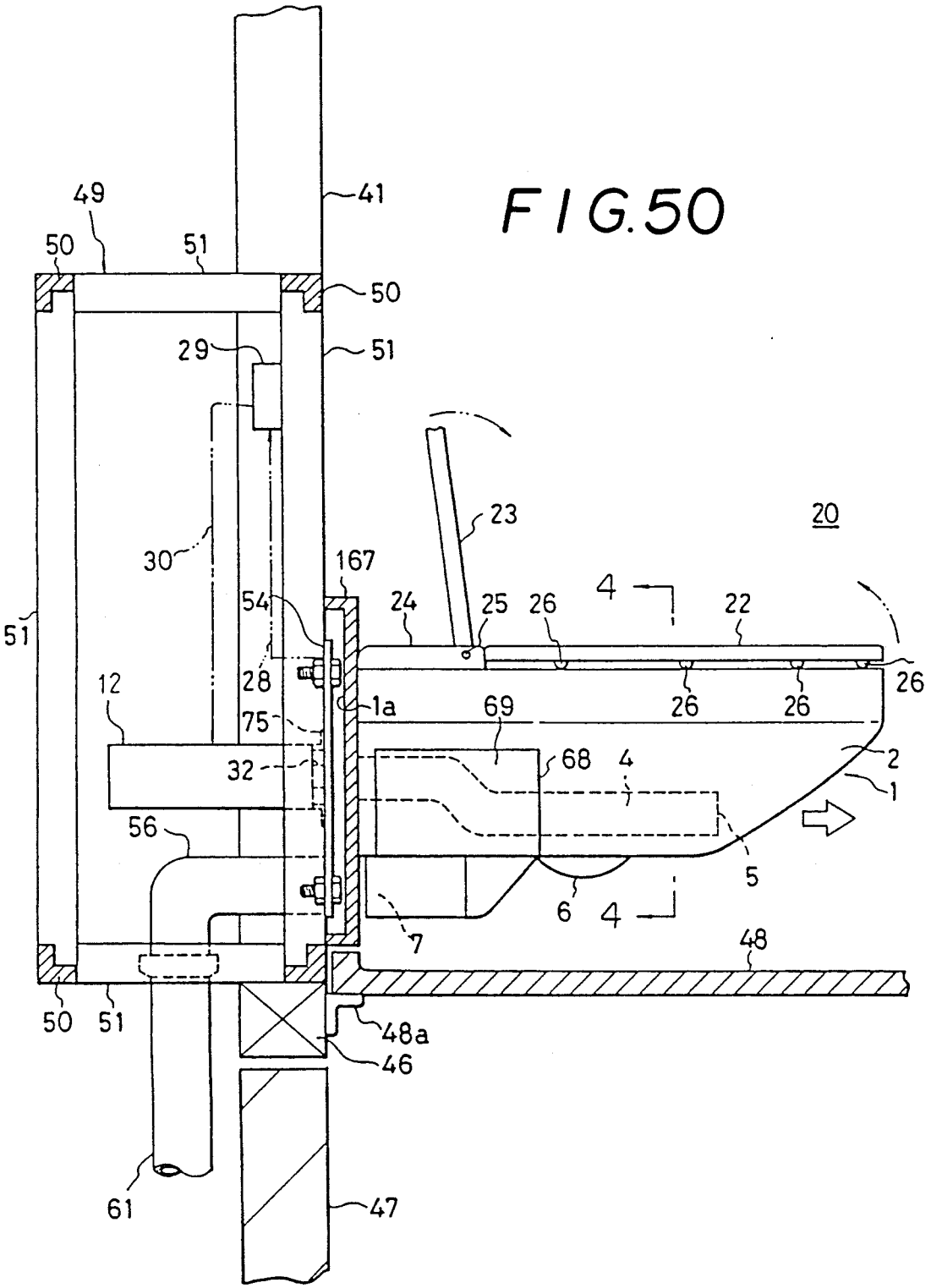
FIGS. 50 and 51 are sectional plan views illustrating the manner wherein the water closet unit is installed in the toilet room, using a specific fixing plate.
Figure 51:
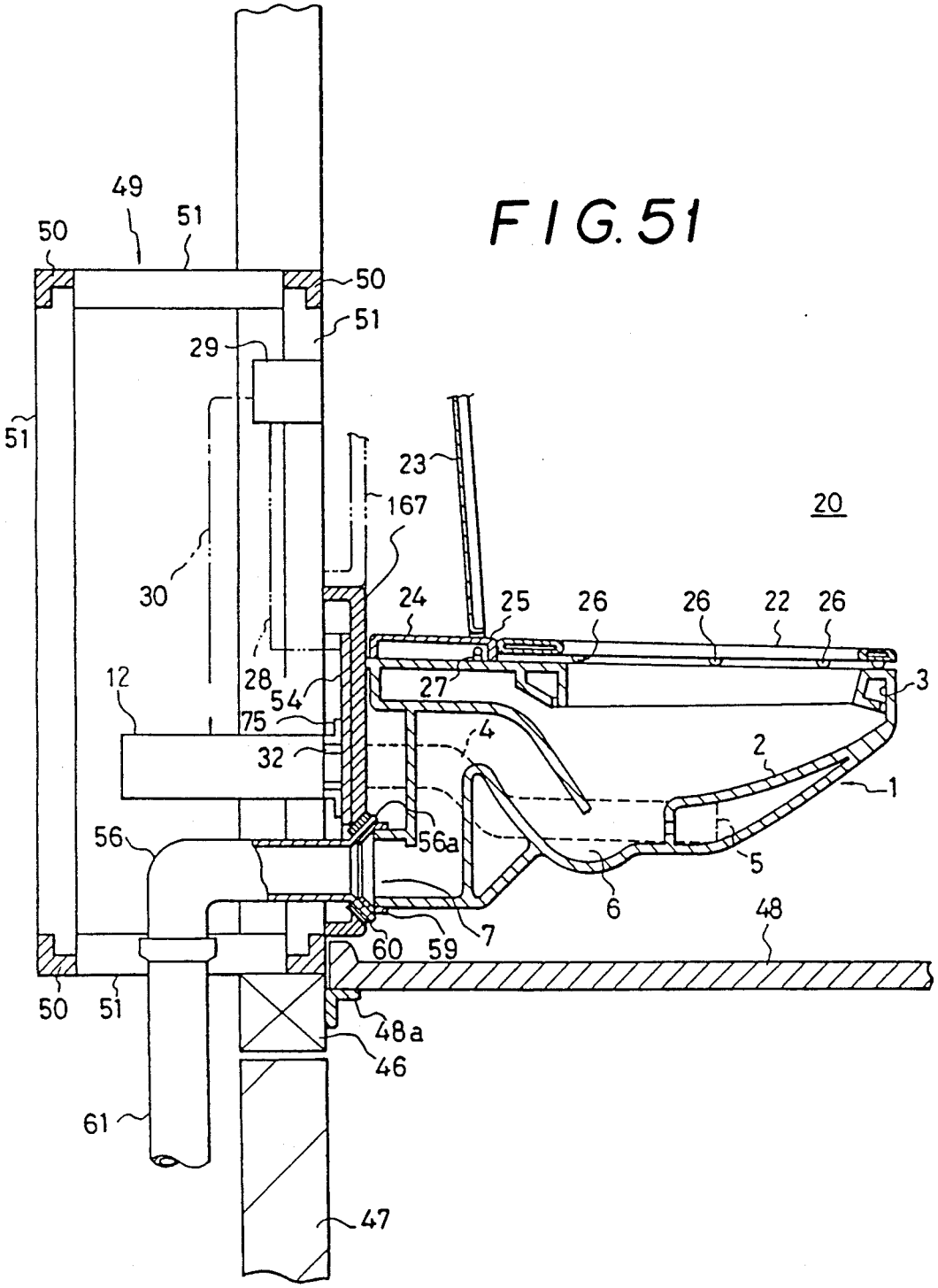
Figure 52:
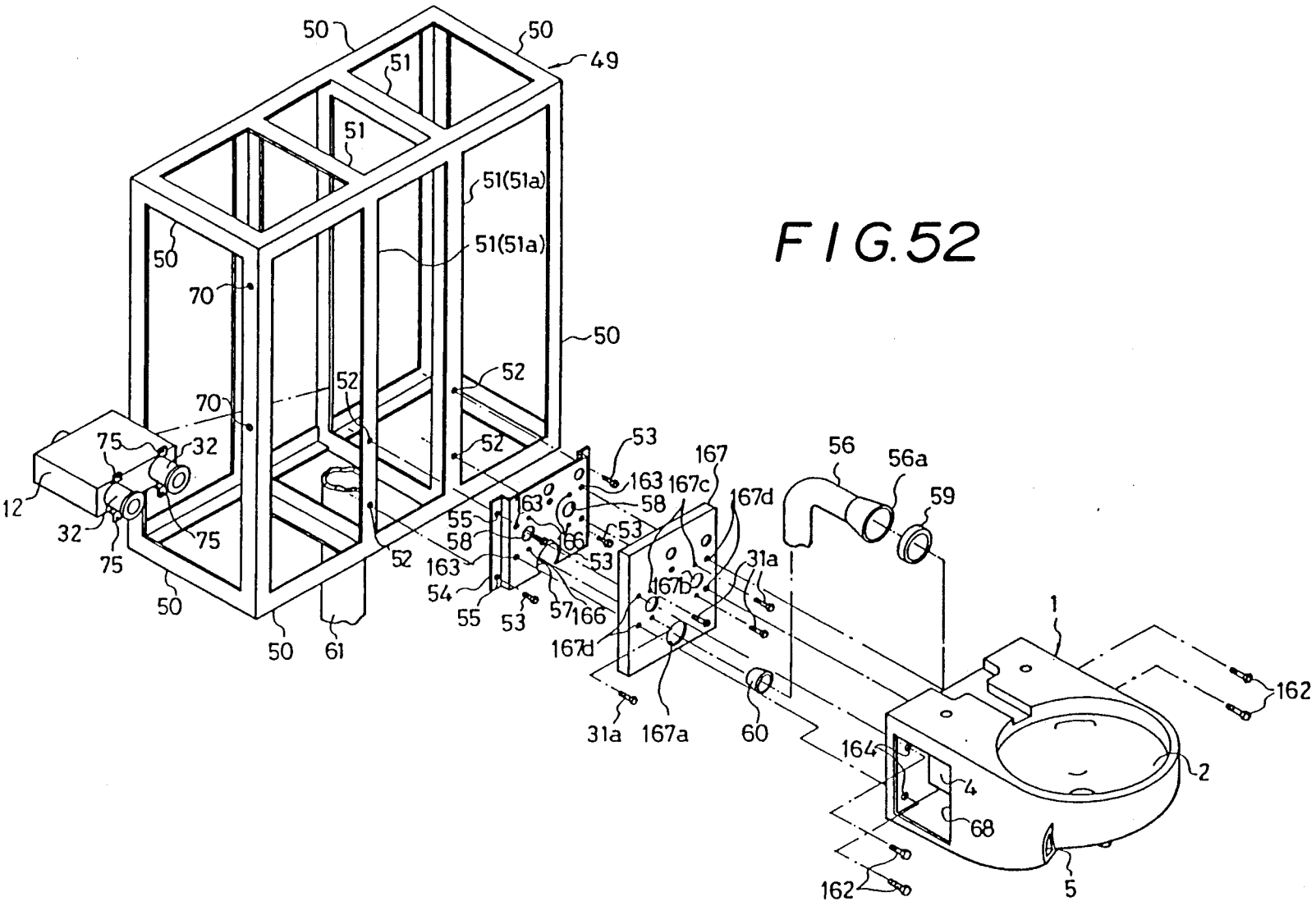
FIG. 52 is a setting-up perspective view of FIGS. 50 and 51, FIGS. 53 and 54 are perspective views of the embodiments of the fixing plates.
Figure 53:
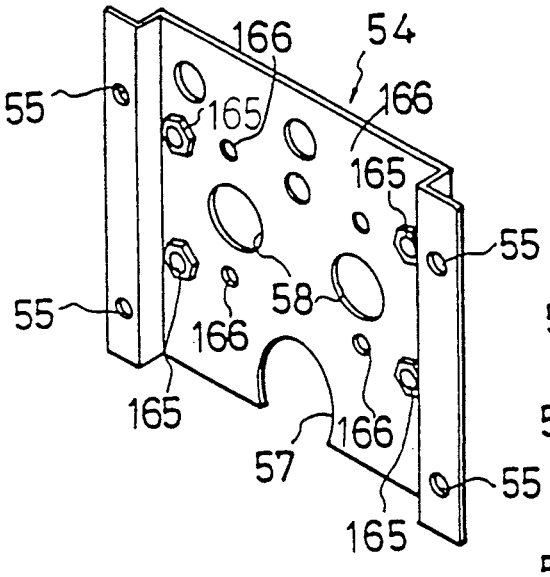

FIGS. 50 to 52 schematically show the condition wherein the water closet 1 is attached to the adapter 49, using the fixing plate having such specific structure, particularly the fixing plate 54 shown in FIG. 53.

As shown, particularly in FIG. 52, the fixing plate 54 has through holes 163 for the bolts 162 to attach the water closet 1. At the rear side of the water closet 1, through holes 164 are provided for the bolts 162. Nuts 165 threadedly fittable to the bolts 162 are fixed by welding or the like at the positions of the through holes 163 on the rear surface of the fixing plate 54 (FIG. 53). The fixing plate 54 has a through hole 166 for a bolt 31*a* to attach the warm air generator 12.

The fixing plate 54 is covered with a decorative panel 167. The panel 167 includes a through hole 167*a* for the drainage pipe 56, a through hole 167*b* for the warm air outlet 32, through holes 167*c* for the bolts 31*a*, through holes 167*d* for the bolts 162, or the like.

The warm air generator 12 has an L-shaped bracket 75 so as to attach the generator to the fixing plate 54 with screws (FIG. 52). The warm air generator 12 and the decorative panel 167 are attached by inserting the bolts 31*a* through the holes 167*c* and 166 in the decorative panel 167 and the fixing plate 54, and fastening the nuts.

To carry out the attachment of the water closet 1, the fixing plate 54 is fixed to the adapter 49 with the bolts 53. The warm air generator 12 and the decorative panel 167 are then fixed with the bolts 31*a*. The rear end 1*a* of the water closet 1 is brought into contact with the decorative panel 167, and the bolts 162 are threadedly engaged with the nuts 165. In this case, the bolts 162 can be easily engaged with the nuts 165, which have been fastened on the back surface of the fixing plate 54.

Figure 54:
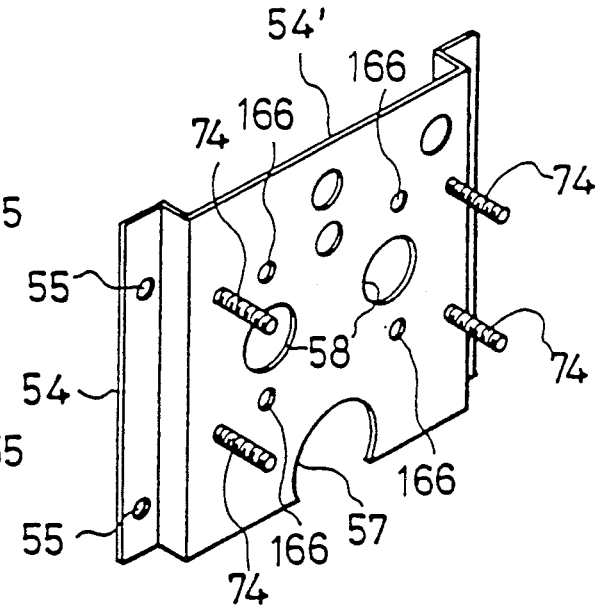
Figure 55:
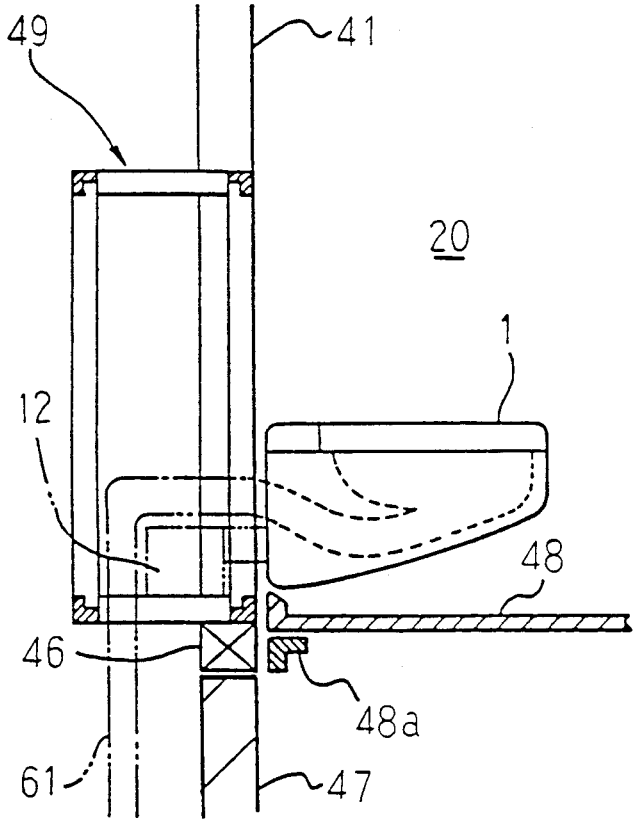
FIG. 55 is a sectional elevation view schematically illustrating the manner wherein the present water closet unit including the warm air outlet disposed on the side wall of the adapter is installed in the toilet room.

FIG. 54 shows another fixing plate 54' which may be used in the present invention. The fixing plate 54' does not have bolt holes 163 and nuts 165. Instead thereof, stud bolts 74 are provided on the fixing plate 54'. The water closet 1 can be attached by inserting the stud bolts 74 through the bolt holes 167*d* in the decorative panel 167 and the bolt holes 164 in the water closet 1, and then fastening the nuts. The referential numerals in FIG. 54 have the same meanings as given in FIG. 53. The water closet 1 can be easily attached to the adapter, using also the fixing plate 54'.

In still another embodiment of the present invention, the warm air outlet may be arranged on the side wall of the adapter, instead of or in addition to the warm air outlet in the water closet. The warm air outlet is provided on the side wall same as that for attaching the water closet. Further, the warm air outlet is provided at a height lower than that of the top of the water closet.

When the water closet unit having such a structure is installed in the toilet room, the warm air is blown out from the lower portion of the wall behind the water closet and can rapidly heat the leg of the user. Further, the toilet room is wholly heated, too. When the warm air outlets are arranged in both of the side wall of the adapter and the lower portion of the water closet, the warm air is also blown out from the water closet, and thus, the leg of the user may be effectively heated. Further, the dew condensation of the toilet bowl and the freezing of the trap water can be avoided.

FIGS. 55 to 59 illustrate the condition wherein the adapter 49 carrying the water closet 1 fastened thereto is attached to the pillar 41 in the toilet room 20. The adapter 49 contains the warm air generator 12 therein. The referential numerals in FIGS. 55 to 59 have the meanings as given above.

Figure 56:
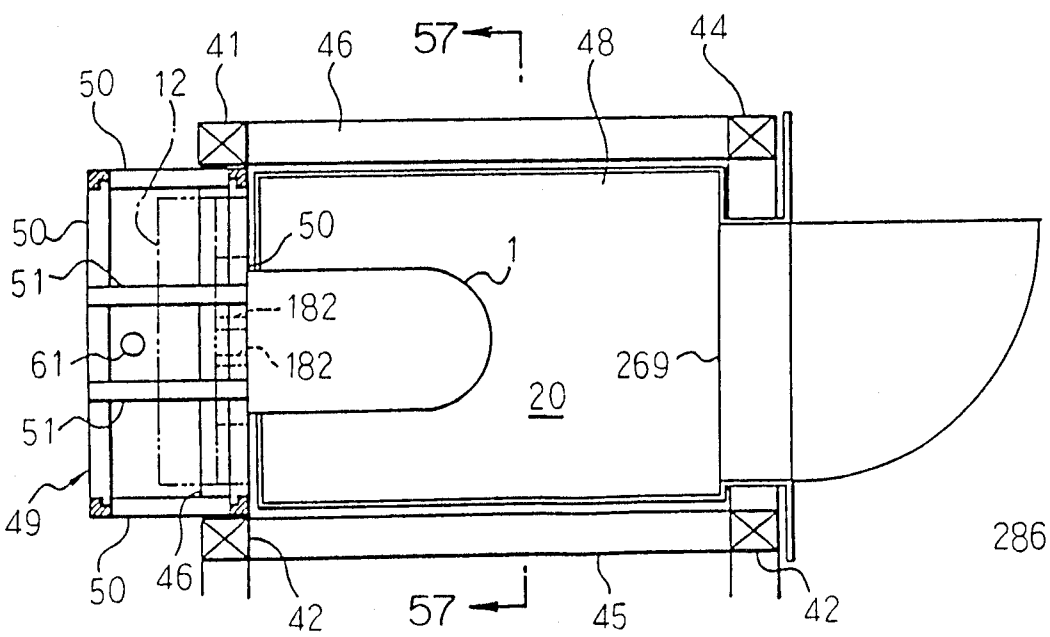
FIG. 56 is a sectional plan view thereof.

The toilet room 20 has a door 269 (FIG. 56). The adapter 49 carries appropriate decorative panels 49A, 49B and 49C on the front and upper sides thereof (FIG. 57).

Figure 58:
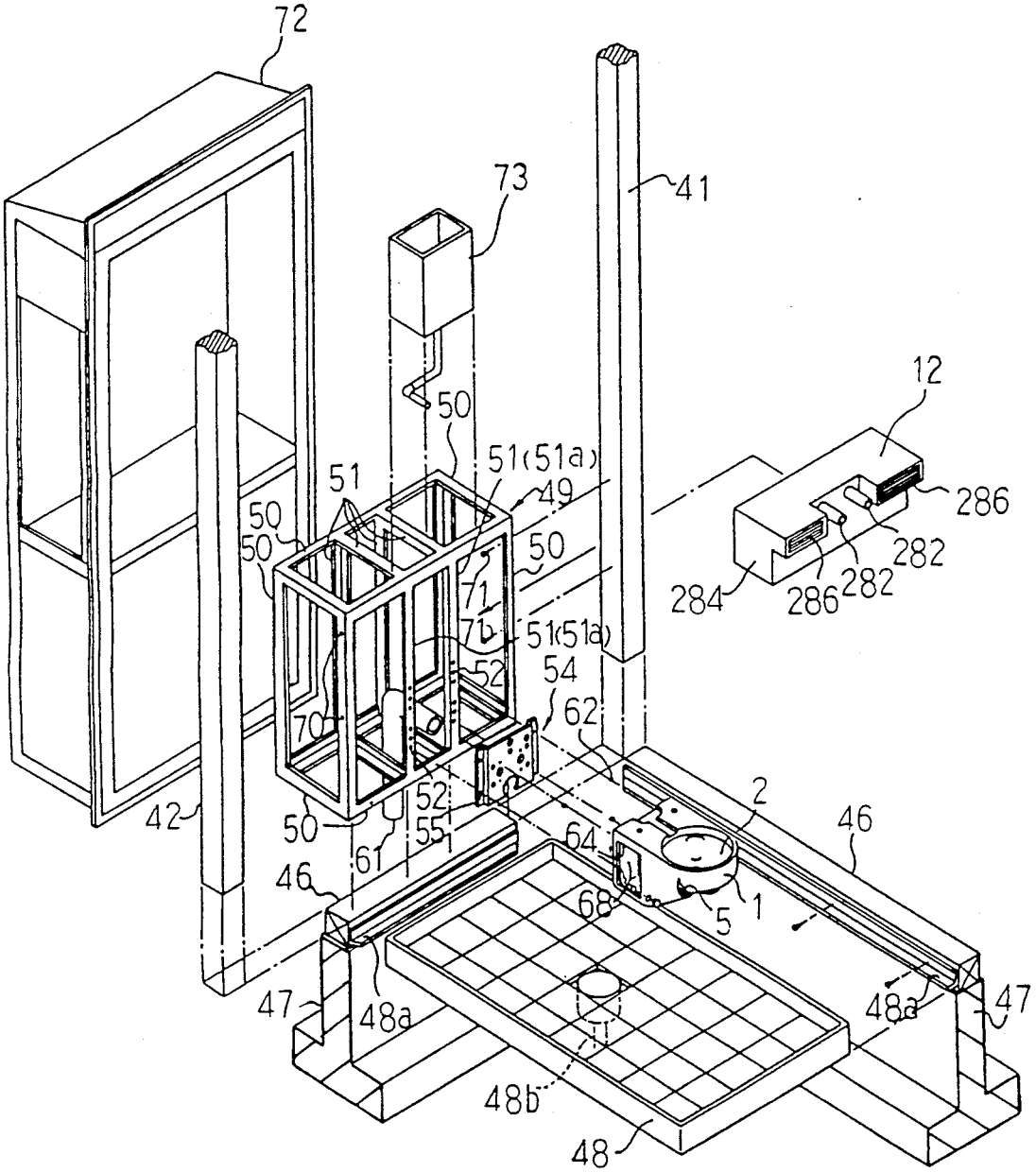
Figure 59:
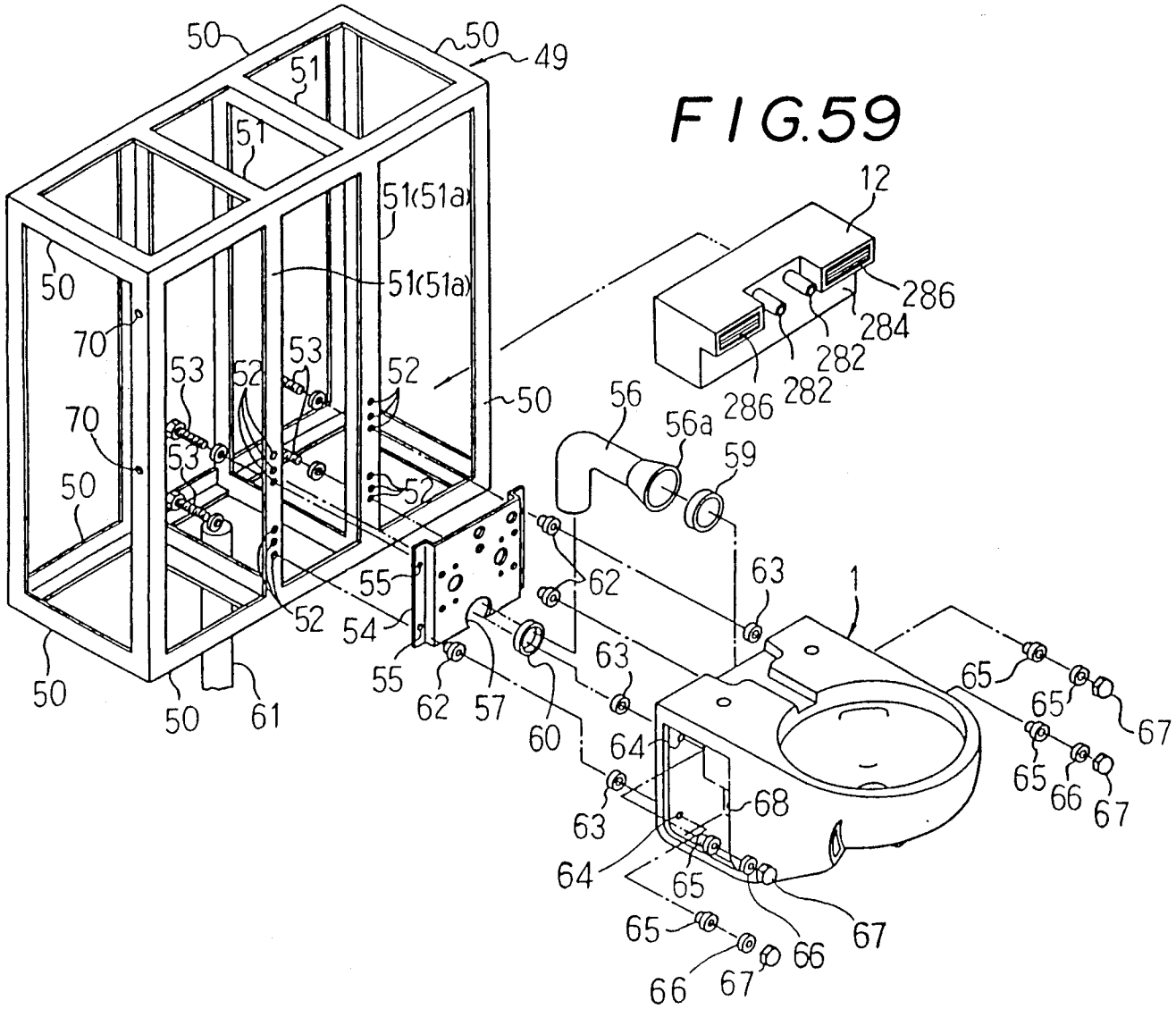
Figure 60:
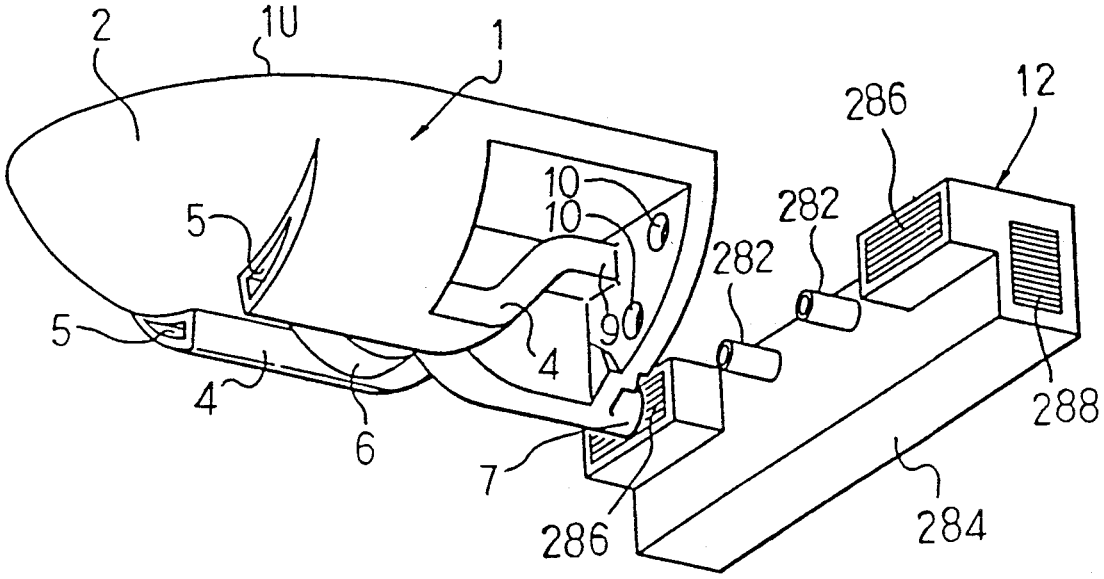
FIG. 60 is a perspective view of the water closet and the warm air generator.

As shown in FIGS. 58 to 60, the warm air generator 12 is included in a casing 284 which is transversely arranged behind the water closet 1. The casing 284 further contains a turbo-fan, a resistance heating element (such as a ceramic heater element) and the like. The warm air generator 12 has the warm air pipes 282 and the warm air outlets 286 on both sides at a height lower than that of the upper face IU of the water closet. The warm air generator 12 has an intake vent 288.

Figure 57:
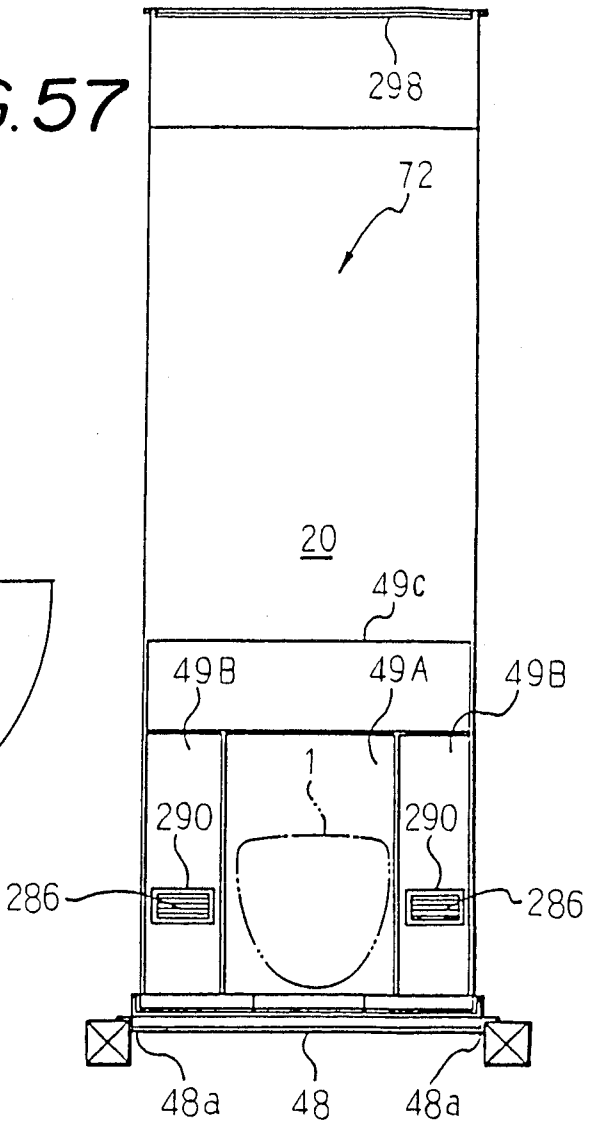
FIG. 57 is a sectional view taken on line LVII—LVII of FIG. 56, FIGS. 58 and 59 are setting-up perspective views thereof.

As shown in FIG. 57, openings 290 are arranged on the front panel 49B of the adapter 49 so that the outlets 286 face the toilet room 20.

In the toilet room having such water closet unit, the warm air is blown out from the outlets 286 arranged on the wall of the adapter and the outlets 5 in the water closet 1, to effect the heating and, particularly the heating of the leg of the user. When the warm air generator having the resistance heating element as a heat source is employed, the warm air with a high temperature is blown out shortly after the warm air generator is turned on, and thus, the water closet has a good starting performance.

The warm air outlet on the wall of the adapter may be arranged at a height lower than that of the water closet, whereby the leg of the user may be heated more sufficiently. When the outlets 286 on the wall of the adapter are arranged in both sides of the water closet as in the embodiment illustrated in FIGS. 57 to 60, the toilet room 20 may be more effectively heated as a whole. There may be arranged a device for controlling that the warm air is blown out from either the outlet 286 on the wall or the outlet 5 in the water closet. In this case, the water closet unit may be constructed so that the whole heating is effected by blowing the warm air out only from the outlet 286, and further, the warm air is blown out from the outlet 5 when the water closet is employed.

The water closet and the water closet unit according to the present invention may be controlled in various manners by employing the seat switch.

For example, an on-off control of the warm air generator may be carried out by an on-off signal by the seat switch. In this case, when the user sits down on the toilet seat, the warm air starts to blow, and when the user stands up from the seat, the blowing-off ceases. Therefore, the electric power consumed may be saved, and this embodiment is economical.

Further, a timer may be added to the warm air generator, and at the same time, the power of the warm air generator may be made controllable. In this embodiment, when the timer is on, The warm air generator is operated under a low power to blow the warm air having a relatively low temperature. When the user sits down on the toilet seat, the warm air generator is operated under a high power to blow the warm air having a relatively high temperature during the employment of the water closet by the user. In the water closet or water closet unit wherein the timer controlling system is employed, the temperature in the whole toilet room may be elevated by blowing the warm air out when the water closet is not used.

To improve the starting performance of the whole heating of the toilet room, there may be used the system wherein the warm air generator is operated under a high power when the timer is on, and the low power is utilized if the user feels the air hot.

For example, as shown in FIGS. 41 and 42, the seat switch 27 including the pressure-sensitive switch mechanism is disposed between the hinge shaft 25 and the upper surface of the toilet bowl 2. The seat switch 27 is connected via the lead wire 28 with the controller 29, and then via the signal wire 30 with the warm air generator 12. The outlet 32 of the warm air generator 12 is communicated with the warm air duct 4.

Figure 61:
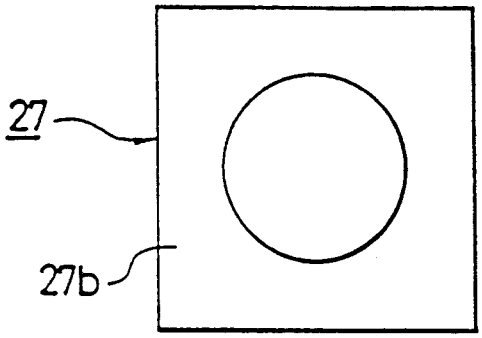
FIG. 61 is a plan view of the seat switch.
Figure 62:
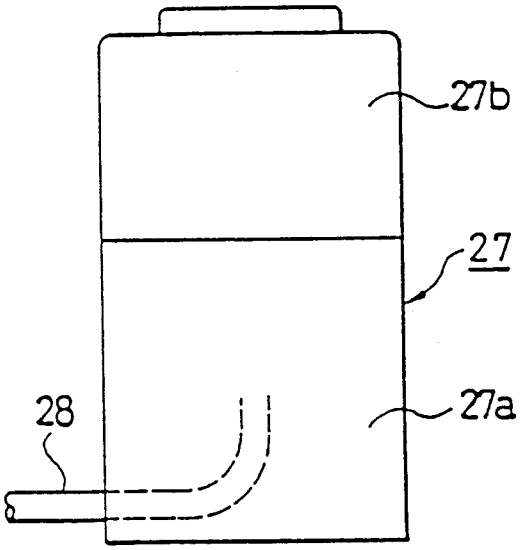
FIG. 62 is a front view thereof.
Figure 63:
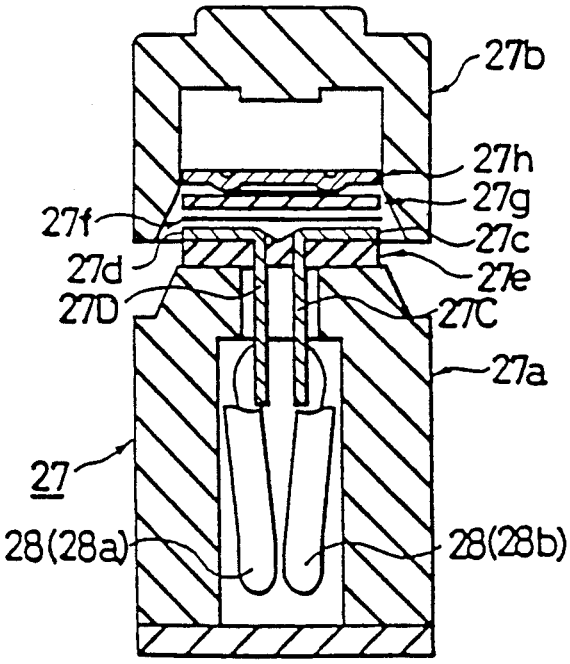
FIG. 63 is a sectional view thereof.

FIGS. 61 to 63 illustrate the structure of the seat switch 27. The seat switch 27 is covered with cylindrical jackets 27*a*, 27*b* made of an elastic material, such as a rubber. At the end of the elastic jacket 27*a*, a pair of semicircular electrodes 27*c*, 27*d* is disposed by introducing into receptacles 27C, 27D in the elastic jacket 27*a*. The end of each receptacle 27C and 27D is connected with lead wires 28 (28*a* and 28*b*). An insulating material 27*e* is introduced between the electrodes 27*c* and 27*d*.

An insulating spacer 27*f* in the form of a thin plate having an opening, e.g., a ring, is disposed, contacting the electrodes 27*c* and 27*d*. On the insulating spacer 27*f*, an electrically conductive, elastic (e.g., rubber) piece 27*g* and a press piece 27*h* are stacked.

In the seat switch 27, when a compression load is applied to the elastic jacket 27*a* in an axial direction thereof, the cap-shaped elastic jacket 27*b* is deformed as press-collapsed in an axial direction. In the switch, then, the conductive elastic piece 27*g* is pressed with the press piece 27*h*. The conductive elastic piece 27*g* is deformed so that a part thereof is introduced into the opening of the insulating spacer 27*f*. Thus, the tip of the introduced part of the conductive elastic piece 27*g* contacts the electrodes 27*c*, 27*d*, whereby the electrodes 27*c* and 27*d* are connected with each other, and the seat switch is turned on.

When the compression load is removed from the seat switch 27, the elastic jacket 27*b* recovers the original shape thereof. Thus, the conductive elastic piece 27*g* recovers the original shape, and then separates from the electrodes 27*c* and 27*d*. Therefore, the electrodes 27*c* and 27*d* separate from each other, and the seat switch 27 is turned off.

In the water closet having the above structure, when the user sits down on the toilet seat 22, the seat switch 27 is turned on, the warm air generator 12 is then operated, and the warm air is blown out from the outlet 5. The warm air contacts the lower half of the body, particularly the calf, of the user, thereby heating the leg of the user.

Referring to FIGS. 64 to 67, the structure of the controller 29 and the warm air generator 12 will be explained hereinafter.

Figure 64:
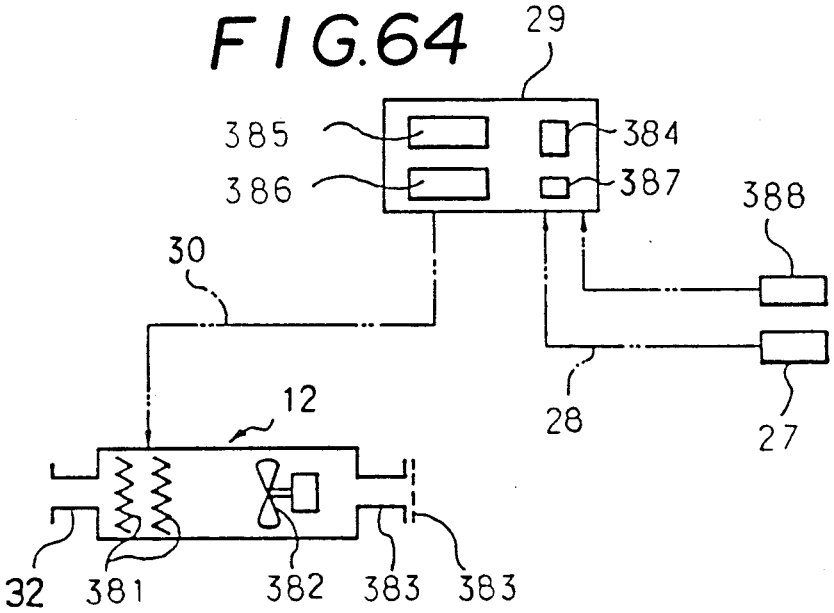
FIG. 64 is a block diagram of the control system of the embodiment wherein the seat switch is used.

As shown in FIG. 64, the warm air generator 12 has an electric heater (ceramic heater) 381 as a heat source. The generator further contains a propeller fan 382 as a fan. An air filter 383*a* is disposed to an intake vent 383. The warm air generator 12 is installed within the bay window unit 72.

The controller 29 comprises a main switch 384 for turning the whole circuit on or off, a temperature presetting device 385 for setting a standard temperature at which the electric heat 381 is operated, the timer 386, a switch 387 for forcing the warm air generator 12 to work, and the like. The lead wire 28 from the seat switch 27 and the signal wire 30 to the warm air generator 12 are connected with the controller 29. Further, a temperature sensor 388 to detect the temperature in the toilet room 20 is connected with the controller 29.

The controller 29 contains a device for the control as described below, such as a sequence control circuit of microcomputer. As shown in FIG. 65, when the user sits down on the toilet seat 22 and the seat switch 27 is turned on, the temperature in the toilet room 20 is judged if it is lower than the predetermined standard temperature (e.g., 20° C.). If the temperature is lower than the predetermined one, the electric heater 381 is turned on, the propeller fan 382 is rotated, and then the warm air is blown out from the outlet 5. If the temperature is higher than the predetermined one, the warm air is not blown out. When the user stands up from the toilet seat 22, the electric heater 381 is turned off and the rotation of the propeller fan 382 is stopped.

When the timer 386 is turned on (i.e., when the presetted time comes to blow the warm air out), or when the forcing switch 387 is turned on, the temperature in the toilet room 20 is judged if it is lower than the predetermined one. If the temperature is lower, the electric heater 381 is turned on, and the propeller fan 382 is rotated, and thus, the warm air is blown out.

FIG. 67 shows an embodiment wherein the timer 386 is employed. In this embodiment, the timer 386 is presetted so that it is turned on only during 5:00 a.m. to 8:30 a.m., when the water closet is frequently employed. Thus, the toilet room 20 is intended to heat as a whole (arrow B).

During 5:00 a.m. to 8:30 a.m., i.e., when the timer is on, if the user sits down on the seat 22, the electric heater 381 is operated in a full power to blow the warm air out (arrows C, D, E, F, G). During the other period of time, only if the user sits down on the toilet seat, the electric heater 381 is worked to blow the warm air as shown in arrows A and H in FIG. 67. By continuously operating the electric heater only during the period of time when the water closet is frequently employed, as above, it is possible to save electricity, and at the same time, perform the whole heating of the toilet room. Therefore, economical and comfortable requirements may be met. Because the electric heater 381 is turned on immediately after turning on, the warm air is blown out immediately after the user sits down.

It is preferable in the above embodiment to use the electric heater which can save electricity (for example, the resistance heating element which can change the powers, for example, of 400 W and 800 W) and to blow the warm air having relatively low temperature by working the electric heater under a lower power when the timer is on (arrow B in FIG. 67).

Further, the power of the heater may be changed between more than two levels, or continuously controlled.

According to still another embodiment of the present invention, the seat switch brings about another control system. The present invention also provides a water closet or a water closet unit comprising the warm air path [(i) the warm air duct and optionally (ii) the warm air guiding groove] for blowing the warm air out to the leg of the user from the lower portion of the water closet installed to the toilet room, the warm air generator [(i) the blower arranged in the warm air duct, for generating the air stream flowing to the leg of the user, and (ii) the electric heater arranged in the warm air duct, for heating the air stream flowing through the duct, when turned on], and a controlling device which applies an electric current to the electric heater when the user of the water closet sits down on the toilet seat, but restrains an amount of the air from the blower until a given period of time elapses.

In the above embodiment, the electric heater is turned on, when the user sits down on the water closet installed in the toilet room. Further, the amount of the air from the blower is restrained, until the given period of time elapses after the user sits down on the water closet. Therefore, the heat radiation from the electric heater is prevented, and thus, the heater can rapidly go up to the predetermined temperature. After the given period of time elapses, the blower starts to work for conveying a given amount of the warm air. Then, the warm air heated up to the predetermined temperature is blown out from the outlet of the warm air duct disposed in the lower portion of the sitting type water closet to the leg of the user. Therefore, this embodiment can prevent cold air from blowing out, and a cool touch to the user can be avoided, shortly after the electric heater starts to work.

Figure 68:
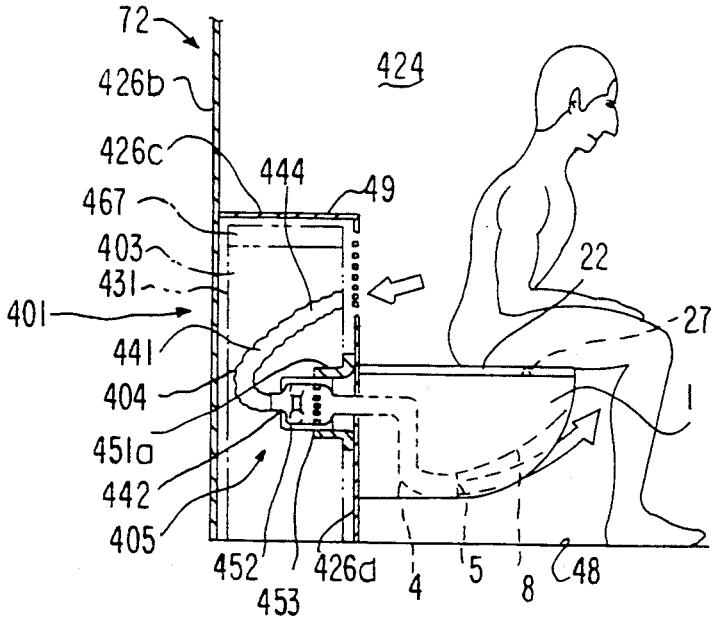
FIGS. 68 and 69 are side elevation views and FIG. 70 is a perspective view schematically illustrating the manner wherein the water closet unit having the seat switch as another embodiment of the present invention is installed in the toilet room.
Figure 69:
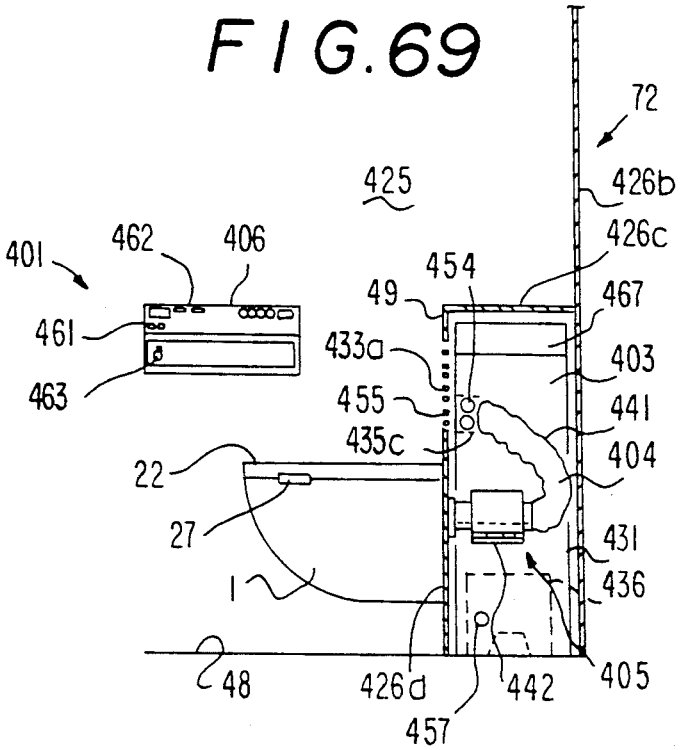
Figure 70:
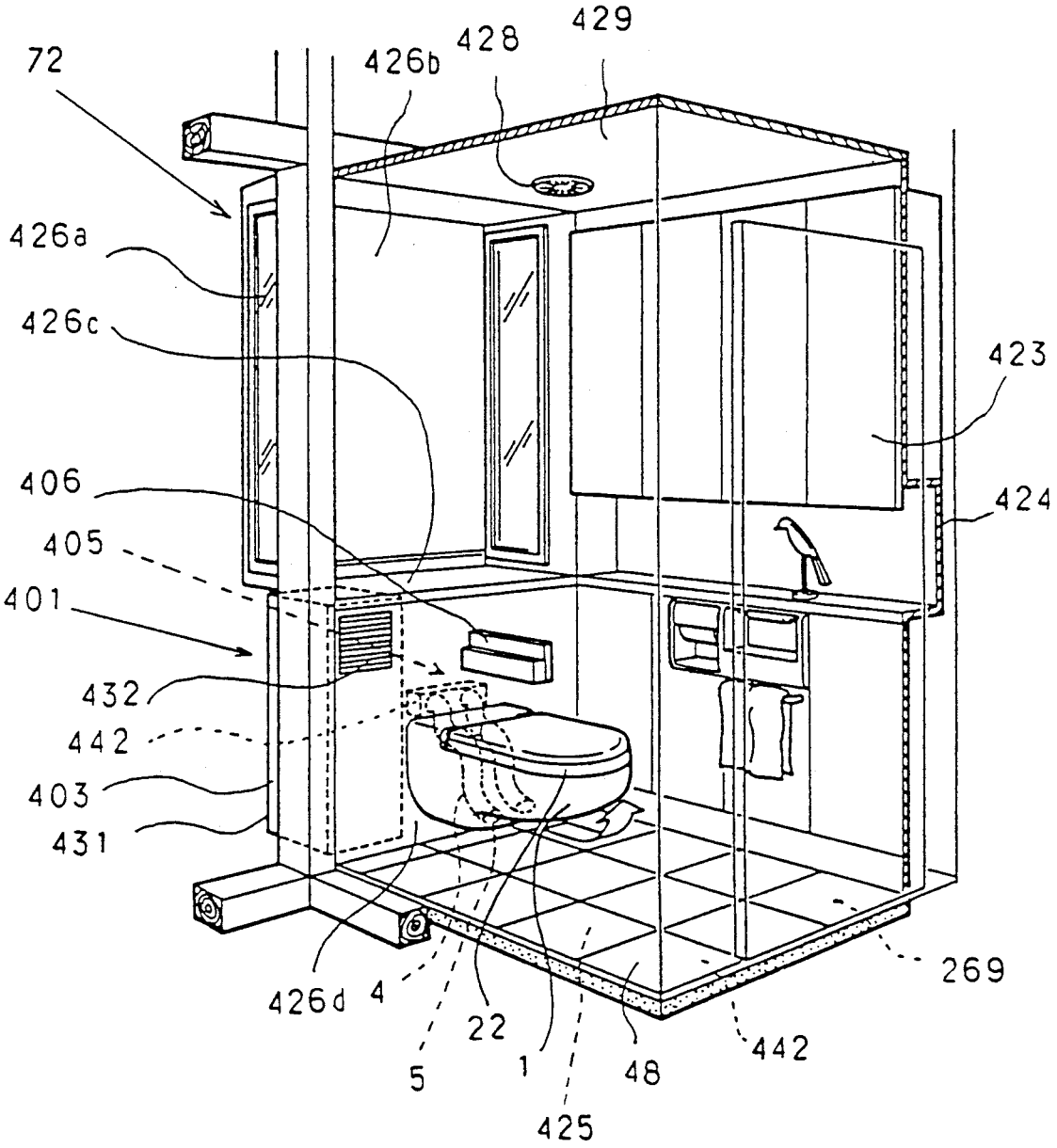
Figure 72:
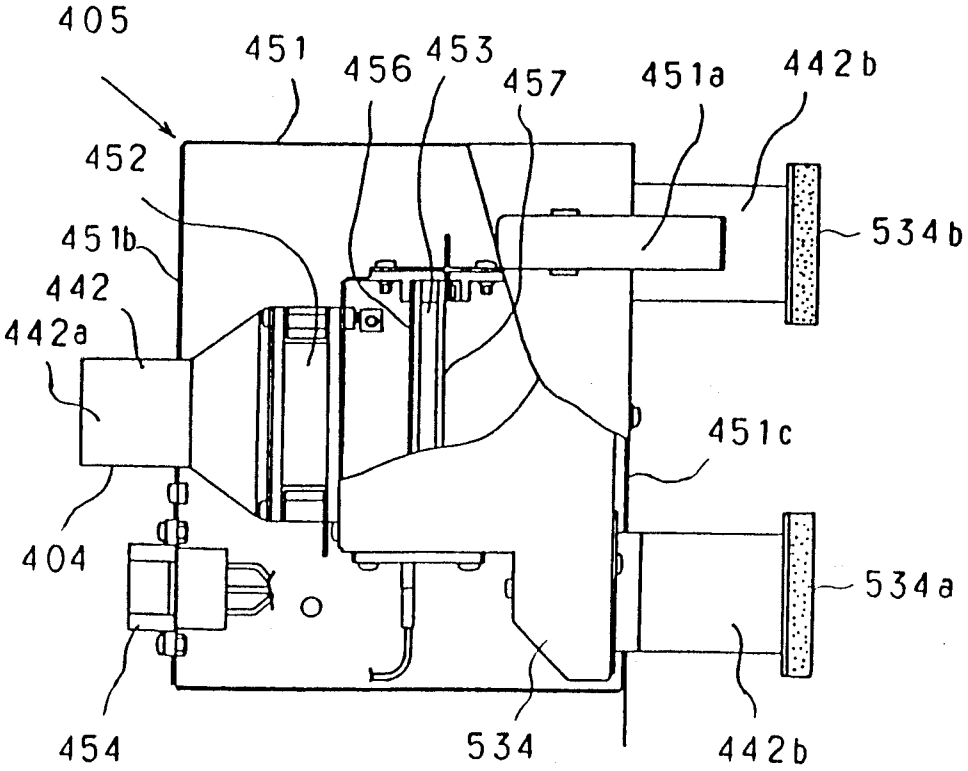
FIG. 72 is a plan view thereof.
Figure 71:
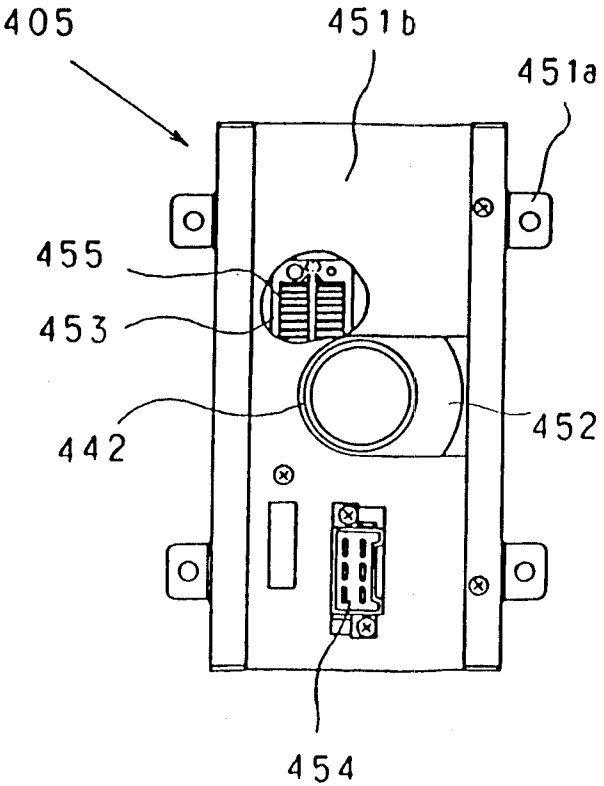
FIG. 71 is a side elevation view of a leg heater.

FIGS. 68 to 70 illustrate the toilet room including the water closet unit of the above embodiment. FIGS. 71 and 72 show a leg heater contained in the warm air generator.

The water closet unit 401 comprises a heat pump type air-conditioner 403 for wholly heating the toilet room 20; a ventilating duct 404 for blowing the warm air out into the toilet room 20; the blower 452 arranged in the warm air duct 404 for generating the air stream to the leg of the user; and the leg heater 405 for heating the air passing through the ventilating duct 404. The water closet unit 401 is connected with the control panel 406.

The toilet room 20 comprises a side wall 422 carrying the door 269; a side wall 424 carrying a container cabinet 423 for toilet paper; a side wall 425 carrying the control panel 406; the bay window unit 72 protruding outwardly; a resin floor 48; and a ceiling 429 carrying an air fan. The bay window unit 72 comprises a side wall 426*a*, and a counter 426*c* which is arranged in the front wall 426*b* and contains the air-conditioner 403 and the leg heater 405 therein.

The air-conditioner 403 is a window fan type, and fastened on the rear face of the side wall 426*d* of the counter 426*c*. The air-conditioner 403 is contained in the adapter 49 comprising the counter 426*c* and the side wall 426*b*. The air-conditioner 403 may contain a refrigeration cycle (not shown) within a unit case 431. Grilles 432 are provided to the outlet arranged on the front wall of the unit case 431, and an intake vent (not shown) and an outlet (not shown) arranged on the side wall of the unit case 431. The ventilating duct 404 comprises an intake duct 441 for inhaling the air present in the toilet room 20; a heater duct 442 connecting with the intake duct 441; and two warm air ducts 4 formed integrally on the lower portion of the toilet bowl 2 and connected with the heater duct 442.

The intake duct 441 has an intake vent 444 which faces the toilet room 20 to inhale the air present therein, and is arranged at the back of the grill 432 of the air-conditioner 403. The heater duct 442 is disposed to the leg heater 405. The warm air duct 4 has the warm air outlet 5 which has an opening near to the leg of the user, and blows the warm air out to the leg exposed when the user employs the water closet. From the warm air outlet 5 to the tip of the water closet 1, there is provided the warm air guiding groove 8 so as to minimize the reduction of the temperature of the warm air.

The leg heater 405 comprises a casing 451 for heat insulating the heater duct 442 from the air; an axial flow fan or the blower 452, which is arranged in the heater duct 442 and generates, in the heater duct 442, the air stream to the toilet room 20; two harmonica type positive thermistor cells (hereinafter referred to as PTC heater) 453 which are arranged in the heater duct 442, and heat the air passing therethrough.

The casing 451 has a parallelepipedic shape, and is fastened to the rear side of the side wall 426*b* of the counter 426*c*, with the fixing stays 451*a* welded to the casing 451.

The casing 451 carries, on a side plate 451*b*, a connector 454 for applying the electric current to the axial flow fan 452 and the PTC heater 453. Further, on the casing 451, a tail end 442*a* of the side plate 451*b*, and a two-way tail end 442*b* of the heater duct 442 is outwardly protruded from the other side plate 451*c*.

The axial flow fan 452 can serve to blow out a given amount of the air from the warm air outlet 5 to the exposed leg of the user, when received a given amount of electric current from the control circuit 466. When the axial flow fan 452 receives electric current from the control circuit 466 in an amount less than the predetermined one, the fan serves to blow the air to the exposed leg of the user in an amount less than the predetermined one.

The PTC heater 453 is formed by arranging many positive thermistor cell plates 455 [comprising conductive ceramics mainly composed of barium titanate ($BaTiO_3$), or the like] between a positive electrode plate 456 and a negative electrode plate 457. The PTC heater is formed so that the resistance thereof is suddenly increased at a given Curie point, by introducing various additives.

The PTC heater 453 makes use of the PTC characteristic property to maintain the surface temperature at a constant level by a current restriction function in the area where the resistance is suddenly changed. The Curie point of the PTC heater 453 is set to the temperature (e.g., 300° C.) lower than an ignition point (e.g., 400° C.) of dust or the like so that the surface temperature (almost the same temperature as Curie point) of the PTC heater 453 is set to the temperature lower than the ignition temperature of the dust.

Figure 73:
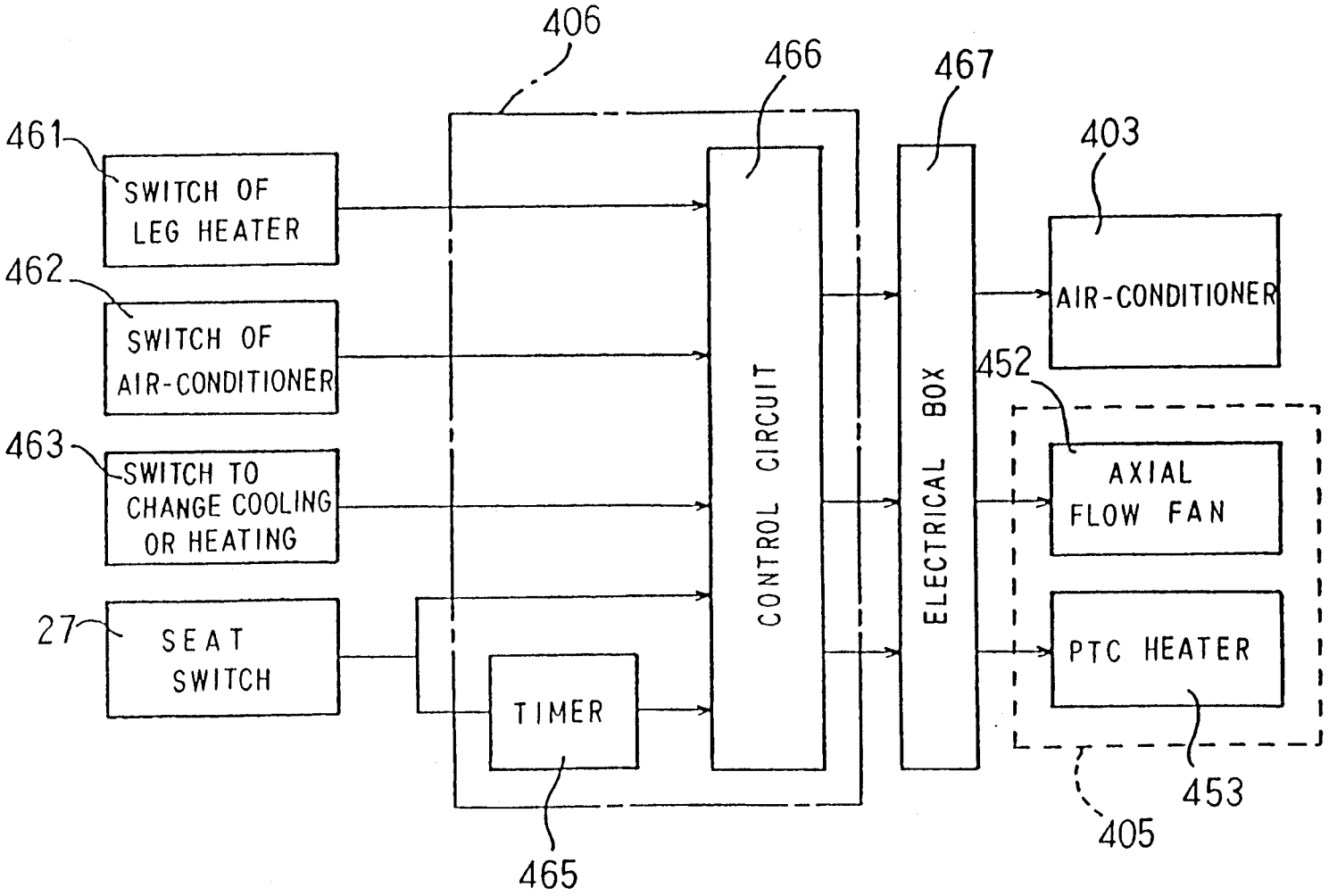
FIG. 73 is a block diagram of the built-in control circuit of the control panel.

FIG. 73 shows a block diagram of the built-in control circuit of the control panel.

The control panel 406 carries, on the entire front surface thereof, a switch 461 of the leg heater, a switch 462 of the air-conditioner, and a switch 463 for changing an air-cooling and an air-heating. The control panel 406 contains a control circuit 466 as a controlling device to receive signals from the leg heater switch 461, the air-conditioner switch 462, the cooling/heating-changing switch 463, the seat switch 27 and timer 465.

The leg heater switch 461 is a manual switch which gives to the control circuit 466 on-off signals of the leg heater 405, i.e., the axial flow fan 452 and the PTC heater 453. The leg heater switch 461 has three positions, i.e., "off", "weak", and "strong". The "weak" means one of the PTC heaters 453 is on, and the "strong" means two PTC heaters 453 are on.

The air-conditioner switch 462 is a manual switch which gives to the control circuit 466 on-off signals of the air-conditioner 403.

The cooling-heating changing switch 463 is a manual switch for changing the air-cooling to the air-heating, and vice versa.

The seat switch 27 is disposed under the toilet seat 22 of the water closet 1. When the seat switch 27 detects that the user sits down on the water closet 1, the seat switch 27 sends a sitting signal to the timer 465 and the control circuit 466 so that the axial flow fan 452 and the PTC heater are turned on. The seat switch 27 contains a pressure-sensitive switch which changes the resistance thereof by the weight of the user who sits down on the water closet 1, and sends the on-signal to the timer 465 and the control circuit 466 so that the leg heater 405 is turned on.

The timer 465, when receiving the on-signal from the seat switch 27, gives an off-signal to the control circuit 466 so as to defer operating the axial flow fan 452 for a given period of time (for example, for 5 seconds).

The control circuit 466 performs, in accordance with the input signals received, the on-off control of the air-conditioner 403, the axial flow fan 452 and the PTC heater 453, via an electrical box 467. Further, the control circuit 466 turns the axial flow fan 452 off to restrain the amount of the air from the fan 452, during a period of time when the circuit 466 receives the off-signal of the fan 452 from the timer 465.

The electrical box 467 is arranged in the upper portion of the unit case 431 of the air-conditioner 403, connected with a domestic electric source (100 V), and supplies an electric current to the air conditioner 403, the axial flow fan 452 and the PTC heater 453.

Figure 74:
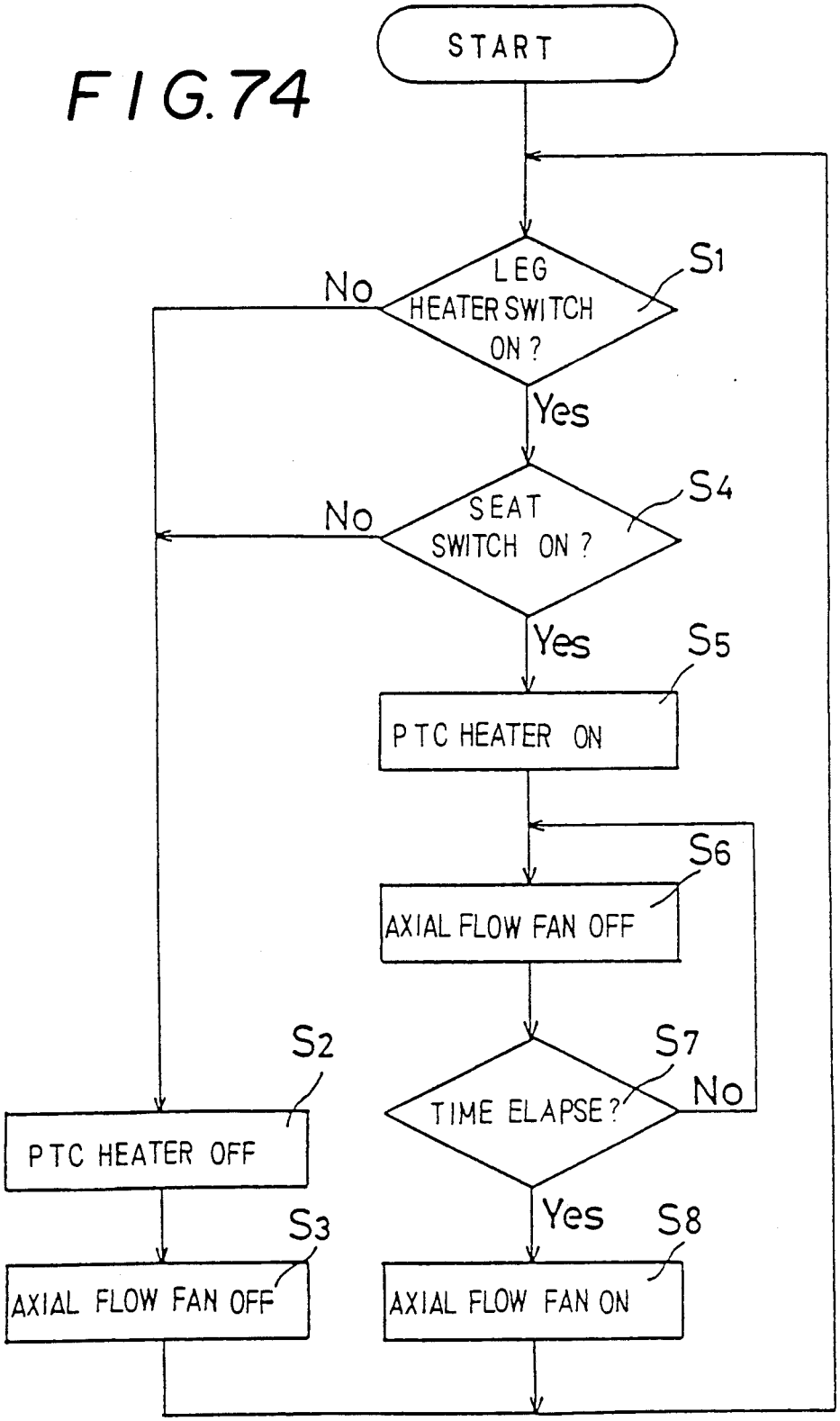
FIG. 74 is a flow chart of another actuation of the leg heater in the control circuit.

The operation of the leg heater 405 in the control circuit 466 according to the above embodiment will be explained, referring to FIG. 74.

First, a judgement is made if the leg heater switch 461 is on (or strong or weak) or off (step S1). When the leg heater switch 461 is off (No), the PTC heater 453 is turned off (step S2) and the axial flow fan 452 is turned off (step S3). Thereafter, the step S1 is repeated.

When the leg heater switch 461 is on (Yes) in the step S1, a judgement is made if the seat switch 27 is on (step S4). When the seat switch 27 is off (No), the step S2 is selected.

If the user of the water closet 1 sits down on the toilet seat 22 in this situation, the resistance of the seat switch 27 is changed by the weight of the user. Then, the seat switch 27 sends the on-signal for turning the leg heater 405 on to the timer 465 and the control circuit 466.

As above, when the seat switch 27 is turned on (Yes), the PTC heater is turned on (step S5), and the axial flow fan 452 is turned off (step S6).

The PTC heater 453 has a large hear capacity, and thus, can not be rapidly elevated to the predetermined temperature. If the PTC heater 453 in this condition is brought into contact with a fresh air (not heated) by the axial flow fan 452, the time necessary to elevate the temperature of the heater 453 per se to the predetermined one becomes longer. As a result, the air having a relatively low temperature is blown out from the warm air outlet 5 to the leg of the user.

If the air not heated is blown out to the leg of the user shortly after the PTC heater 453 begins to work, the undressed user would feel the touch cooler than that the user feels when dressed. The user sitting on the seat 22 can not but receive the cool air at the leg. Therefore, it is necessary to introduce a means for avoiding the cool touch from the user, in the water closet 1 carrying the leg heater 405 and the warm air outlet 5 therefor on the lower portion of the closet.

In the above embodiment, accordingly, the axial flow fan 452 is maintained to be off, until a given period on time (e.g., 5 seconds) elapses after the seat switch is turned on (step S7), to restrain the amount of the air blown. The PTC heater 453 stands under the windless condition, and the heat radiation therefrom is prevented, whereby the heater is rapidly elevated to the predetermined temperature.

Accordingly, it is avoided that the cool air is blown out to the leg of the user shortly after the PTC heater 453 is operated. Thus, the cool touch can be remedied.

After the predetermined period of time, the axial flow fan 452 is turned on to produce the air stream in the ventilating duct 404 (step S8). When the axial flow fan 452 is on, the air present in the toilet room 20 is sucked into the intake duct 441 from the intake vent. The air sucked into the intake duct 441 is introduced into the heater duct 442, heated to the predetermined temperature with the PTC heater 453, and then conveyed to the warm air duct 4. The warm air introduced into the warm air duct 4 is blown out from the outlet 5, blows along the guiding groove 8, on the closet, and reaches the leg of the user, thereby sufficiently heating the user.

In comparison with the case wherein the axial flow fan is turned on immediately after the PTC heater 453 is turned on, the user can feel the improved touch as shown in Table 1 by deferring the operation of the axial flow fan 452 until the predetermined period of time elapses.

TABLE 1

| Time after turning seat switch on (sec.) | Turning fan and PTC heater on | Deferring fan 5 sec., but turning heater on |
|---|---|---|
| 0–15 | cool touch | no feeling |
| 15–20 | no feeling | no feeling |
| >20 | warm touch | warm touch |

(Temperature of toilet room 20 is 3° C.)

As shown in Table 1, when the axial flow fan 452 and the PTC heater 453 are simultaneously turned on, the user feels the cooling air stream for about 15 seconds after the fan and heater begin to work. The user does not feel the cooling or warm touch about 15 to 20 seconds later, and then becomes to feel the warm touch about 20 seconds later.

On the other hand, when deferring the operation of the fan, the user does not feel the cool touch even for about 15 seconds immediately after the PTC heater 435 is turned on, whereas the warm touch can be obtained about 20 seconds later. This means that the heating effect is not affected.

As above, the cool touch shortly after the PTC heater 453 is turned on can be avoided, and the rapid heating effect can be satisfactorily obtained.

Figure 75:
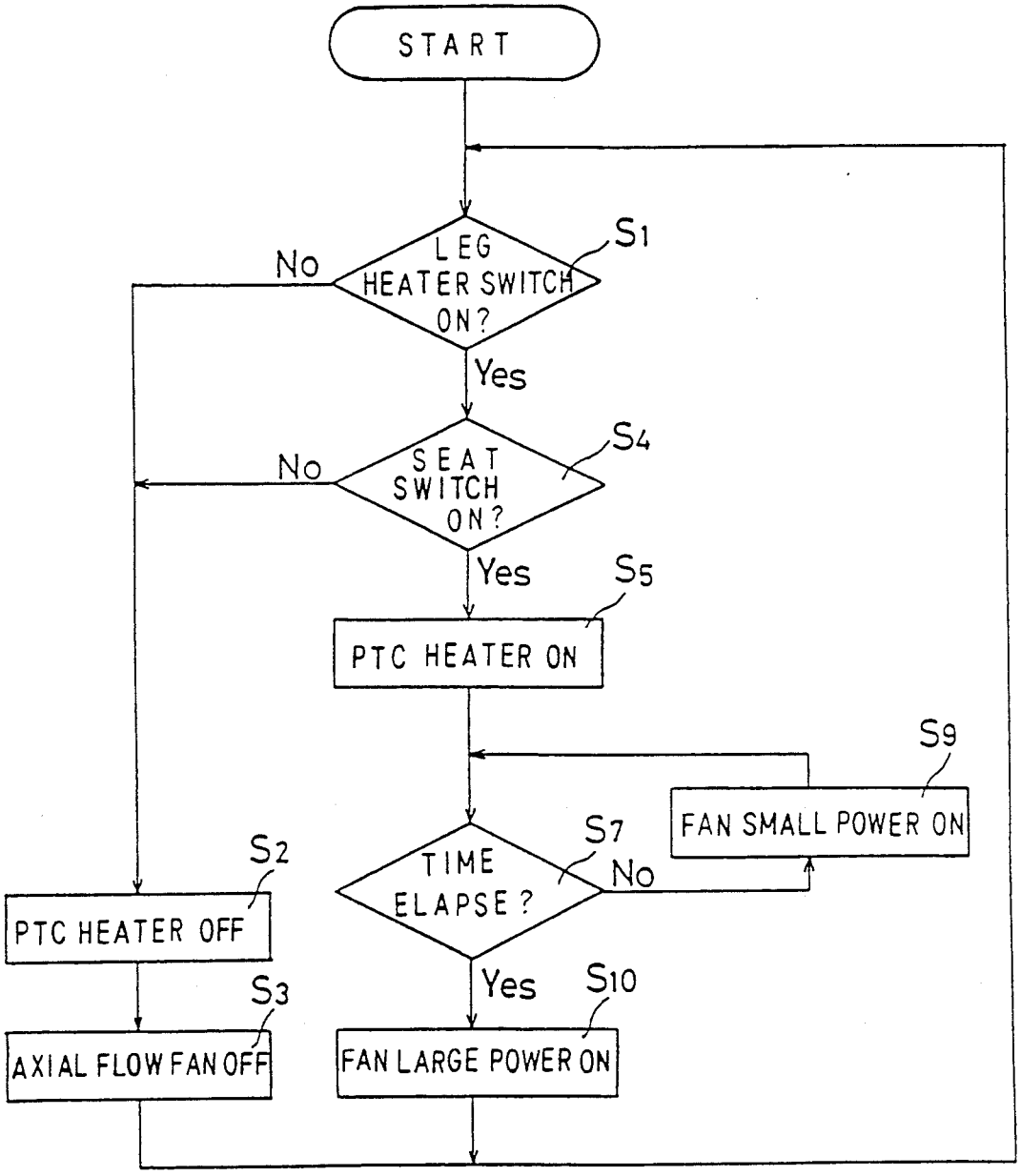
FIG. 75 is a flow chart of still another actuation of the leg heater in the control circuit.

FIG. 75 shows the flow chart of another operation of the leg heater 405 in the control circuit 466. The explanation of the operations described with reference to FIG. 74 will be omitted.

In this embodiment, not only the PTC heater 453, but also the axial flow fan 452 are turned on at the same time until the predetermined period of time elapses, but the fan is operated under the condition to flow a small amount of the air out, namely, the air in an amount smaller than the predetermined normal amount (step S9).

The word "small amount of the air" or the like used herein means the amount which does not give the user the cool touch.

Although the above embodiments are described with respect to the counter type adapter, the frame type adapter may also be used. Instead of the PTC heater, an electric heater such as a nichrome wire heater may also be employed.

According to the present invention, there is provided a means for remedying the defects caused by the PTC heater used as the heating means in the warm air generation.

Figure 76:
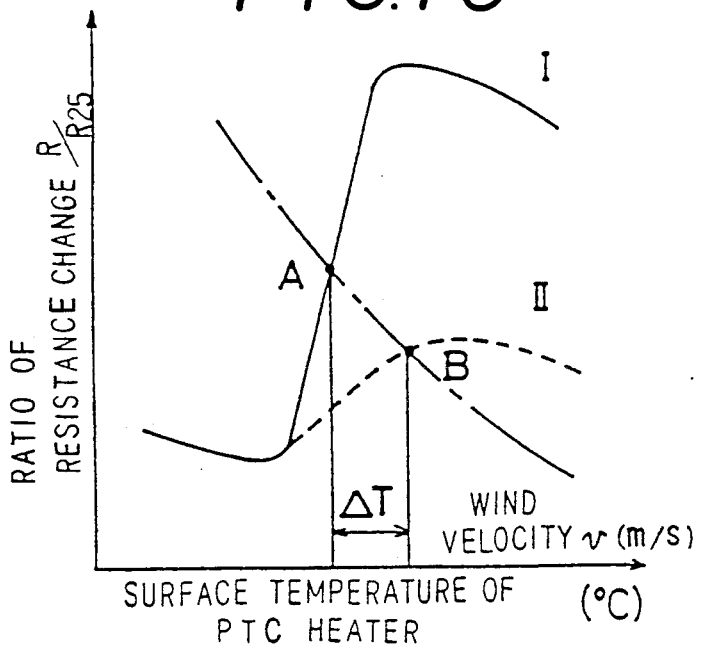
FIG. 76 is a graph showing the relationship between the surface temperature of a positive thermistor cell (hereinafter referred to as PTC) heater and a ratio of resistance at a given temperature to that at 25° C.
Figure 78:
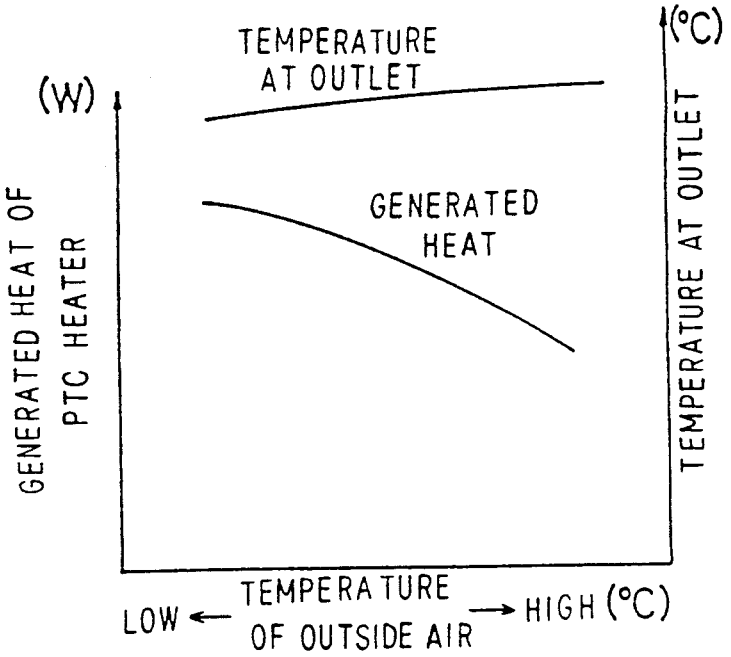
FIG. 78 is a graph showing the relationship between the temperature of the outside air, and a heat release value and the temperature at the outlet.

When the PTC heater is used under a reducing atmosphere such as hydrogen sulfide which is one of malodor components in the toilet room, the PTC characteristics can be changed by reduction. FIG. 76 is a graph showing the relationship between the surface temperature of the PTC heater and a ratio of resistance at a given temperature to that at 25° C. ($R_{25}$). When the PTC characteristics are changed, and the PTC resistance curve is changed from the curve I to the curve II. As a result, the operation point which is the intersection point of a wind velocity v (m/s) and the PTC resistance curve is moved from the point A to the point B. The surface temperature of the PTC heater is elevated by $\Delta T°$ C. Therefore, the conventional heating apparatus for the toilet room which apparatus employs the PTC heater has a problem that the PTC heater encounters the reduction deterioration when used for a long time, and then the PTC properties are changed. As a result, the surface temperature of the PTC heater, and thus, the temperature of the toilet room is elevated, whereby the heating feeling is lowered.

Accordingly, the present invention provides a combination of an outside air introducing type ventilating duct which inhales the air present outside the toilet room and blows out into the toilet room, a blower which is arranged in the ventilating duct and produces the air stream into the toilet room, and the PTC heater which is arranged in the ventilating duct and heats the air.

The above structure brings about the following advantages. The air present outside the toilet room is blown out into the toilet room by the blower, and thus the PTC heater is not exposed with the reducing gas such as hydrogen sulfide present in the toilet room, whereby the elevation of the surface temperature of the positive thermistor caused by the reduction deterioration can be avoided.

Further, the PTC heater can maintain the surface temperature thereof in a constant level. Therefore, when the temperature of the air outside the toilet room is lowered, the difference between the surface temperature of the PTC heater and that of the outside air is increased, and thus the heat release value is increased. Thus, the heated air blown out into the toilet room has a constant temperature, independently of the variation of the outside temperature. Further, the heating feeling is not lowered, even if the outside air has a low temperature.

Figure 77:
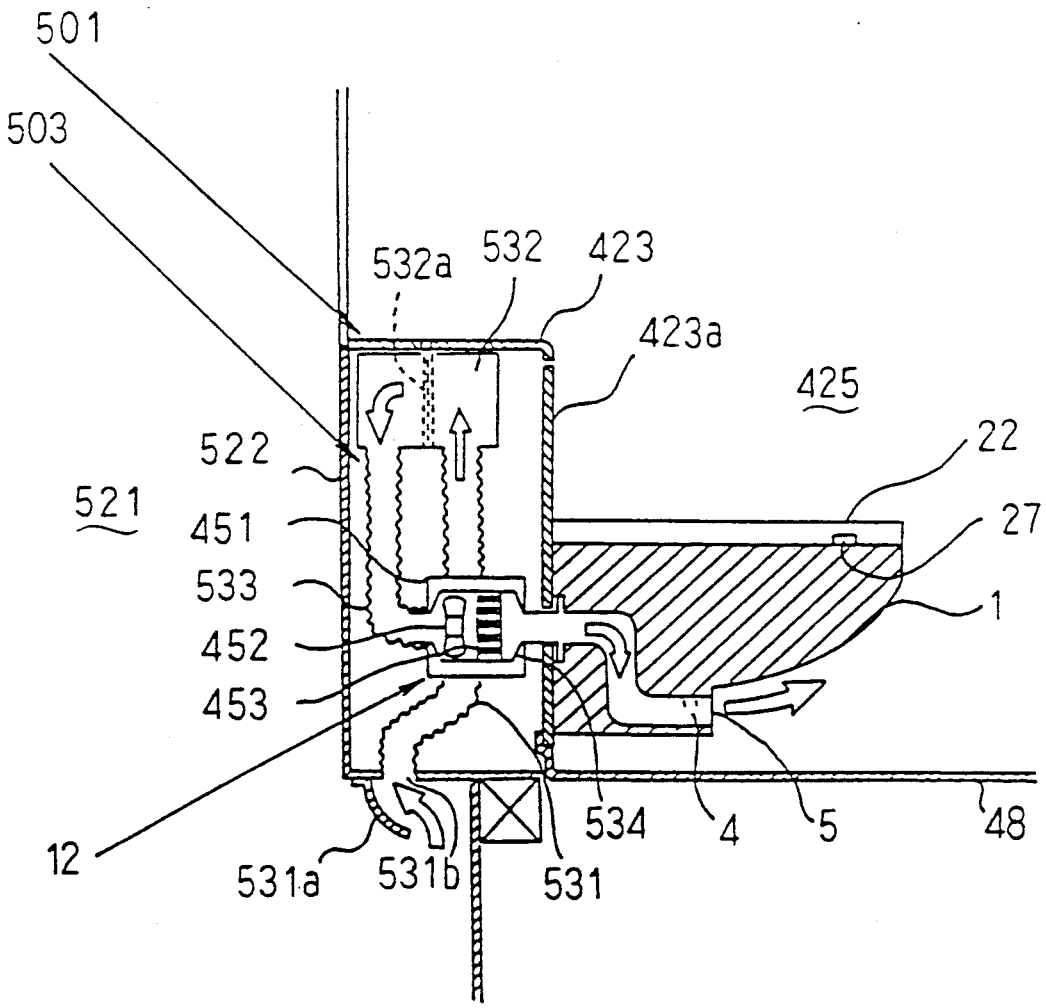
FIG. 77 is a sectional elevation view schematically illustrating the manner wherein the water closet unit using an intake vent for the outside air is installed in the toilet room.

FIG. 77 shows an embodiment wherein the above water closet is installed. The water closet unit 501 is arranged within the counter 523 disposed on the side wall 522 which is protruded to the outside 521 of the toilet room 20. The water closet 1 is attached to the side wall 423*a* of the counter 523. The counter 523 and the side wall 423*a* form the adapter.

The water closet 501 comprises the outside air introducing type ventilating duct 503 for blowing out the air (referred to as outside air) present outside 521 of the toilet room 20 (e.g., the outsides, or the adjoining room), and the warm air generator 12 arranged within the ventilating duct 503 comprises a bellows duct 531 for introducing the outside air, a chamber 532 connected with the duct 531, a bellows duct 533 connected with the chamber 532, the warm air duct 534 connected with the duct 533, and two warm air ducts 4 which are diverged from the warm air duct 534 and blow the warm air out to the leg of the user. An intake vent 531*b* having a hood 531*a* is arranged to the tip of the duct 531. The chamber 532 forms a space having a sectional area larger than those of the ducts 531 and 533, so as to reduce the pressure and control the variation caused by the wind as to the amount of the inhaled air. In the chamber 532, a filter 532*a* is disposed to adsorb the dust included in the outside air.

Heat insulating materials are disposed to the bifurcated ends 534*c* of the ventilating duct 534. Between the bifurcated ends 534*c* of the ventilating duct 534 and the warm air duct 4, there are provided sealing materials 534*a* and 534*b* to leak the warm air. At the end of the warm air duct 4, there is an opening between the lower portion of the water closet 1 and the floor 48 to form the warm air duct 4.

The warm air generator 12 comprises the casing 451 which covers the ventilating duct 534 with a gap therebetween to assure insulation with the air, the blower or the axial flow fan 452 which is arranged within the ventilating duct 534 and generates the air stream to the inside 425 of the toilet room 20, and two PTC heaters which are arranged within the ventilating duct 534 and heats the air stream passing therethrough.

The warm air generator and the like contained in the water closet unit 501 are turned on, when the pressure-sensitive seat switch 27 disposed under the toilet seat 22 of the water closet 1 is turned on. When the user sits down on the water closet 1, the resistance of the seat switch is changed by the weight of the user, and thus, the switch sends on-signals to the axial flow fan 452 and the PTC heater 453. When the user stands up, the resistance is changed, and the switch sends off-signals to the axial flow fan 452 and the PTC heater 453. When the user stands up, the resistance is changed, and the switch sends off-signals to the axial flow fan 452 and the PTC heater 453.

The axial flow fan 452 is rotated upon the receipt of the on-signal, and the outside air present in the outside 521 of the toilet room 20 is sucked through the outside air intake vent 531*b* to the ventilating duct 503. The sucked air is introduced into the chamber 532 via the duct 531. Relatively large dusts contained in the outside air are caught by the filter 532*a*.

After passing through the chamber 532, the outside air is conveyed to the ventilating duct 534 via the duct 322.

The Curie point of the PTC heater 453 is presetted to the point below the ignition temperature of the dust contained in the outside air. Upon receiving the on-signal, the PTC heater 453 consumes a large amount of the electric current to generate the heat, when the outside air has the low temperature, namely the resistance of the PTC heater is low. If the surface temperature is elevated to the temperature above the presetted Curie point, the resistance is rapidly increased. Then, the amount of the current consumed is restrained, and a constant surface temperature may be maintained, whereby the surface temperature may be maintained under the ignition temperature of the duct.

Because the air heated by the PTC heater 453 is the outside air which is introduced into ventilating duct 534 and is free from the reducing gases such as hydrogen sulfide, the reduction deterioration causing the elevation of the surface temperature of the PTC heater may be avoided, and thus, the ignition of foreign substances such as the dust adsorbed to the heater may be prevented. A reliable heating apparatus for the toilet room may be provided.

Further, the PTC heater 453 has a constant surface temperature. When the temperature of the outside air is lowered, the surface temperature of the PTC heater 453 becomes largely different from the temperature of the outside air. Then, the PTC heater may reduce the resistance thereof, consume a large amount of the current, and increase the heat (W) generated, whereby the reduction of the temperature of the outside air may be compensated by the increase of the heat generated. Therefore, the warm air outlet 5 of the warm air duct 4 can blow out the warm air heated by the PTC heater and having a constant temperature, regardless of the variation of the temperature of the outside air. Accordingly, the deterioration in the heating feeling can be prevented.

The temperature drop of the warm air blown out from the warm air outlet (caused by the temperature drop of the outside air) can be more effectively prevented. The amount of the air blown out can be controlled in accordance with the outside air temperature determined through a sensor for detecting the temperature of the outside air. For example, when the temperature of the outside air is lowered, the amount of the air blown out may be reduced to thereby maintain a constant temperature of the warm air at the warm air outlet.

The warm air outlet may be arranged on the side wall, ceiling, floor, or the like of the toilet room. Although the PTC heater may be formed by placing plural PTC heater plates by the side of another, the PTC heater may be produced from a single PTC heater. Further, an open-off valve may be disposed to the warm air duct so as to open and close the duct, dependently upon the necessity of the heating. Alternatively, an air-conditioning apparatus, such as an air-cooling apparatus, an air-cooling and heating apparatus, a ventilating apparatus may be installed in addition to the air-heating apparatus.

The PTC heater exhibits a function to control the amount of the current at the area where the resistance is suddenly increased from the point corresponding to the Curie point. Thus, the PTC heater has the property that the temperature thereof is not elevated above a given temperature. In general, the PTC heater does not require a protection device for overheating.

In the toilet room, however, the PTC heater employed in the heating apparatus can adsorb the dust from paper, clothes, or the like, which dust usually flies therein. The PTC heater employed in the heating apparatus for the toilet room is usually presetted to the temperature at which the dust from paper, clothes or the like does not ignite, by virtue of the function of controlling the current.

When the PTC heater is reduced with the reducing substances, however, the resistance increase caused by the temperature elevation becomes smaller. In other words, the current controlling function is lost if the PTC heater is reduced. The PTC heater can abnormally generate the heat. If the PTC heater is overheated, the PTC heater can reach the temperature at which the dust from paper, clothes or the like can ignite.

Further, if the PTC heater is overheated, the user can feel uncomfortable touch in the air overheated and blown out from the heating apparatus for the toilet room.

According to the present invention, there is provided a combination of the ventilating duct for conveying the air into the toilet room; the blower for generating in the ventilating duct the air stream to the toilet room; the PTC heater which is arranged within the ventilating duct, generates the heat when turned on, and increases the resistance thereof as the temperature is elevated; a safety means for turning the PTC heater off when the PTC heater is heated to the predetermined temperature.

In the above embodiment, the PTC heater is turned off by the safety means, if the PTC heater arranged in the ventilating duct is reduced with the reducing substances such as hydrogen sulfide, ammonia or the like contained in the air of the toilet room, thereby being rendered into the state where the resistance increase can not be obtained with the temperature elevation; and then, the PTC heater is overheated to the predetermined temperature which is the temperature near to the ignition point of the dust, such as paper, fiber from clothes, or which is the temperature giving the uncomfortable feeling to the user.

Figure 79:
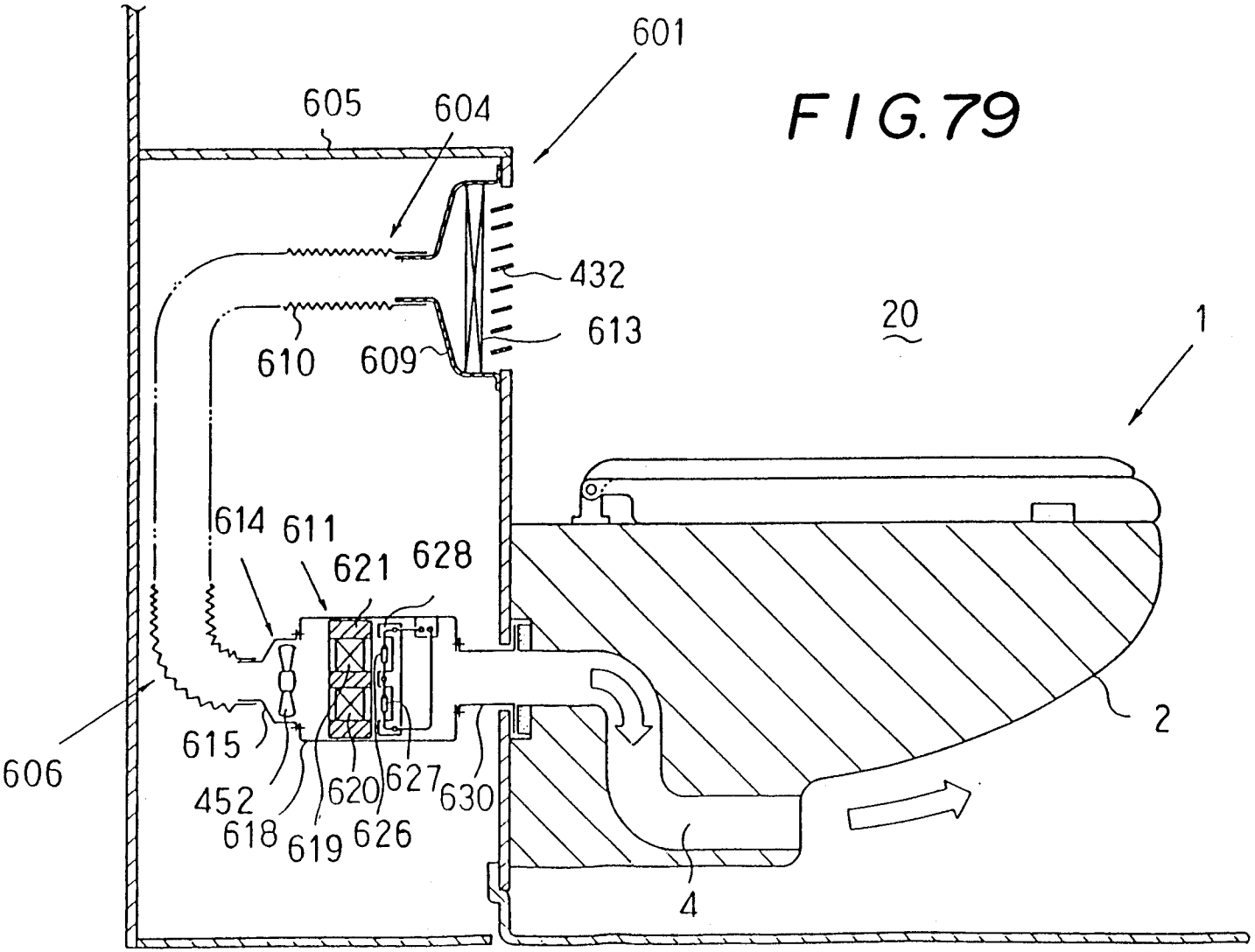
FIG. 79 is a sectional elevation view illustrating the manner wherein the water closet unit containing a safety means as an embodiment of the present invention is installed in the toilet room.

FIG. 79 shows an example wherein the above embodiment is installed in the water closet unit. The water closet unit 601 has the ventilating duct 604 for conveying the air from the lower portion of the toilet bowl 2 in the water closet 1 to the leg of the user. The duct 606 with the box disposed in the air-conditioner box 605 or adapter arranged at the rear side of the water closet 1 is connected with two ducts 4 integrally formed with the water closet 1 (FIG. 70) through the ventilating duct 604.

The duct 606 within the box comprises an intake duct 609 for inhaling the air in the toilet room 20, a bellows duct 610, and a heater unit 611. The intake duct 609 has a grill 432 in the upstream portion of the opening. In the grill 432, a filter 613 is provided to prevent the paper or the fiber of the clothes from entering the heater unit 611. The bellows duct 610 is a duct for guiding the air sucked from the intake duct 609 to the heater unit 611.

At the upstream portion of the heater unit 611, the blower 614 to generate in the ventilating duct 604 the air stream into the toilet room 20. This type of the blower 614 comprises the axial flow fan 451 disposed within the cylindrical resin blowing duct 615. A heat insulating duct 618 made of a heat insulating material follows the downstream portion of the blower 614. The insulating duct 618 contains therein a first PTC heater 619 and a second PTC heater. A heat insulating material 614 is interposed therebetween. The first PTC heater and the second PTC heater generate the heat when turned on, and the resistance thereof is suddenly increased from the Curie point. In this embodiment, the Curie point is presetted, for example, to 220°–250° C. which is lower than about 350° C., i.e., the ignition temperature of the paper, fiber of clothes, or the like. The first or second PTC heater 619 or 620 is an assembled article manufactured by laminating plural PTC heater plates with gaps therebetween in the form of a harmonica. The heater is arranged so that the air passes through the gaps between the PTC heater plates.

Figure 80:
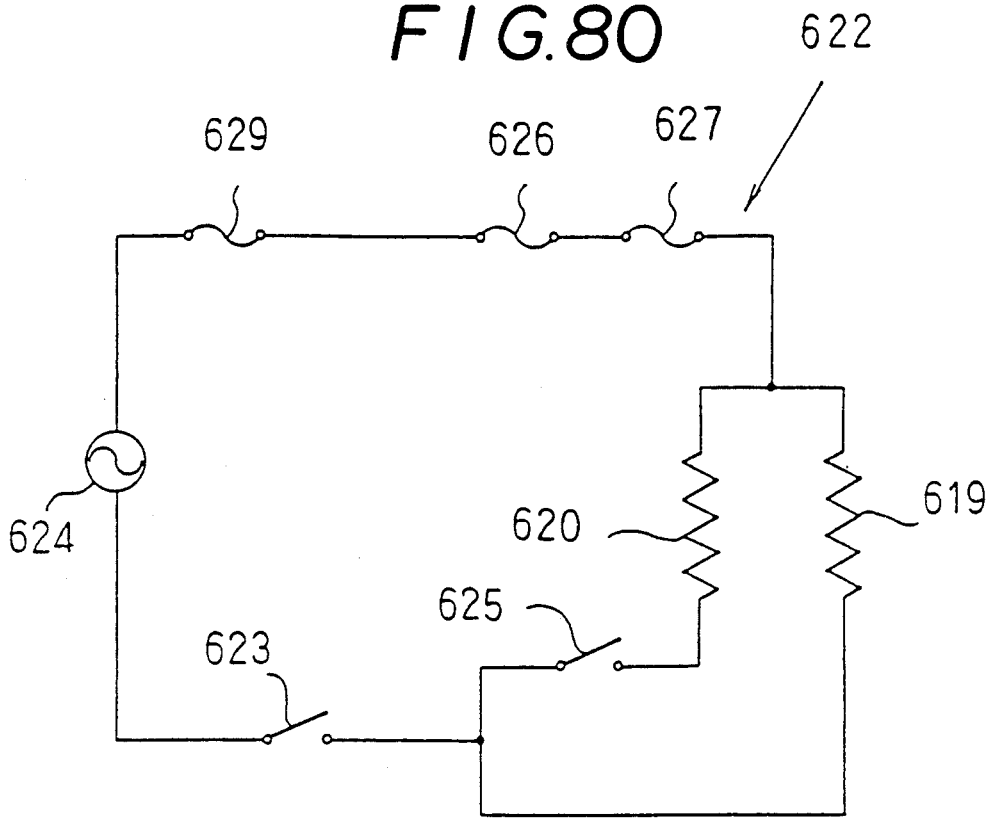
FIG. 80 is an electrical circuit diagram of an on-off control of a first PTC heater and a second PTC heater.

FIG. 80 shows an electrical circuit 624 for the on-off control of the first PTC heater 619 and the second PTC heater 620. The first PTC heater 619 and the second PTC heater 620 are connected with each other in parallel, and can be connected with a commercial alternating source 624, if the main switch 623 is manually turned on by the user. The second PTC heater has a sub-switch 625 which is connected with the second PTC heater in series and can manually turn only the second PTC heater 620 on and off. In the case that the main switch 623 is on, both of the first and second PTC heaters 619 and 620 are turned on, if the sub-switch 625 is turned on. In the above case, only the first PTC heater 619 is turned on, if the sub-switch 625 is turned off.

In the circuit of the first and second PTC heaters 619 and 620, temperature fuses 626 and 627 are interposed in series. Temperature fuses 626 and 627 are the safety means in this embodiment. If an atmosphere temperature is elevated up to the predetermined value, fuses are melted to break the circuit of the first and second PTC heaters 619 and 620. As shown in FIG. 79, temperature fuses 626 and 627 are arranged in the insulating duct 618 via heat-resistant insulating material, such as a mica plate 628, so that the warm air immediately after passing each of the first and second PTC heaters 619 and 620 touches directly the temperature fuse, respectively. The fuses 626 and 627 are formed to melt, if the first or second PTC heater is elevated up to the predetermined temperature, e.g., about 320° C., which is lower than the ignition point of the dust of paper or clothes, e.g., about 350° C. A current fuse 629 shown in FIG. 80 is a fuse for protecting the circuit by melting upon encountering overcurrent.

The operation of the above embodiment will be explained hereinafter. The user turns the main switch 623 on, and then, the blower 614 is turned on through a circuit (not shown), for example, when he feels the toilet room is cold. The air present in the toilet room 20 is sucked through the intake duct 609, and blown out from the warm air duct 4 in the water closet 1 to the leg of the user.

If not only the main switch 623, but also the sub-switch 625 are on, the first and second PTC heaters are turned on to generate the heat.

Figure 81:
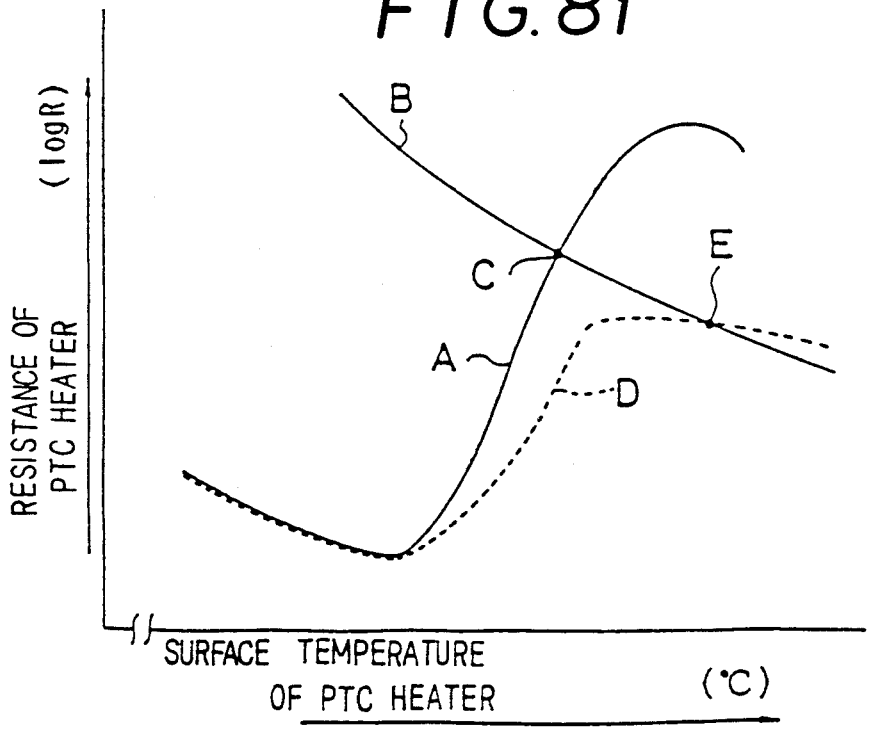
FIG. 81 is a graph showing the relationship between the temperature of the PTC heater and the resistance.

As shown in FIG. 81, the first and second PTC heaters have a resistance-temperature characteristics (curve A) that the heat is generated after turning on and the resistance is suddenly increased from the Curie point. In the ventilating duct 604, the air stream is produced by the blower 614. The temperature of the first or second PTC heater is determined by the crossing point C of the resistance-temperature characteristic curve A with the operation curve B defined by the amount of the air produced by the blower, the temperature of the air sucked, and the like.

The air blown out by the blower 614 to the leg of the user passes through either the heated first or second PTC heater 619 or 620. As a result, the air which has passed through the ventilating duct 604 is blown out as a relatively warm air from the lower portion of the toilet bowl 2 in the water closet 1 to the leg of the user (high operation).

When the main switch 623 is on, but the sub-switch 625 is off, only the first PTC heater 619 is worked, but the second PTC heater 620 is not turned on. As a result, the air passing through and heated by the first PTC heater 619 and the air passing through but not heated by the second PTC heater are agitated in the ventilating duct 604 at the downstream area of the first and second PTC heaters, and thus, the warm air having a relatively low temperature in comparison with that in the high operation is blown out to the leg of the user (low operation).

The air present in the toilet room 20 can contain the reduceing substances, such as hydrogen sulfide or ammonia formed from a detergent for the water closet 1.

If the PTC heaters 619 and 620 are exposed to the reducing substances, and then reduced therewith, the heaters do not exhibit the resistance elevation as the temperature elevation, as shown in FIG. 81 (curve D). In other words, the PTC heaters 619 and 620 lose the function to control the current as the temperature evevation, when reduced. The temperature of the reduced PTC heater 619 or 620 is elevated to the crossing point E of the operation curve B and the resistance-temperature characteristic curve D.

If at least one of the first and second PTC heaters 619 and 620 is reduced and elevated up to the predetermined temperature of 320° C., the temperature fuse 626 or 627 arranged at the downstream area of the overheated heater is melted to turn the PTC heaters 619 and 620 off.

As above, when at least one of the first and second PTC heaters 619 and 620 reaches 320° C., the safety means or the temperature fuse 626 or 627 is melted to cease the application of the current to the PTC heaters 619 and 620. Therefore, dusts adsorbed to the PTC heaters do not ignite. Further, the uncomfortable feeling caused by the unusual heat generation can be avoided.

If only one safety means is provided to the understream area of plural PTC heaters, the overheat generation can not be detected. This is because that some PTC heaters are reduced to generate the overheat, and a part of PTC heaters including the reduced PTC heaters as above is turned on, the temperature of the air heated thereby can be lower than that obtained by using all of the normal (not reduced) PTC heaters. Therefore, it is necessary to arrange the safety means (temperature fuse 626) for detecting the abnormal heat generation of the first PTC heater, and the safety means (temperature fuse 627) for the second PTC heater. If the first PTC heater is elevated to the predetermined temperature, when only the first PTC heater is operated (low operation), the abnormal heat generation of the first PTC can be detected.

Further, the safety means comprises the temperature fuses 626 and 627 connected with the first and second PTC heaters in series. Therefore, if one of the first and second PTC heaters generate the abnormal heat, both of the first and second PTC heaters are turned off.

Figure 82:
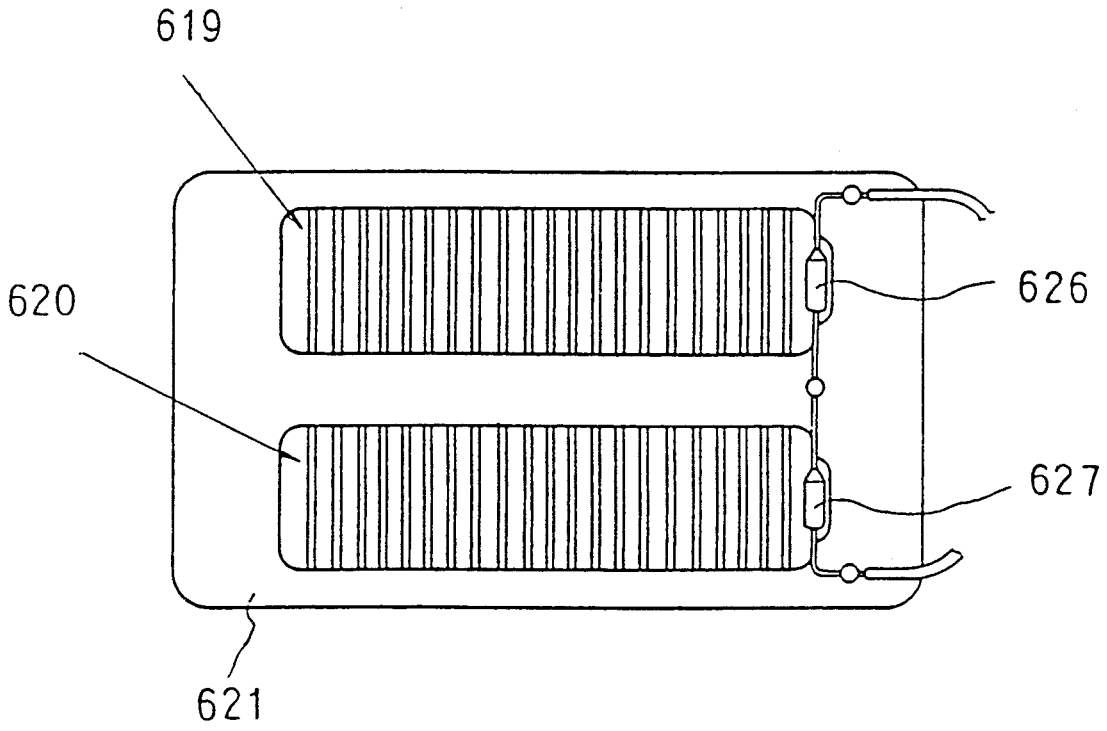
FIG. 82 illustrates the manner disposing temperature fuses.
Figure 83:
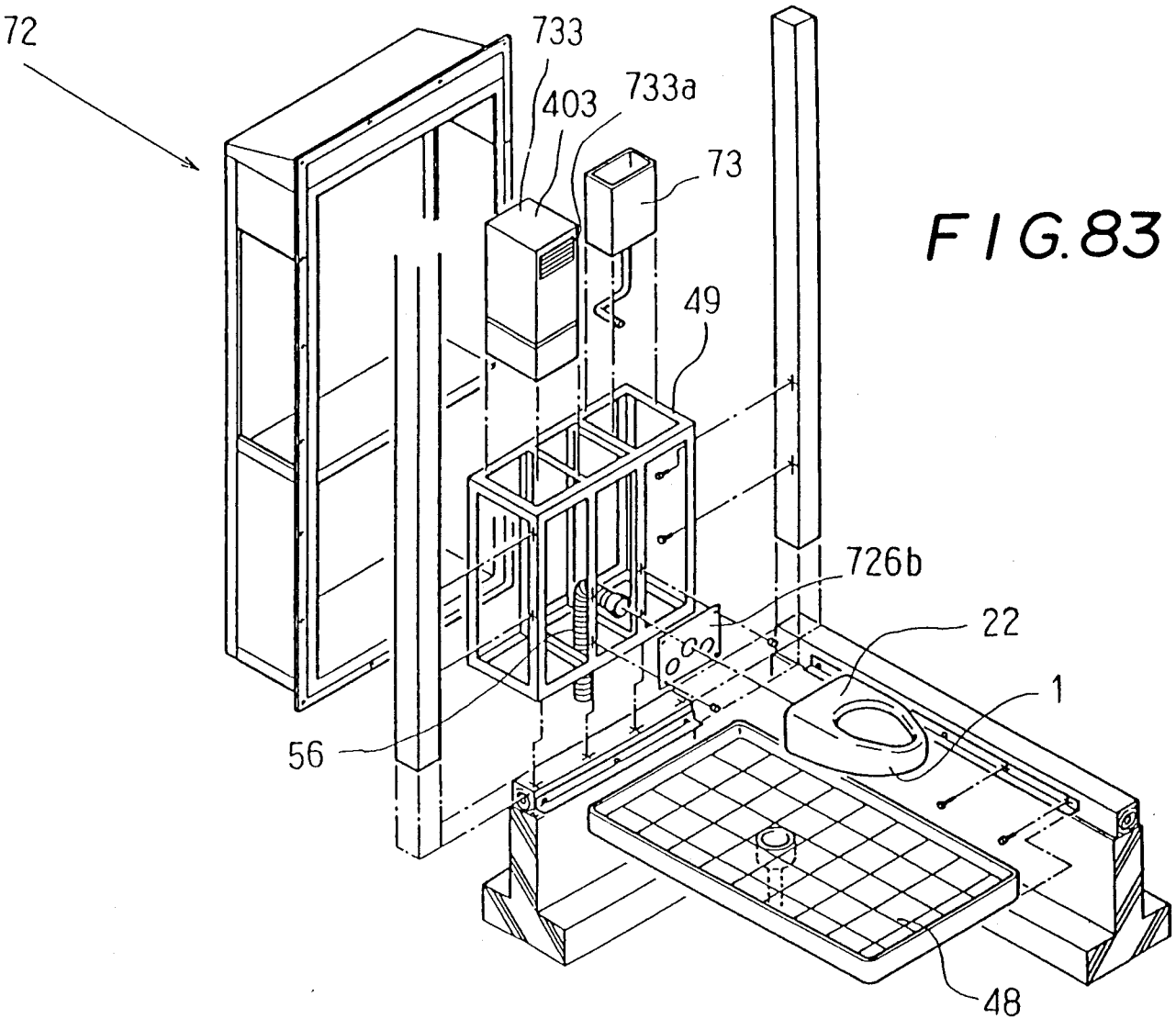
FIG. 83 illustrates the setting-up of the main part of an embodiment of the present invention wherein a wholly heating device is further disposed.
Figure 84:
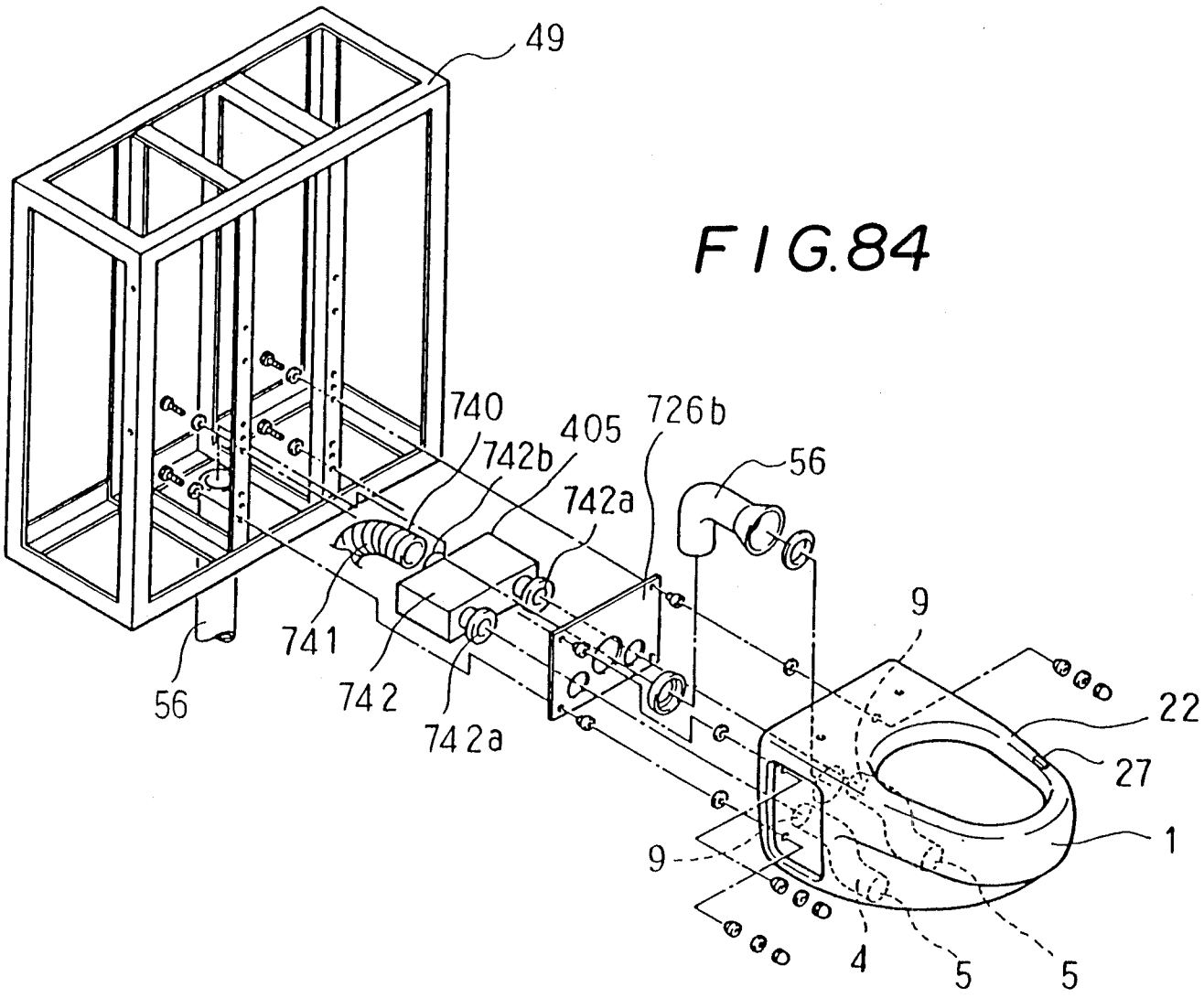
FIG. 84 shows an enlargement of the main part in FIG. 83.
Figure 86:
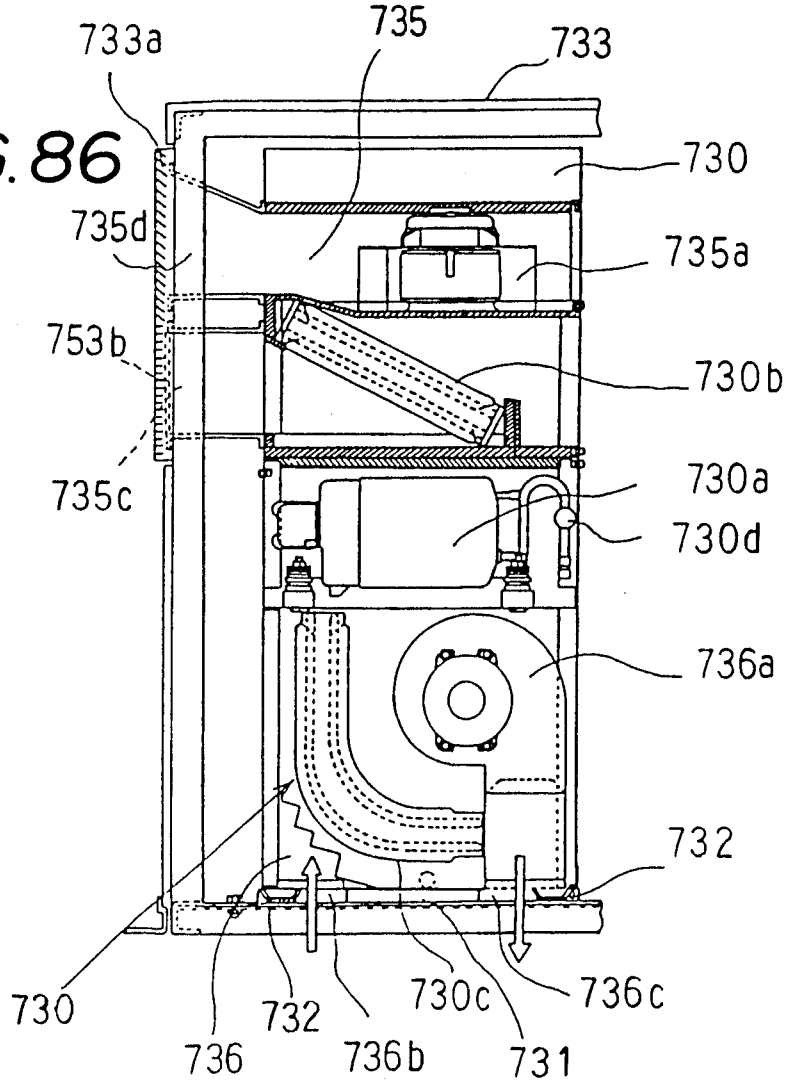
FIG. 86 is a sectional elevation view thereof.
Figure 85:
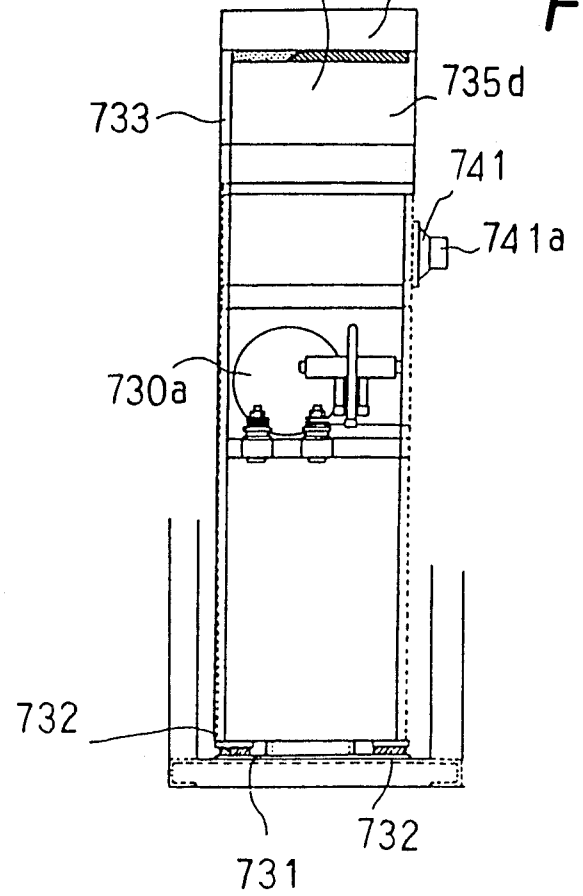
FIG. 85 is a front view of an air-conditioner.

FIG. 82 illustrates the embodiment wherein the temperature fuses 626 and 627 are attached to the heat-resistant insulating material 614 supporting the first and second PTC heaters.

It is possible to connect one temperature fuse (two in total) in parallel with each of the first and second PTC heaters and cease the current application only to the PTC heater causing the abnormal heat generation. Any number (one, or three or more) of PTC heaters may be disposed in the ventilating duct. The safety means may be used for the PTC heater to the wholly heating apparatus of the toilet room.

The seat switch (which is turned on when the user sits down on the water closet) may be connected with the main switch in series. A deferring circuit for postphoning the start to operate the blower for a given period of time may be arranged, thereby preventing the cool air from blowing the user shortly after the seat switch is turned on. Further, after user stands up from the water closet, the blower may continue to operate for a given period of time, to thereby prevent the deformation of the ventilating duct with a remaining heat.

A temperature sensor for detecting the temperature of the PTC heater may be used as the safety means instead of the temperature fuse. Using the temperature sensor, it is possible to control the current application to the PTC heater in accordance with the outlet from the sensor. Further, the current application can be controlled in accordance with the current amount or voltage of the PTC heater.

According to the preferred embodiment of the present invention, there is provided a water closet unit comprising (a) a wholly heating device for heating all over the toilet room, (b) a sensor device for detecting an entrance into and an exit from the toilet room by the user thereof, and (c) a control device which ceases an operation of the wholly heating device, and, at the same time, actuates the warm air generator included in the water closet unit, to thereby perform a partial heating, when the sensor device detects the entrance of the user, and on the other hand, which actuates the wholly heating device, and, at the same time, ceases the warm air generator to thereby stop the partial heating, when the sensor device detects the exit of the user.

The above water closet unit brings about the following advantages.

When the toilet room is empty, all over the room is heated with the wholly heating device.

When the user enters the toilet room, and the sensor detects the entrance thereby, the operation of the wholly heating device is stopped, whereas the electric heater and the blower start to operate. Therefore, the heated air is blown out from the water closet or the portion around the closet to the leg of the user.

When the user stands up from the water closet and the sensor detects the exit of the user from the toilet room, the electric heater and the blower are stopped operating, whereas the wholly heating device again starts to operate, thereby heating all over the toilet room.

As above, using the sinsor means, the control is made to change the operation of the air-conditioner from the whole heating to the partial heating (electric heater), and vice versa.

Because the wholly heating device is changed to the electric heater in the heating means, when the user enters the toilet room, the cool touch caused by the blown air having the low temperature can be avoided.

The high temperature air heated with the electric heater is applied to the exposed leg of the user, whereby the user can be rapidly and concentratedly heated at the portion where the user feels particularly cold. Further, because the operation of the wholly heating device is stopped when the user is in the toilet room, the cool feeling can be avoided, whereby the user can enjoy a comfortable atmosphere from the entrance into the room to the exit therefrom. The electric heater is operated for a short period of time when the user is in the room, and the cost can be saved.

The water closet unit of the above embodiment will be explained with respect to FIGS. 68 to 70, and 83 to 86.

The water closet 401 comprises, in addition to the leg heater 405 as the partially heating device for blowing the warm air out to the leg of the user, the heat pump type air-conditioner 403 for wholly heating all over the toilet room 20, and the control panel 406 for controlling the air-conditioner 403 and the leg heater 405.

A cubic frame type adapter 49 of stainless steel is installed within the bay window unit 72 to contain and fix the air-conditioner 403 and the leg heater 405. On the front surface of the cubic frame type adapter 49, the water closet 1 is attached thereto at the rear side of the closet with the bolts via a reinforced iron plate **726*b*. The bay window unit 72 contains therein toilet devices, such as the washing water tank 73, or the drainage pipe 56**.

The air-conditioner 403 serves as the wholly heating device in this embodiment, is a wind-fan type, and is contained in the cubic frame type adapter 49. The air-conditioner 403 is floatingly attached via a rubber mount 732 to a slide pan 731 fixed to the adapter 49 with bolts, whereby vibration of the water closet unit can be avoided by preventing transmission of vibration of the air-conditioner 403 to the bay window unit 72. A unit case 733 for the air-conditioner 430 is connected with the domestic electric source, and contains an electric box for supplying electric current to the air-conditioner 403 and the leg heater 405. The unit case 733 contains an inside air circulating duct 735 which is connected with the toilet room 20, and an outside air circulating duct 736 which is separated from the inside air circulating duct 735 with interstructures or the like and is connected with the outside of the toilet room 20.

A refrigerating cycle of the air-conditioner 403 comprises a compressor 730*a* for a refrigeration medium, a heat exchanger 730*b* for the inside of the room, a heat exchanger 730*c* for the outside of the room, a four-direction valve 730*d*, a vacuum device (not shown), and refrigeration medium pipes (not shown) for connecting the above components with each other.

The compressor 730*a* may compress the refrigeration medium sucked, and discharge the refrigeration medium with a high temperature and a high pressure.

The heat exchanger 730*b* for the inside of the room is disposed within the inside air circulating duct 735, and serves as a condenser to cool and condense the refrigeration medium having a high temperature and a high pressure and supplied from the compressor 730*a* upon a heating operation.

The heat exchanger 730*c* for the outside of the room is disposed within the outside air circulating duct 736, and serves as an evaporator to evaporate the refrigeration medium having a low temperature and a low pressure and supplied from the vacuum device by absorption of the heat from the atmosphere.

The four-direction valve 730*d* changes the flow directions of the refrigeration medium, and the refrigeration cycle from the heating operation to the cooling operation, and vice versa.

The vacuum device reduces the pressure of the refrigeration medium.

The inside air circulating duct 735 contains the heat exchanger 730*d* for the inside of the room, and a blower 735*a* for the inside of the room. By the blower 753*a*, the air present inside the room 20 is sucked from an intake vent 735*c* having a filter 735*b*, blown to the heat exchanger 730*b* for the inside of the room, and then blown from the outlet 735*d* to the inside of the toilet room 20. The filter 735*b* comprises a foam material which can adsorb the dust, and further may contain a deodorizer such as an activated carbon, an aromatic to neutrize the toilet odor, or the like.

The outside air circulating duct 736 contains the heat exchanger 730*c* for the outside of the room, and a blower 736*a* for the outside of the room. By the blower 736*a*, the air present outside the toilet room 20 is sucked from an intake vent 736*b*, blown to the heat exchanger 730*c* for the outside of the room, and discharged from the outlet 736*c* to the outside of the toilet room.

On the front surface of the unit case 733, a grill 733*a* is disposed to cover the intake vent 735*c* (having the filter 735*b*) and the outlet 735*d*.

When the PTC heater 453 is turned on, the air passing through the ventilating duct 404 is heated by the PTC heater 453.

The leg heater 405 is attached to the reinforced iron plate 726*b* with bolts so that the warm air outlet 426*a* of the heater case 426 is connected with the inlet 426*a* of the warm air duct 4, at the rear end of the water closet 1.

When the user enters the toilet room 20 and sits down on the toilet seat 22 on the water closet 1, the resistance of the seat switch 27 is changed by the weight of the user. The seat switch 27 is disposed under the toilet seat 22 of the water closet 1. The seat switch 27, when detecting the user sitting down on the seat, sends a signal to a control device (not shown) to turn the blower 452 and the PTC heater 453 on, and the air-conditioner 403 off. Further, the seat switch 27, when detecting the user standing up from the seat, sends a signal to the control device to turn the blower 452 and the PTC heater 453 off and the air-conditioner 403 on.

By virtue of the above structure, the heating means is changed from the air-conditioner 403 to the PTC heater when the use enters the toilet room, and so, the cool touch caused by the warm air having a relatively low temperature and blown out from the air-conditioner can be avoided.

Further, the warm air heated by the PTC heater 453 and having a relatively high temperature is brought into contact with the exposed leg of the user, and so, the user is rapidly heated, concentratedly at the portion where the user particularly feels cool. The temperature in the toilet room 20 can be maintained if the operation of the air-conditioner 403 is stopped, whereby the user can enjoy the comfortable atmosphere from the entrance to the exit. The PTC heater 453 is operated for a relatively short period of time when the user is in the toilet room 20, the cost for the operation may be saved.

The temperature when the toilet room is not employed is presetted to the level where the user does not feel warm, as well as cool, and the leg of the user can be heated when the seat switch is on. In this embodiment, the cost saving may be improved.

The present invention also relates to a prefabricated toilet room unit wherein the water closet unit is installed. The prefabricated toilet room unit can be manufactured by a conventional method, using the water closet unit as mentioned above.

Although the present invention has been described with reference to specific embodiments, various changes and modifications obvious to those skilled in the art are deemed to be within the spirit, scope and concept of the invention.

We claim:

1. A sitting type water closet adapted to be mounted in a toilet room comprising: a toilet bowl having a rear portion, a front portion and interior and exterior surfaces; a warm air path extending through said bowl between said interior and exterior surfaces from a warm air inlet defined in a rear surface of said bowl to a warm air outlet disposed in a front portion of said bowl; a warm air generator comprising a blower and a positive thermistor cell connected to said warm air inlet to provide a flow of warm air through said warm air path and into said toilet room; and an intake vent connected between said warm air generator and a location outside of said toilet room.

2. A sitting type water closet according to claim 1, further comprising a safety means connected to said positive thermistor cell for ceasing application of an electric current to said positive thermistor cell when said positive thermistor cell reaches a predetermined temperature.

* * * * *